US007966166B2

(12) United States Patent
Thambynayagam et al.

(10) Patent No.: US 7,966,166 B2
(45) Date of Patent: Jun. 21, 2011

(54) METHOD FOR DETERMINING A SET OF NET PRESENT VALUES TO INFLUENCE THE DRILLING OF A WELLBORE AND INCREASE PRODUCTION

(75) Inventors: R. K. Michael Thambynayagam, Sugar Land, TX (US); Andrew Carnegie, Kuala Lumpur (MY); Raj Banerjee, Oxon (GB); Gregory P. Grove, Houston, TX (US); Luca Ortenzi, Mogliano (IT); Roger Griffiths, Schaffhausen (CH); Joseph A. Ayoub, Katy, TX (US); Jeff Spath, Missouri City, TX (US)

(73) Assignee: Schlumberger Technology Corp., Houston, TX (US)

( * ) Notice: Subject to any disclaimer, the term of this patent is extended or adjusted under 35 U.S.C. 154(b) by 555 days.

(21) Appl. No.: 12/148,415

(22) Filed: Apr. 18, 2008

(65) Prior Publication Data

US 2009/0260880 A1 Oct. 22, 2009

(51) Int. Cl.
*G06G 7/48* (2006.01)

(52) U.S. Cl. ..... 703/10; 702/9; 700/28

(58) Field of Classification Search ..... 703/10
See application file for complete search history.

(56) References Cited

U.S. PATENT DOCUMENTS 5,842,149 A * 11/1998 Harrell et al. ..... 702/9
5,992,519 A * 11/1999 Ramakrishnan et al. 166/250.15
6,775,578 B2 * 8/2004 Couet et al. ..... 700/28
6,853,921 B2 * 2/2005 Thomas et al. ..... 702/14
7,181,380 B2 * 2/2007 Dusterhoft et al. ..... 703/10
7,337,660 B2 * 3/2008 Ibrahim et al. ..... 73/152.55
7,430,501 B2 * 9/2008 Feraille et al. ..... 703/10
7,512,543 B2 * 3/2009 Raghuraman et al. ..... 705/7
2005/0096893 A1 5/2005 Feraille
2005/0119911 A1 * 6/2005 Ayan et al. ..... 705/1
2007/0112547 A1 5/2007 Ghorayeb
2007/0156377 A1 7/2007 Gurpinar
2007/0168133 A1 7/2007 Bennett
2007/0168170 A1 7/2007 Thomas
2007/0299643 A1 12/2007 Guyaguler

OTHER PUBLICATIONS

Durlofsky et al, "Advanced Techniques for Reservoir Simulation and Modeling of Nonconventional Wells", Final Report, Stanford University, Department of Petroleum Engineering, Aug. 20, 2004.*
Smiseth et al, "DollarTarget-Optimize Trade-Off Between Risk and Return in Well Planning and Drilling Operations", SPE 111693, 2008 SPE Intelligent Energy Conference and Exhibition, Feb. 25-27, 2008.*
Primera et al, "Simulation While Drilling: Utopia or Reality?", SPE 99945, 2006 SPE Intelligent Energy Conference and Exhibition, Apr. 11-13, 2006.*

(Continued)

*Primary Examiner* — Mary C Jacob
(74) *Attorney, Agent, or Firm* — Robert P. Lord; Cuong L. Nguyen; Bryan P. Galloway

(57) ABSTRACT

A method is disclosed for modeling a first reservoir while drilling a wellbore into a corresponding second reservoir, the first reservoir having a plurality of stations, comprising: determining a plurality of values of net present value corresponding, respectively, to the plurality of stations of the first reservoir; and drilling the wellbore into the corresponding second reservoir in accordance with the plurality of values of net present value.

41 Claims, 4 Drawing Sheets

OTHER PUBLICATIONS

Boe et al, "On Real Time Reservoir Management and Simulation While Drilling", SPE 65149, SPE European Petroleum Conference, Oct. 24-25, 2000.*

Sakowski et al, "Impact of Intelligent Well Systems on Total Economics of Field Development", SPE 94672, 2005 SPE Hydrocarbon Economics and Evaluation Symposium, Apr. 3-5, 2005.*

Yeten et al, "Optimization of Nonconventional Well Type, Location and Trajectory", SPE 77565, 2002 SPE Annual Technical Conference and Exhibition, Sep.29-Oct. 2, 2002.*

Omaire, A., "Economic Evaluation of Smart Well Technology," Thesis, Texas A&M University, May 2007 [retrieved Jul. 14, 2009] Retrieved from the Internet <URL: http://txspace.tamu.edu/bitstream/handle/1969.1/5931/etd-tamu-2007A-PETE-AlOmair.pdf?sequence=1> Entire document, especially: p. 5, para 1; p. 7, para 1-2; p. 43, col. 3 thru p. 44, col. 1; Figs 2.1, 2.2 and Table 4.19, 4.20.

Bourgeois, D., et al. "Improving Well Placement With Modeling While Drilling," Oilfield Review, Winter 2006, vol. 18, No. 4 [retrieved Jul. 14, 2009] Retrieved from the Internet, <URL: http://public.slb.com/media/services/resources/oilfieldreview/ors06/win06p20_29.pdf>.

* cited by examiner

METHOD FOR DETERMINING A SET OF NET PRESENT VALUES TO INFLUENCE THE DRILLING OF A WELLBORE AND INCREASE PRODUCTION

BACKGROUND

The subject matter set forth in this specification relates to a software (hereinafter called the "NPV Max Software") that is adapted to be stored in a workstation or other computer system, the NPV Max Software being adapted for optimizing or maximizing a Net Present Value (NPV) of a well while drilling and estimating production from a reservoir field while drilling.

The term 'reservoir characterization and optimization of productivity while drilling' means 'the ability to perform reliable interpretations sufficiently rapidly so as to be able to influence major decisions'. An example of such a major decision could be 'how to steer a well being drilled' in order to optimize the productivity and expected ultimate recovery (EUR) from the reservoir field into which the well is being drilled. This specification discloses a 'reservoir characterization and optimization of productivity while drilling' method (including its associated system or apparatus and program storage device and computer program) that will: (1) optimize or maximize the Net Present Value (NPV) of a well while drilling into a reservoir field, and (2) estimate a production from the reservoir field while drilling the well into the reservoir field.

SUMMARY

One aspect of the present invention involves a method of modeling a first reservoir while drilling a wellbore into a corresponding second reservoir, the first reservoir having a plurality of stations, comprising: (a) determining a plurality of values of net present value corresponding, respectively, to the plurality of stations of the first reservoir; and (b) drilling the wellbore into the corresponding second reservoir in accordance with the plurality of values of net present value.

Another aspect of the present invention involves a method for determining an optimum trajectory of a wellbore being drilled into a reservoir, comprising: (a) modeling a corresponding reservoir in a simulator, the corresponding reservoir having a plurality of stations; (b) determining a plurality of net present values corresponding, respectively, to the plurality of stations of the corresponding reservoir; (c) determining, from among the plurality of net present values, a subset of maximum ones, relative to a predetermined threshold, of the plurality of net present values; (d) determine, from among the plurality of stations of the corresponding reservoir, a subset of stations which correspond, respectively, to the subset of maximum ones of the plurality of net present values; and (e) drilling the wellbore in the reservoir along a path which corresponds to the subset of stations, the optimum trajectory of the wellbore being drilled into the reservoir corresponding to the path.

Another aspect of the present invention involves a method of determining an optimum drilling method associated with a drilling of a wellbore into a reservoir, comprising: (a) modeling a corresponding reservoir in a simulator, the corresponding reservoir having a plurality of stations; (b) determining a plurality of net present values corresponding, respectively, to the plurality of stations of the corresponding reservoir; (c) determining, from among the plurality of net present values, a subset of maximum ones, relative to a predetermined threshold, of the plurality of net present values; (d) determine, from among the plurality of stations of the corresponding reservoir, a subset of stations which correspond, respectively, to the subset of maximum ones of the plurality of net present values; and (e) selecting a drilling method associated with a drilling of a wellbore into a reservoir in accordance with the subset of stations which correspond, respectively, to the subset of maximum ones of the plurality of net present values.

Another aspect of the present invention involves a program storage device readable by a machine tangibly embodying a set of instructions executable by the machine to perform method steps for modeling a first reservoir while drilling a wellbore into a corresponding second reservoir, the first reservoir having a plurality of stations, the method steps comprising: (a) determining a plurality of values of net present value corresponding, respectively, to the plurality of stations of the first reservoir; and (b) drilling the wellbore into the corresponding second reservoir in accordance with the plurality of values of net present value.

Another aspect of the present invention involves a program storage device readable by a machine tangibly embodying a set of instructions executable by the machine to perform method steps for determining an optimum trajectory of a wellbore being drilled into a reservoir, the method steps comprising: (a) modeling a corresponding reservoir in a simulator, the corresponding reservoir having a plurality of stations; (b) determining a plurality of net present values corresponding, respectively, to the plurality of stations of the corresponding reservoir; (c) determining, from among the plurality of net present values, a subset of maximum ones, relative to a predetermined threshold, of the plurality of net present values; (d) determine, from among the plurality of stations of the corresponding reservoir, a subset of stations which correspond, respectively, to the subset of maximum ones of the plurality of net present values; and (e) drilling the wellbore in the reservoir along a path which corresponds to the subset of stations, the optimum trajectory of the wellbore being drilled into the reservoir corresponding to the path.

Another aspect of the present invention involves a program storage device readable by a machine tangibly embodying a set of instructions executable by the machine to perform method steps for determining an optimum drilling method associated with a drilling of a wellbore into a reservoir, the method steps comprising: (a) modeling a corresponding reservoir in a simulator, the corresponding reservoir having a plurality of stations; (b) determining a plurality of net present values corresponding, respectively, to the plurality of stations of the corresponding reservoir; (c) determining, from among the plurality of net present values, a subset of maximum ones, relative to a predetermined threshold, of the plurality of net present values; (d) determine, from among the plurality of stations of the corresponding reservoir, a subset of stations which correspond, respectively, to the subset of maximum ones of the plurality of net present values; and (e) selecting a drilling method associated with a drilling of a wellbore into a reservoir in accordance with the subset of stations which correspond, respectively, to the subset of maximum ones of the plurality of net present values.

Another aspect of the present invention involves a system adapted for modeling a first reservoir while drilling a wellbore into a corresponding second reservoir, the first reservoir having a plurality of stations, comprising: apparatus adapted for determining a plurality of values of net present value corresponding, respectively, to the plurality of stations of the first reservoir; and apparatus adapted for drilling the wellbore into the corresponding second reservoir in accordance with the plurality of values of net present value.

Another aspect of the present invention involves a system adapted for determining an optimum trajectory of a wellbore being drilled into a reservoir, comprising: apparatus adapted for modeling a corresponding reservoir in a simulator, the corresponding reservoir having a plurality of stations; apparatus adapted for determining a plurality of net present values corresponding, respectively, to the plurality of stations of the corresponding reservoir; apparatus adapted for determining, from among the plurality of net present values, a subset of maximum ones, relative to a predetermined threshold, of the plurality of net present values; apparatus adapted for determining, from among the plurality of stations of the corresponding reservoir, a subset of stations which correspond, respectively, to the subset of maximum ones of the plurality of net present values, drilling the wellbore in the reservoir along a path which corresponds to the subset of stations, the optimum trajectory of the wellbore being drilled into the reservoir corresponding to the path.

Another aspect of the present invention involves a system adapted for determining an optimum drilling method associated with a drilling of a wellbore into a reservoir, comprising: apparatus adapted for modeling a corresponding reservoir in a simulator, the corresponding reservoir having a plurality of stations; apparatus adapted for determining a plurality of net present values corresponding, respectively, to the plurality of stations of the corresponding reservoir; apparatus adapted for determining, from among the plurality of net present values, a subset of maximum ones, relative to a predetermined threshold, of the plurality of net present values; apparatus adapted for determining, from among the plurality of stations of the corresponding reservoir, a subset of stations which correspond, respectively, to the subset of maximum ones of the plurality of net present values, selecting a drilling method associated with a drilling of a wellbore into a reservoir in accordance with the subset of stations which correspond, respectively, to the subset of maximum ones of the plurality of net present values.

Another aspect of the present invention involves a computer program adapted to be executed by a processor, the computer program, when executed by the processor, conducting a process for modeling a first reservoir while drilling a wellbore into a corresponding second reservoir, the first reservoir having a plurality of stations, the process comprising: (a) determining a plurality of values of net present value corresponding, respectively, to the plurality of stations of the first reservoir, the wellbore being drilled into the corresponding second reservoir in accordance with the plurality of values of net present value.

Further scope of applicability will become apparent from the detailed description presented hereinafter. It should be understood, however, that the detailed description and the specific examples set forth below are given by way of illustration only, since various changes and modifications within the spirit and scope of the 'NPV Max Software', as described and claimed in this specification, will become obvious to one skilled in the art from a reading of the following detailed description.

BRIEF DESCRIPTION OF THE DRAWINGS

A full understanding will be obtained from the detailed description presented hereinbelow, and the accompanying drawings which are given by way of illustration only and are not intended to be limitative to any extent, and wherein.

DESCRIPTION

This specification discloses a software (hereinafter called the "NPV Max Software") that is adapted to be stored in a workstation or other computer system, the NPV Max Software being adapted for 'optimizing or maximizing the Net Present Value (NPV) of a well' while drilling and estimating production from a reservoir field while drilling. It should be understood that the definition of "optimizing or maximizing the Net Present Value (NPV) of a well" also means ensuring that the total NPV of the field into which it is being drilled is also optimized, and hence that the NPV of the field must (at the very least) not reduce due to the drilling of the well.

Figure 1:
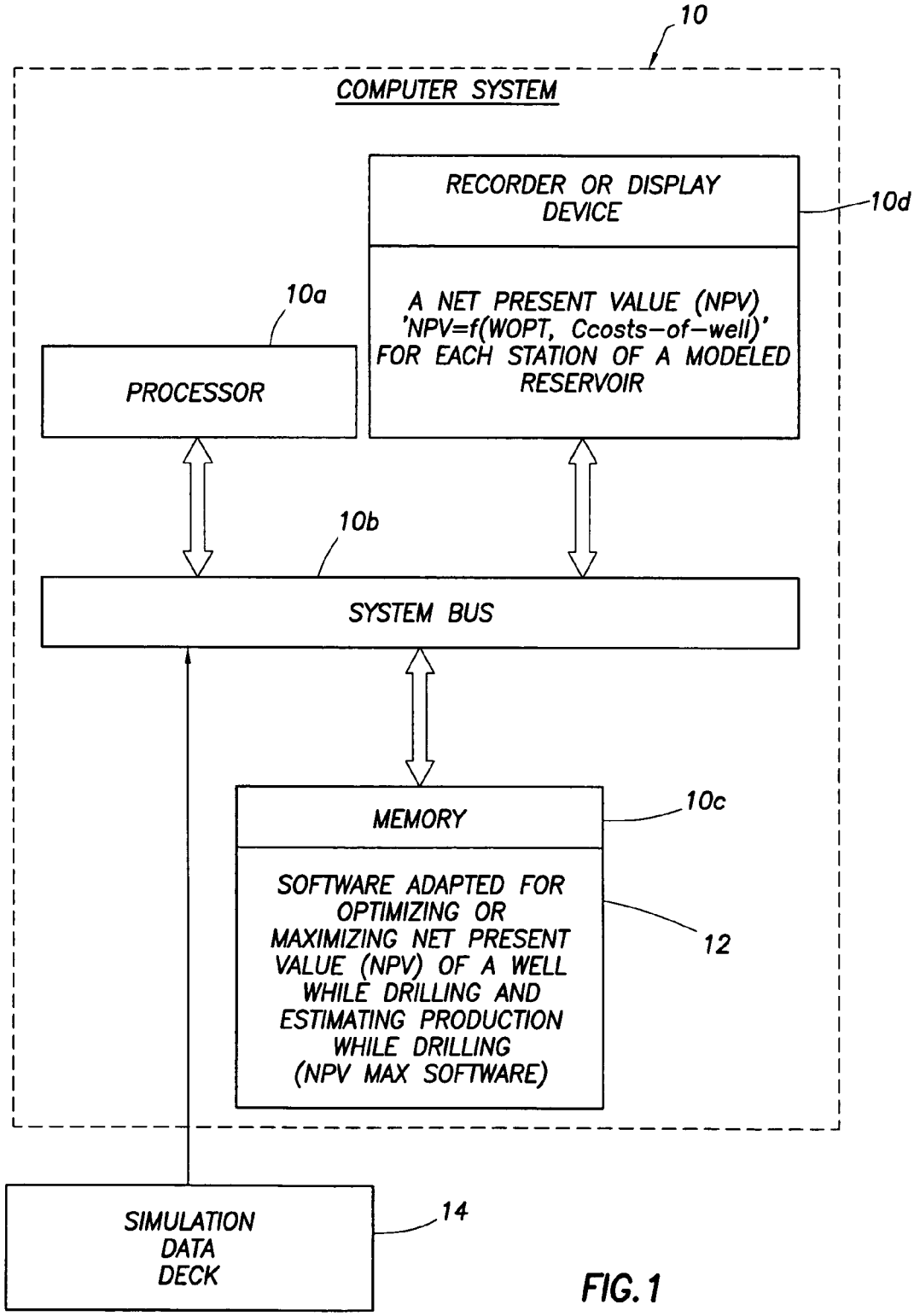
FIG. 1 illustrates a computer system adapted for storing a 'Software adapted for optimizing or maximizing Net Present Value (NPV) of a well while drilling and estimating production while drilling', hereinafter called the "NPV Max Software"
Figure 2:
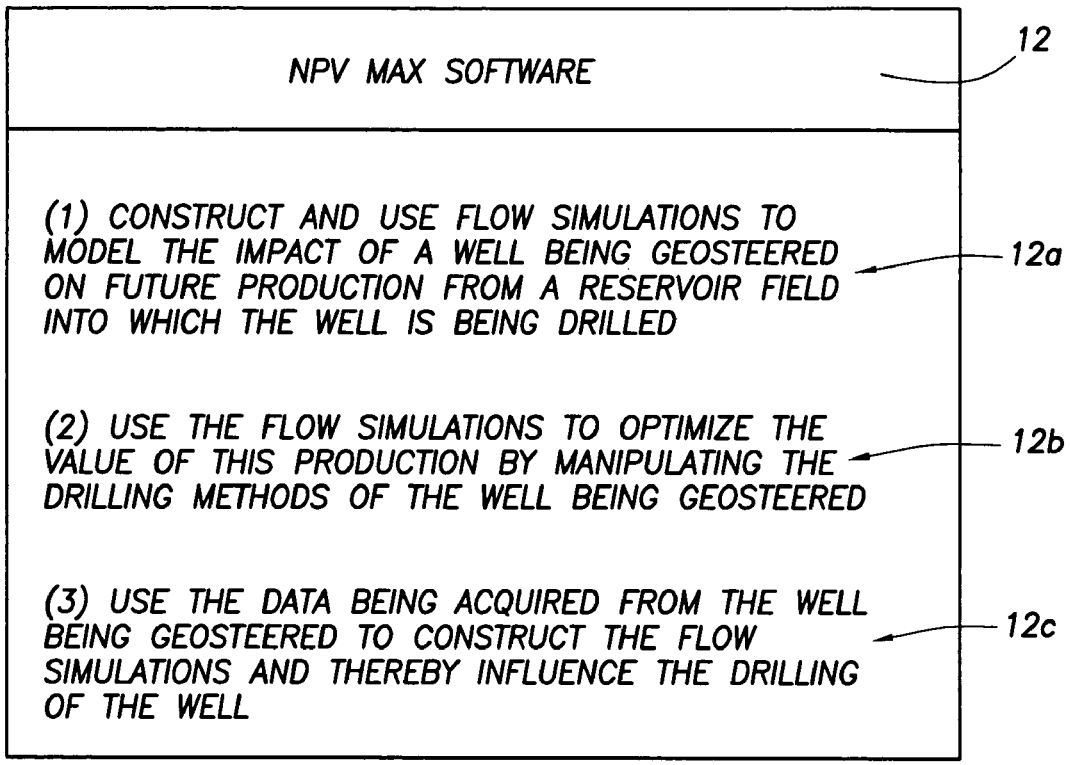
FIG. 2 illustrates a function associated with the NPV Max Software of FIG. 1.

In FIG. 2, the basic 'functions of the NPV Max software 12' are illustrated: (1) construct and use flow simulations to model the impact of a well being geosteered on future production from a reservoir field into which the well is being drilled, 12*a*, (2) use the flow simulations to optimize (or maximize) the value of this production by manipulating the drilling methods of the well being geosteered, 12*b*, and (3) use the data acquired from the well being geosteered to construct the flow simulations and thereby influence the drilling of the well, 12*c*. Using the method associated with the 'NPV Max Software' disclosed in this specification, the drilling of a wellbore in a real (not modeled) reservoir commences, and, simultaneously, the processor of a computer system (of FIG. 1) begins to execute the 'NPV Max Software' in order to calculate a value of the 'Net Present Value (NPV)' for each 'station' of a 'modeled reservoir' thereby generating a 'plurality of values of the NPV' corresponding, respectively, to the 'plurality of stations of the modeled reservoir', where the 'plurality of the values of NPV' corresponding, respectively, to the 'plurality of stations of the modeled reservoir' will aid and assist a 'drilling person or entity' in the drilling of a wellbore in a reservoir. For example, the wellbore's trajectory can be changed while drilling, or the drilling methods used to drill the wellbore can be changed accordingly. That is, the 'drilling person or entity' (when drilling the wellbore in the reservoir) will determine (from among the 'plurality of values of NPV' corresponding, respectively, to the 'plurality of stations of the modeled reservoir') the stations of the modeled reservoir which have the 'optimum ones' or 'maximum ones' of the 'plurality of values of NPV'. The 'drilling person or entity' can then 'geosteer' or change the trajectory of the wellbore (being drilled into the reservoir) in order to follow the stations of the modeled reservoir which have the 'optimum ones' or 'maximum ones' (relative to a predetermined threshold) of the 'plurality of values of NPV'

The term 'reservoir characterization and optimization of productivity while drilling' means 'the ability to perform reliable interpretations sufficiently rapidly so as to be able to influence major decisions'. An example of such a major decision could be 'how to steer a well being drilled' in order to optimize the productivity and expected ultimate recovery (EUR) from the reservoir field into which the well is being drilled. The 'NPV Max Software' disclosed in this specification practices a 'reservoir characterization and optimization of productivity while drilling' method (which includes an associated system and program storage device and computer program) that will: (1) optimize or maximize the Net Present Value (NPV) of a well while drilling the well into a reservoir field, and (2) estimate a production from the reservoir field while drilling the well into the reservoir field. As a result, the 'NPV Max Software' disclosed in this specification will optimize or maximize a Net Present Value (NPV) of a well while drilling the well into a reservoir field, and estimate a production from the reservoir field while drilling the well into the reservoir field.

In this specification, it is proposed that 'while-drilling workflows' can be facilitated by combining a 'static near well bore geologic (layered formation) and petrophysical model' with a 'fast reservoir simulator'. A simulation study can be done in advance of the drilling. This predicts a range of well productivities and provides a 'Base Model case' against which one can compare 'updated models'. Then, while drilling, when there are periodic updates at 'stations', a predefined workflow is executed which performs modeling to re-generate and launch the 'fast simulations'. Having an 'estimated range of productivities as the drilling proceeds' is extremely useful. In addition, the term 'station' can be defined as a 'time dependent point at which the workflow is executed'. This is a 'virtual station' in the sense that the number of stations and the time dependency is variable and problem dependent. The information can be used to: (1) stop drilling when the optimal production scenario is reached, (2) eliminate unnecessary costs, (3) evaluate the economic viability of continued drilling in marginal reservoirs, and (4) reduce risk and uncertainty. An 'optimal production scenario' is the state of having the 'maximum expected NPV', subjected to a predefined acceptable level of risk. The term 'Net Present Value (NPV)' is a function of the 'expected value of hydrocarbon production, minus the costs of drilling and completing and maintaining the well'. Different trajectories associated with drilling a wellbore in a reservoir field can be simulated in order to evaluate: (1) the impact of the steering plan on the final production from the reservoir field, and (2) the Net Present Value (NPV). As a result, the risks and rewards associated with continued drilling in the reservoir field can be appraised in real time in order to make informed decisions.

The following 'methods or functions, apparatus, and data' are 'pre-requisite to' the 'reservoir characterization and optimization of productivity while drilling' method that is practiced by the 'NPV Max Software' disclosed in this specification: (1) a method or function which will characterize the 'near well bore environment', including layering, (2) an apparatus known as a 'fast fluid flow simulator' for a layered reservoir, and (3) data known as 'diagnostics and history matching formation testing while drilling (TestWD) data'.

Referring to FIGS. 1 and 2, a computer system is illustrated that is adapted for storing a 'Software adapted for optimizing or maximizing Net Present Value (NPV) of a well while drilling and estimating production while drilling (NPV Max Software)'.

Figure 3:
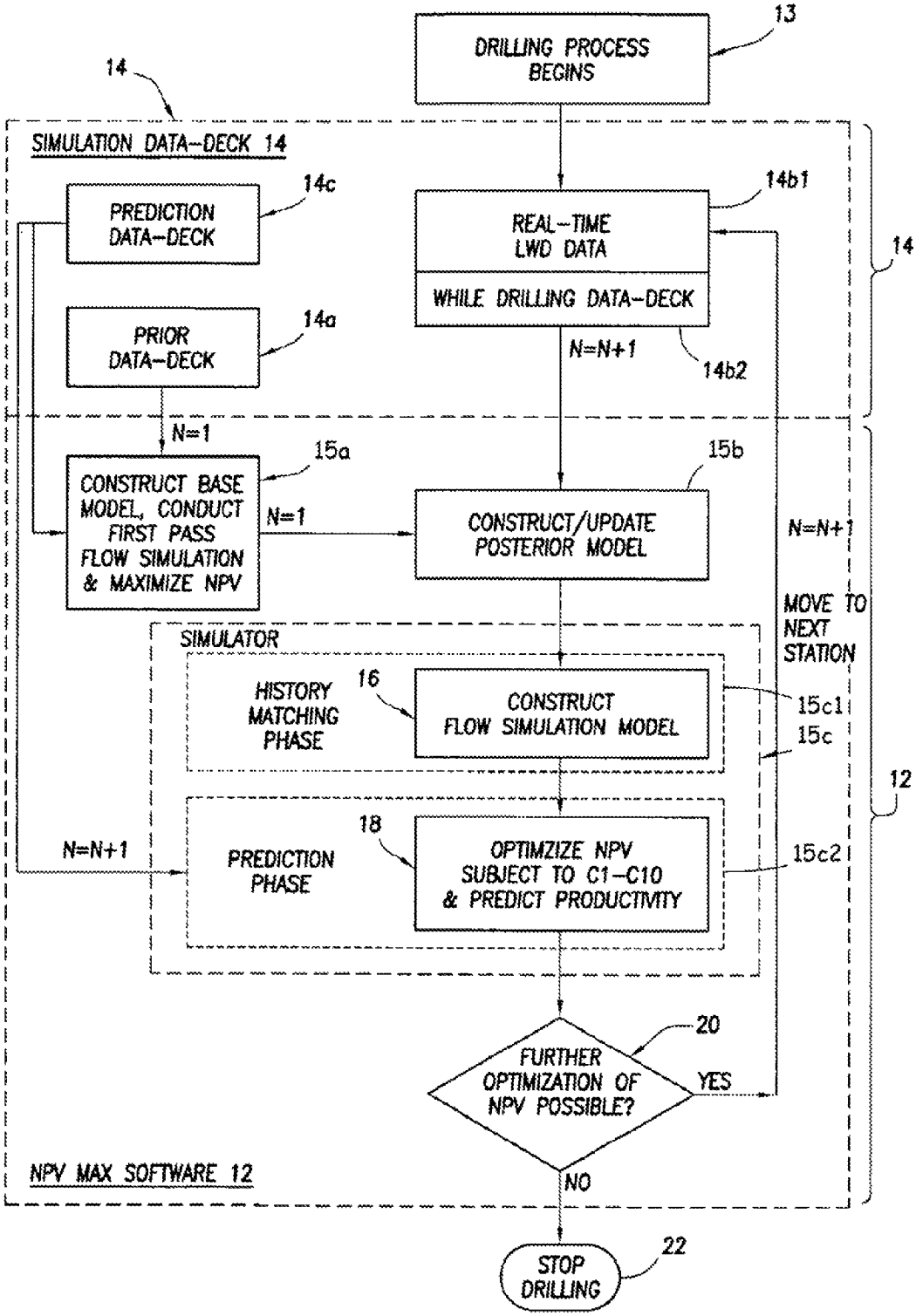
FIG. 3 illustrates a detailed construction of the 'simulation data deck' and the 'NPV Max Software' of FIGS. 1 and 2.

In FIG. 1, a workstation, personal computer, or other computer system 10 is illustrated adapted for storing a 'Software adapted for optimizing or maximizing Net Present Value (NPV) of a well while drilling and estimating production while drilling (NPV Max Software)'. Hereinafter, in this specification, the aforementioned 'Software adapted for optimizing or maximizing Net Present Value (NPV) of a well while drilling and estimating production while drilling (NPV Max Software)' will be referred to as the "NPV Max Software". The computer system 10 of FIG. 1 includes a Processor 10*a* operatively connected to a system bus 10*b*, a memory or other program storage device 10*c* operatively connected to the system bus 10*b*, and a recorder or display device 10*d* operatively connected to the system bus 10*b*. The memory or other program storage device 10*c* stores the 'Software adapted for optimizing or maximizing Net Present Value (NPV) of a well while drilling and estimating production while drilling (NPV Max Software)' 12 (i.e., the memory 10*c* stores the 'NPV Max Software' 12) that is adapted for optimizing or maximizing a Net Present Value (NPV) of a well while drilling and estimating production from a reservoir field while drilling. Recall that the 'NPV Max Software' 12 illustrated in FIG. 1 practices a 'reservoir characterization and optimization of productivity while drilling' method (which includes an associated system and program storage device and computer program) that will: (1) optimize or maximize the Net Present Value (NPV) of a well while drilling the well into a reservoir field, and (2) estimate a production from the reservoir field while drilling the well into the reservoir field. As a result, the 'NPV Max Software' 12 will optimize or maximize a Net Present Value (NPV) of a well while drilling the well into a reservoir field, and estimate a production from the reservoir field while drilling the well into the reservoir field. The computer system 10 receives 'input data' 14 which comprises a 'simulation data deck' 14, where the 'simulation data deck' 14 includes a 'prior data deck', a 'while drilling data deck', and a 'prediction data deck', which is illustrated in FIG. 3 and will be discussed later in this specification. The 'NPV Max Software' 12, which is stored in the memory 10*c* of FIG. 1, can be initially stored on a Hard Disk or CD-Rom, where the Hard Disk or CD-Rom is also a 'program storage device'. The CD-Rom can be inserted into the computer system 10, and the 'NPV Max Software' 12 can be loaded from the Hard Disk or CD-Rom and into the memory/program storage device 10*c* of the computer system 10 of FIG. 1. The Processor 10*a* will execute the 'NPV Max Software' 12 that is stored in memory 10*c* of FIG. 1; and, responsive thereto, the Processor 10*a* can then generate either a 'record' or an 'output display' that can be recorded or displayed on the Recorder or Display device 10*d* of FIG. 1. The 'record' or 'output display' that is generated by the Recorder or Display device 10*d* of FIG. 1, will illustrate or display a "a Net Present Value (NPV) 'NPV=f(WOPT, Ccosts-of-well)' for each station of a modeled reservoir". The term 'station' of a reservoir field can be defined as a 'time dependent point at which the workflow of FIG. 3 is executed'. This is a 'virtual station' in the sense that the number of stations and the time dependency is variable and problem dependent. The computer system 10 of FIG. 1 may be a personal computer (PC), a workstation, a microprocessor, or a mainframe. Examples of possible workstations include a Silicon Graphics Indigo 2 workstation or a Sun SPARC workstation or a Sun ULTRA workstation or a Sun BLADE workstation. The memory or program storage device 10*c* (including the above referenced Hard Disk or CD-Rom) is a 'computer readable medium' or a 'program storage device' which is readable by a machine, such as the processor 10*a*. The processor 10*a* may be, for example, a microprocessor, microcontroller, or a mainframe or workstation processor. The memory or program storage device 10*c*, which stores the 'Software adapted for optimizing or maximizing Net Present Value (NPV) of a well while drilling and estimating production while drilling (NPV Max Software)' 12 or 'NPV Max Software' 12, may be, for example, a hard disk, ROM, CD-ROM, DRAM, or other RAM, flash memory, magnetic storage, optical storage, registers, or other volatile and/or non-volatile memory.

In FIG. 2, the 'NPV Max software' 12 of FIG. 1 functions, when executed by the processor 10*a*, to: (1) construct and use flow simulations to model the impact of a well being geosteered on future production from a reservoir field into which the well is being drilled, as indicated by numeral 12*a*, (2) use the flow simulations to optimize (or maximize) the value of this production by manipulating the drilling methods of the well being geosteered, as indicated by numeral 12*b*, and (3) use the data acquired from the well being geosteered to construct the flow simulations and thereby influence the drilling of the well, as indicated by numeral 12*c*.

In operation, although a more detailed functional description of the operation of the 'NPV Max software' 12 of FIG. 1 will be set forth later in this specification, refer now to FIGS. 1 and 2. Recall the 'functions of the NPV Max software 12' which are illustrated in FIG. 2: (1) construct and use flow simulations to model the impact of a well being geosteered on future production from a reservoir field into which the well is being drilled, 12*a*, (2) use the flow simulations to optimize (or maximize) the value of this production by manipulating the drilling methods of the well being geosteered, 12*b*, and (3) use the data acquired from the well being geosteered to construct the flow simulations and thereby influence the drilling of the well, 12*c*. In FIG. 1, drilling of a wellbore in a 'real (not modeled) reservoir' commences, and, simultaneously, the processor 10*a* of the computer system 10 of FIG. 1 begins to execute the 'NPV Max Software' 12 in order to calculate a value of the 'Net Present Value (NPV)' for each 'station' of a 'modeled reservoir', a plurality of the values of the 'NPV' corresponding, respectively, to the plurality of 'stations' of the 'modeled reservoir' assisting (a drilling person or entity) in the drilling of the wellbore in the reservoir; for example, the wellbore's trajectory can be changed while drilling, or the drilling methods used to drill the wellbore can be changed accordingly. When the processor 10*a* of FIG. 1 executes the 'NPV Max Software' 12 which is stored in memory 10*c*, while using the simulation data deck 'input data' 14 (which includes a 'prior data deck', a 'while drilling data deck' and a 'prediction data deck'), the processor 10*a* of FIG. 1 will determine (by using the 'flow simulations' which are run and executed by a 'simulator' that is embodied in the 'NPV Max Software 12) one or more 'maximum values of Net Present Value (NPV)' for each 'station' in a 'modeled reservoir' field during the drilling of a corresponding 'real (not modeled) wellbore'. Recall that a 'station' of a reservoir field is defined as a 'time dependent point (along the modeled reservoir field) '. In addition, recall that the term 'Net Present Value (NPV)' is defined to be a function of the 'expected value of hydrocarbon production, minus the costs of drilling and completing and maintaining the well'. The 'Net Present Value (NPV)' is represented by an 'Objective Function', where, for an oil well, the 'Objective Function' is further represented by the following equation: 'NPV=f(WOPT, Ccosts-of-well)', where ' WOPT' is the cumulative amount of oil that can be produced from a production steered well, and 'Ccosts-of-well' are the total costs of starting and maintaining production from the well. During the drilling of a real (not modeled) wellbore in a reservoir field, the processor 10*a* will maximize or optimize the above referenced 'Objective Function' for each 'station' in the 'modeled reservoir' thereby determining 'one or more values of the Net Present Values (NPV)' for each 'station' in the 'modeled reservoir'. When the processor 10*a* determines the 'one or more values of Net Present Value (NPV)' for each 'station' in a 'modeled reservoir', 'a plurality of net present values' will be determined which correspond, respectively, to 'a plurality of stations' in the 'modeled reservoir'. When the 'plurality of net present values' are determined corresponding, respectively, to 'the plurality stations' in the 'modeled reservoir', the 'drilling person or entity' can then determine (from the 'plurality of net present values' corresponding, respectively, to the 'plurality of stations' in the 'modeled reservoir') the specific "stations of the modeled reservoir which have the 'optimum ones' or 'maximum ones' (relative to a predetermined threshold value) of the plurality of values of NPV". When the 'drilling person or entity' knows which "stations of the modeled reservoir have the 'optimum ones' or 'maximum ones' of the plurality of values of NPV", the 'drilling person or entity' can then: (1) drill and 'geosteer' the wellbore into the reservoir, and/or (2) change the trajectory of the wellbore being drilled into the reservoir in order to follow the "stations of the modeled reservoir which have the 'optimum ones' or 'maximum ones' of the plurality of values of NPV", and thereby maximize the value of the production of oil and/or gas from the reservoir. In addition or in the alternative, the 'drilling person or entity' can change the drilling methods, while drilling the wellbore into the reservoir, specifically in accordance with the 'optimum ones' or 'maximum ones' of the 'plurality of values of NPV', corresponding, respectively, to the plurality of stations of the modeled reservoir, and thereby maximize the production of oil and/or gas from the reservoir. When the wellbore is 'geosteered' and drilled into the reservoir, 'data' is acquired during the 'geosteering' and drilling of the wellbore into the reservoir, and that 'data' can then be used to reconstruct the aforementioned 'flow simulations', which are then subsequently re-run and re-executed by the 'simulator' that is embodied in the 'NPV Max Software' 12 of FIG. 1.

Referring to FIG. 3, a flowchart or block diagram is illustrated which provides a more detailed construction of the 'simulation data deck' 14 and the 'NPV Max Software' 12 of FIGS. 1 and 2.

In FIG. 3, the 'drilling process begins' at step 13. A first 'iteration' or 'station' starts at 'N=1'. The simulation data deck 14 includes the 'prior data deck' 14*a*, the 'while drilling data deck' 14*b*2 which is derived from 'real time logging while drilling (LWD) data' 14*b*1, and the 'prediction data deck' 14*c*. The 'real-time logging while drilling (LWD) data' 14*b*1 is received when the 'drilling process begins' at step 13. The 'NPV Max Software' 12 includes a first step: 'Construct a Base Model, Conduct first pass flow simulation, and maximize NPV' 15*a*. The 'NPV Max Software' 12 also includes a second step: 'Construct/Update Posterior Model' 15*b*. The 'NPV Max Software' 12 also includes a 'simulator' 15*c*, the 'simulator' 15*c* including a first 'history matching' step 15*c*1 and a second 'prediction phase' step 15*c*2. The 'history matching' step 15*c*1 further includes a 'Construct Flow Simulation Model' step 16. The 'prediction phase' step 15*c*2 further includes an 'optimize NPV Subject to C1-C10 & Predict Productivity' step 18. In FIG. 3, the 'Construct a Base Model, Conduct first pass flow simulation, and maximize NPV' step 15*a* receives the 'prior data deck' 14*a* and the 'prediction data deck' 14*c* at 'iteration' or 'station': 'N=1'. The 'Construct/Update Posterior Model' step 15*b* receives an output from the 'Construct Base Model . . . ' step 15*a* at iteration or 'station': 'N=1'; however, in addition, the 'Construct/Update Posterior Model' step 15*b* also receives the 'while drilling data deck' at further iterations or stations starting at iteration or 'station': 'N=N+1'. The 'Construct Flow Simulation Model' step 16 associated with the 'history matching phase' 15*c*1 of the 'simulator' 12 receives an output from the 'Construct/Update Posterior Model' step 15*b*. The 'Optimize NPV subject to C1-C10 & Predict Productivity' step 18 associated with the 'prediction phase' step 15*c*2 of the 'simulator' 12 receives an output from the 'Construct Flow Simulation Model' step 16 at iteration or 'station': N=1; however, in addition, the 'Optimize NPV . . . ' step 18 also receives the 'prediction data deck' 14*c* at further iterations or stations beginning at station: N=N+1. When the 'Optimize NPV subject to C1-C10 & Predict Productivity' step 18 associated with the 'prediction phase' step 15*c*2 of the 'simulator' 12 is completed, the next step 20 asks: 'Further Optimization of NPV Possible?' (step 20). If the output of step 20 is 'yes' (i.e., further optimization of NPV is possible), move to the next iteration or 'station' N=N+1, and then go to step 14*b*1. If the output of step 20 is 'no' (i.e., no further optimization of NPV is possible), then 'stop drilling' at step 22.

A more detailed explanation of each step of the flowchart or block diagram of FIG. 3 will be set forth in the following paragraphs.

In FIG. 3, three phases of simulation are illustrated: (1) the model construction phase, (2) history matching phase, and (3) prediction phase. The input data sets necessary for each phase are contained in the 'Simulation Data Deck' 14. The modeling is performed during the drilling. The well being Production Steered will be referred to as the 'Production Steered Well'. The information in the Simulation Data Deck 14 is divided into three sub data decks: the Prior-Data-Deck 14*a*, which is the information that describes the state of the reservoir prior to the well being drilled; the While-Drilling Data Deck 14*b*2, which is the information acquired, processed and interpreted during drilling, and the Prediction Data Deck 14*c* which describes how the Production Steered Well and the other wells in the reservoir will be produced and/or injected.

The prior data deck 14*a*, the while-drilling data deck 14*b*2, and the prediction data deck 14*c* will be discussed in detail in the following paragraphs.

Prior Data Deck 14*a*

The Prior Data Deck 14*a* incorporates information on at least the following items:

Reservoir fluid properties: These may include information on the types of fluid phases that may occur in the simulation model (oil, water, gas, solids such as asphaltenes and sand) and the respective saturations, densities, viscosities, compressibilities, expected phase behavior(s), reaction between injected and formation rock and formation fluids, formation fluid spatial distributions (eg a hydrocarbon compositional gradient, mud filtrate invasion depths);

Reservoir rock petrophysical properties: These may include porosity distribution, permeability tensor distribution in single or multiple porosity systems, compressibility;

Rock/fluid interaction: These may include capillary pressure curves, relative permeability curves (including endpoint variations) and hysterisis in these relationships;

Geomechanics: These may include dependence of properties on pressure and temperature, fines migration, onset of sanding;

Fluid Contact(s): These may include standoff from Gas-Oil and Water-Oil contacts;

Reservoir pressures and temperatures; and

Sedimentary/Tectonic and boundaries: These are estimated position and nature of reservoir thickness and lateral extension.

Many of the parameters in the Prior Data Deck 14*a* are updated after history matching. This is the process by which these parameters are modified so that the flow simulation models reproduce relevant observations. These observations are generally from the Production Steered Well. But they may also be from similar wells in the same reservoir. When the flow simulation models are being history matched, they are referred to as being in History Matching phase. In this phase they must have the facility to model well bore hydraulic behavior, filtrate invasion (the overbalance drilling case), flow from the formation (underbalance drilling case), and the geomechanical effects associated with drilling.

In more detail now, the observations which must be reproduced during History Matching phase include:

A. Near well bore phenomena in the Production Steered Well or in other wells of the reservoir. Such phenomena include:

a. rate and depth of invasion of mud filtrate;

b. supercharging of the pressures measured whilst drilling;

c. Pressure and rate transient data;

d. Filtrate clean up behavior observed when pumping fluids from various locations along the well;

e. Fluid produced if and whenever the well is being drilled underbalance; and f. The evidence of formation fluids which can be gathered by analysis of drilling cuttings.

B. Reservoir Scale phenomena. These might include:

a. Spatial distributions of the pressures of the reservoir fluids. For example, the formation fluid pressure distributions which have been measured whilst drilling the Production Steered Well, and which may also have been integrated into a Regional Pore Pressure Model, including pressure transient interference from other wells.

b. Reservoir fluid distributions (including spatial compositional variations if relevant). For example, the reservoir fluid distributions inferred from down hole fluid analysis measurements, acquired from the Production Steered Well and perhaps other wells.

c. Reservoir geomechanical properties. For example the stress tensor distribution coming from a regional Mechanical Earth Model.

Initializing and Re-Initializing the While-Drilling Data Deck 14*b*2

The initial version of the While-Drilling Data Deck 14*b*2 will contain parameters. Many of these come from measurements made from the Production Steered Well and/or from similar wells in the same reservoir. The measurements are explained in more detail below:

Porosity will be measured by Logging While Drilling (LWD) measurements which include:

Neutron Porosities

Sigma and sonic derived Porosities

Formation Bulk Density derived Porosities

Nuclear Magnetic Resonance (NMR) Porosities

The necessary formation fluid saturations, in the invaded zone as well as the un-invaded zone will be derived from LWD measurements which include:

Nuclear Capture Cross Section

Resistivity measurements

NMR measurements

Carbon/Oxygen measurements

Information to derive the permeability tensor will come from LWD measurements which will include the following:

Pore size correlations from LWD Nuclear Magnetic Resonance (NMR) measurements.

Permeability estimation from LWD nuclear elemental spectroscopy.

Permeability estimation from LWD sonic measurements.

Porosity to Permeability transformations.

Image logs (for secondary porosity estimation and bedding Dip).

Pretests from Formation Pressure While Drilling Measurements StethoScope_(FPWD).

The approximate ratio of horizontal to vertical permeability can be estimated from techniques which include the following:

Computing the ratio of the arithmetic to harmonic averages of the FPWD pretest mobilities.

Using Formation Testing While Drilling (TestWD) tool, which has been designed to measure permeability anisotropy.

Resistivity anisotropy.

The simulation layering to be used in the While-Drilling Data Deck will be inferred from Logging While Drilling (LWD) measurements which include:

Image logs

Nuclear elemental spectroscopic logs

Deep imaging tools such as the PeriScope, which relies on detecting resistivity contrasts Near well bore pressures will be measured by the FPWD tool. Supercharging and other distortions on the pressures will be corrected by established methods. The pressures will then be processed to provide information on the average reservoir pressures within the drainage region of the Production Steered Well, the densities of the fluids which are in the formation intersected by this well, and the depths of the reservoir fluid contacts.

Data for the reservoir and well bore fluids will be acquired by downhole LWD sensors, and/or inferred from pressures by the LWD tool and/or inferred from drilling cuttings and/or be inferred from neighboring wells.

Fluid Contact Depths will be inferred from Logging While Drilling (LWD) measurements which include:

Pressure Gradients inferred from FPWD measurements from StethoScope

Deep imaging resistivity tools such as the PeriScope

Downhole analysis of formation fluids

Capillary pressure curves can be inferred from various sources, including LWD logs such as NMR and array resistivities. Data to infer capillary pressure may also come from the pressures measured by the FPWD tool.

Two Phase relative permeability curves can be inferred from knowledge of the mud filtrate invasion. Examples of doing this are:

"Flare" processing on array resistivity invasion profiles.

Observing how the filtrate contamination diminishes when formation fluids are pumped back into the well bore.

Data to model the hydraulic behavior in the well bore will be measured by the LWD sensors.

Further information to aid construction of the While-Drilling Data Deck can be gained if the Production Steered Well is being drilled underbalance. Such information can come from:

Water Flow Logging, WFL, using an LWD Pulse Neutron Generator (PNG).

Phase velocity logging using a miscible injector system in an LWD tool.

Optical and/or electrical probes mounted on a drill collar.

Prediction Data Deck 14*c*

The information contained in the Prediction Data Deck 14*c* includes the expected flow/injection rates of the surrounding wells, the pressure constraints on the wells, and the economic criteria which will be used to optimize the value of the production from the wells. In the Prediction Phase of the simulations, Production Steering, for an oil well, maximizes the objective function:

NPV=f(WOPT, Ccosts-of-well)

where 'WOPT' is the cumulative amount of oil that can be produced from the Production Steered Well. It is assumed to be drilled into a reservoir which contains Oil and perhaps mobile Gas and Water. 'Ccosts-of-well' are the total costs of starting and maintaining production from the well.

The optimization of 'NPV' is subject to the following constraints:

C1: Cstarting-production<Ccapex-budget

C2: Tproduction<Tmax

C3: WWPR<WWPRmax

C4: WGORmin<WGOR<WGORmax

C5: WBHP>WBHPmin

C6: WT HP>WT HPmin

C7: Preservoir>Pabandonment

C8: WOPR>WOPRmin

C9: WT HT>WT HT min

C10: Cmaintaining–production<Copex–budget

Where in the constraints C1 to C10:

'Cstarting-production' are the costs of bringing the well on line to start oil production. Typical factors which contribute to 'Cstarting-production' include: drilling the well, completion and tubulars, artificial lift, flow assurance, required pipeline and surface processing facilities and well clean up.

'Ccapex-budget' is the capital expenditure budget which can be allocated for starting production.

'Tproduction' is the time over which the oil is produced.

'Tmax' is the maximum time that the well can be produced for. There are many possible reasons why a 'Tmax' could exist. For example 'Tmax' could be the related to the period for which the well can be legally produced.

'WWPR, WWPRmax' are respectively the predicted and maximum allowable well water production rates.

'WGOR', 'WGORmax', 'WGORmin' are respectively the predicted, maximum and minimum allowable producing gas oil ratios.

'WBHP', 'WBHPmin' are respectively the predicted and minimum allowable well bottom hole flowing pressures.

'WTHP', 'WTHPmin' are respectively the predicted and minimum allowable well tubing head flowing pressures.

'Preservoir>Pabandonment' are respectively the predicted and minimum allowable reservoir pressures WOPR>WOPRmin are respectively the predicted and minimum allowable oil production rates.

'WTHT', 'WTHTmin' are respectively the predicted and minimum allowable well tubing head temperatures.

'Cmaintaining-production' are the recurring costs of maintaining production.

'Copex-budget' is the budget for operating expenditures.

Constructing the Base Model 15*a* of FIG. 3

Using all available relevant information, a Base Model 15*a* of the reservoir is prepared prior to the drilling of the well. This is done using 'Petrel', the 'Single Well Predictive Model (SWPM)', and the fast flow simulation software 'GREAT'. Alternately, the base model could come from 'PetrelRE' using 'Eclipse'. The model is capable of predicting the well production performance and is used to help design the well trajectory so that the objective function 'NPV' can be maximized. The layering and petrophysical properties required for the simulation will be obtained from surrounding well data. The terms 'Petrel', 'Single Well Predictive Model (SWPM)', 'GREAT', 'PetrelRE', and 'Eclipse' represent software products that are owned and operated by Schlumberger Technology Corporation of Houston, Tex.

The 'Single Well Predictive Model (SWPM)' software, hereinafter referred to as 'SWPM', is set forth in prior pending application Ser. No. 11/007,764 filed Dec. 8, 2004, which is a continuation in part of application Ser. No. 10/726,288 filed on Dec. 2, 2003, which is a utility application of prior provisional application Ser. No. 60/578,053 filed on Jun. 8, 2004, the disclosures of which are all incorporated by reference into the specification of this application.

The fast flow simulation software 'GREAT', hereinafter referred to as 'GREAT', is set forth in U.S. Pat. No. 7,069,148 B2 to Thambynayagam et al, entitled "Gas Reservoir Evaluation and Assessment Tool Method and Apparatus and Program Storage Device", the disclosure of which is incorporated by reference into the specification of this application.

Update the Base Model 15*a* to produce an interim Posterior Model 15*b* in FIG. 3

As drilling commences, some of the data required for Production Steering is acquired from the well being drilled. The data which may be acquired has been previously described herein. The newly acquired data is used to update the Base Model 15*a* of FIG. 3, using Bayesian techniques, in order to generate an interim Posterior Model 15*b* in FIG. 3. It should be noted that the Base Model 15*a* itself can handle the uncertainties in the input parameters by calculating a range in the predicted 'NPV' of the well.

The depth and thickness of layers used in the simulation model will be constructed after interpretation of some of the measurements referred to above to update the base model. The data from the LWD logs, which have been mentioned previously in connection with the While-Drilling Data Deck 14*b*2, will be integrated by using log analysis methods to provide continuous values of Porosity, fluid saturations, Permeability and two-phase relative permeabilities. The integration procedure will also allow the use of non-LWD data, such as that from core analysis. The depths of the fluid contacts, the associated properties of the fluids, and the distributions of capillary pressures will be inferred from some of the measurements referred to above.

The above described traces will be used as part of the creation of a three dimensional layered model of the reservoir. The model will also be able to account for the hydraulic behavior in the well bore during drilling of the well. Moreover, it will be sufficient to model the impact of the Production Steered Well on future production from the field into which it is being drilled. Consequently, the model will contain the Production Steered Well and perhaps other wells in the reservoir. The model may be created by methods, such as Artificial Neural Networks to recognize layering from the LWD logs, and Geostatistics to create the property distributions. The constructed model will be used with 'SWPM' and 'GREAT' to perform the analysis and simulations.

Construct Flow Simulation Model 16 of FIG. 3

The above described layered model of the reservoir will be converted to a simulation model of the reservoir in order to enter the history matching mode. The history matching mode involves correction of log derived permeability by matching model generated pressure with actual transient FPWD pressure if available. During this process, correction for supercharging effects due to the invasion of drilling fluid is performed. The history matching process also results in a calculation of formation skin for the well. In addition, the While Drilling Data Deck 14*b*2 will be history matched to reproduce relevant observations described previously in this document. The fast simulator 'GREAT' will be used for multi-well interference history matching.

After the history matching is complete, the While-Drilling Data Deck 14*b*2 can be combined with the Prediction Data Deck 14*c* to create an ensemble of simulation models. Collectively they can be used to model the impact of the Production Steered Well on future production from the field into which it is being drilled. Techniques, such as upscaling and downscaling, will be used prior to the flow simulation with 'GREAT'. The model is used to optimize the 'NPV' subject to constraints C1 to C10 (also described above), at certain specified levels of risk of not achieving the 'NPV', and so perhaps to redesign the well (i.e., changing trajectories). This step is performed by the 'AURUM' software in conjuction with the fast simulator 'GREAT'. Thus, in this embodiment, uncertainty is quantified in the predictions from the reservoir model used for Production Steering. Bayesian techniques are well known to be suited to incorporating observations into a prior model of a system, and so do not need to be explained here.

The 'AURUM' software is a product of Schlumberger Technology Corporation of Houston, Tex.

The simulation model can now be used to predict the pressure-production performance of the well. A simulated multirate test can give the Inflow Performance Relationship (IPR) of the well. A comparison of the IPR's at different times is indicative of the buildup of productivity of the well.

The NPV Max Software 12 disclosed in this specification also handles the risks associated with uncertainty in the bounding constraints associated with conditions C1 to C10.

Then, as drilling proceeds, more of the data required for Production Steering is acquired from the Production Steered well. This data is used to periodically update the Posterier Model 15*b* using Bayesian techniques, and subsequently to repeat the optimization of 'NPV'. The above steps of 'Updating the Base Model 15*a* to produce an interim Posterior Model 15*b*' and 'constructing a flow simulation model' 16 of FIG. 3 will be repeated at several stations during the drilling of the Production Steered Well.

Stop Drilling the Well

Terminate drilling of the well when the modeling from the Production Steering indicates that it is unlikely (to within a specified degree of confidence) that 'NPV' can be optimized any further, even if further data is acquired and/or if one of the constraints C1 to C10 will be violated.

Transmission of the Data Needed to Re-Initialize the while-Drilling Data Deck 14*b*2

The 'NPV Max Software' 12 will ensure that Logging While Drilling (LWD) data, acquired while drilling the Production Steered Well, is transmitted efficiently from downhole to the rig surface, and then from the rig surface to the locations where the While-Drilling Data Deck 14*b*2 is being built. To ensure efficiency, signal processing techniques, such as Discrete Wavelet Transforms and Discrete Fourier Transforms, will be used to eliminate distortions to the data and to compress the data.

A functional description of the operation of the 'NPV Max software' 12 of FIG. 1 is set forth in the following paragraphs with reference to FIGS. 1 through 3 of the drawings.

In FIGS. 1 and 2, referring initially to FIG. 2, recall the 'functions of the NPV Max software 12' which are illustrated in FIG. 2: (1) construct and use flow simulations to model the impact of a well being geosteered on future production from a reservoir field into which the well is being drilled, 12*a*, (2) use the flow simulations to optimize (or maximize) the value of this production by manipulating the drilling methods of the well being geosteered, 12*b*, and (3) use the data acquired from the well being geosteered to construct the flow simulations and thereby influence the drilling of the well, 12*c*. In FIG. 1, drilling of a wellbore in a 'real (not modeled) reservoir' commences, and, simultaneously, the processor 10*a* of the computer system 10 of FIG. 1 begins to execute the 'NPV Max Software' 12 in order to calculate a value of the 'Net Present Value (NPV)' for each 'station' of a 'modeled reservoir', a plurality of the values of the 'NPV' corresponding, respectively, to the plurality of 'stations' of the 'modeled reservoir' assisting (a drilling person or entity) in the drilling of the wellbore in the reservoir; for example, the wellbore's trajectory can be changed while drilling, or the drilling methods used to drill the wellbore can be changed accordingly. When the processor 10*a* of FIG. 1 executes the 'NPV Max Software' 12 which is stored in memory 10*c*, while using the simulation data deck 'input data' 14 (which includes a 'prior data deck', a 'while drilling data deck' and a 'prediction data deck'), the processor 10*a* of FIG. 1 will determine (by using the 'flow simulations' which are run and executed by a 'simulator' that is embodied in the 'NPV Max Software 12) a 'maximum value of Net Present Value (NPV)' for each 'station' in a 'modeled reservoir' field during the drilling of a corresponding 'real (not modeled) wellbore'. Recall that a 'station' of a reservoir field is defined as a 'time dependent point (along the modeled reservoir field)'. In addition, recall that the term 'Net Present Value (NPV)' is defined to be a function of the 'expected value of hydrocarbon production, minus the costs of drilling and completing and maintaining the well'. The 'Net Present Value (NPV)' is represented by an 'Objective Function', where the 'Objective Function' is further represented by the following equation: 'NPV=f(WOPT, Ccosts-of-well)', where 'WOPT' is the cumulative amount of oil that can be produced from a production steered well, and 'Ccosts-of-well' are the total costs of starting and maintaining production from the well. During the drilling of a 'real (not modeled) wellbore' in a reservoir field, the processor 10*a* will maximize or optimize the above referenced 'Objective Function' for each 'station' in the 'modeled reservoir' thereby determining 'one or more values of the Net Present Values (NPV)' for each 'station' in the 'modeled reservoir'. When the processor 10*a* determines 'one or more values of Net Present Value (NPV)' for each 'station' in a 'modeled reservoir', 'a plurality of net present values' will be determined which correspond, respectively, to 'a plurality of stations' in the 'modeled reservoir'. When the 'plurality of net present values' are determined corresponding, respectively, to 'the plurality stations' in the modeled reservoir, the drilling person or entity can then determine (from the 'plurality of net present values' corresponding, respectively, to the 'plurality of stations' in the 'modeled reservoir'): how to 'geosteer' and drill a wellbore into the corresponding (real, not modeled) reservoir, and/or how to change the drilling methods associated with drilling the wellbore, in order to maximize the production of oil and/or gas from that corresponding reservoir. For example, when the 'plurality of net present values' are determined corresponding, respectively, to 'the plurality stations' in the 'modeled reservoir', the 'drilling person or entity' can then determine (from the 'plurality of net present values' corresponding, respectively, to the 'plurality of stations' in the 'modeled reservoir') the specific "stations of the modeled reservoir which have the 'optimum ones' or 'maximum ones' of the plurality of values of NPV". When the 'drilling person or entity' knows which "stations of the modeled reservoir have the 'optimum ones' or 'maximum ones' of the plurality of values of NPV", the 'drilling person or entity' can then: (1) drill and 'geosteer' the wellbore into the reservoir, and/or (2) change the trajectory of the wellbore being drilled into the reservoir in order to follow the "stations of the modeled reservoir which have the 'optimum ones' or 'maximum ones' of the plurality of values of NPV", thereby optimizing or maximizing the production of oil and/or gas from the (real, not modeled) reservoir. In addition or in the alternative, the 'drilling person or entity' can change the drilling methods, while drilling the wellbore into the reservoir, specifically in accordance with the 'optimum ones' or 'maximum ones' of the 'plurality of values of NPV', corresponding, respectively, to the plurality of stations of the modeled reservoir, thereby maximizing the production of oil and/or gas from the (real, not modeled) reservoir. When the wellbore is 'geosteered' and drilled into the 'real (not modeled) reservoir', 'data' is acquired during the 'geosteering' and drilling of the wellbore into the 'real (not modeled) reservoir', and that 'data' can then be used to reconstruct the aforementioned 'flow simulations', which are then subsequently re-run and re-executed by the 'simulator' that is embodied in the 'NPV Max Software' 12 of FIG. 1.

In FIG. 3, refer to FIG. 3 which illustrates a detailed construction of the 'NPV Max Software' 12 and its associated 'Simulation Data Deck' 14. In FIG. 3, the drilling process begins, at step 13. Start with the 'first station' (N=1), which is the 'first station' in the 'modeled reservoir'. In the first iteration of FIG. 3 corresponding to the 'first station' (N=1) of the 'modeled reservoir', 'one or more values of NPV' will be determined for the 'first station' of the 'modeled reservoir'. In subsequent iterations corresponding to 'subsequent stations' (N=N+1, N=N=2, etc) of the 'modeled reservoir', 'one or more additional values of NPV' will be determined for the 'subsequent stations' in the 'modeled reservoir'. The drilling process stops, at step 22, when further optimization of NPV is not possible. While drilling a wellbore in a corresponding real (not modeled) reservoir, the 'drilling person or entity' will use the 'one or more values of NPV' for the 'first station' of the 'modeled reservoir' and the 'one or more additional values of NPV' for the 'subsequent stations' in the 'modeled reservoir' (which were determined by the computer system of FIG. 1) to determine the wellbore's optimum 'trajectory while drilling' the real (not modeled) reservoir and/or the optimum 'drilling methods' used to drill the wellbore in the real (not modeled) reservoir in order to maximize the production of oil and/or gas from the reservoir.

In FIG. 3, recall that the information in the Simulation Data Deck 14 of FIGS. 1 and 3 is divided into three sub data decks: the Prior-Data-Deck 14*a*, which is the information that describes the state of the reservoir prior to the well being drilled; the While-Drilling Data Deck 14*b*2, which is the information acquired, processed and interpreted during drilling, and the Prediction Data Deck 14*c* which describes how the Production Steered Well and the other wells in the reservoir will be produced and/or injected. Using all information available, including the data embodied in the prior data deck 14*a* and the prediction data deck 14*c*, a 'base model' 15*a* of FIG. 3 is constructed prior to the drilling of a 'wellbore' in a reservoir field. The 'base model' 15*a* of FIG. 3 is capable of predicting the production performance of the 'wellbore' and is used to help design the trajectory of the 'wellbore' so that the 'Objective Function NPV' can be maximized (for each station of the modeled reservoir). As the drilling of the 'wellbore' commences, some of the data required for 'production steering' is acquired from the 'wellbore' being drilled. This newly acquired data is used to update the 'base model' 15*a* to thereby generate the 'interim posterior model' 15*b* of FIG. 3, where the 'interim posterior model' 15*b* represents a 'three dimensional layered model of the reservoir' that is sufficient to model the impact of the production steered well on the future production from the reservoir field into which the 'wellbore' is being drilled (see function 12*a* of FIG. 2). Consequently, the 'interim posterior model' 15*b* will contain the 'production steered well' and perhaps other wells in the reservoir. The 'interim posterior model' 15*b*, which represents a 'three dimensional layered model of the reservoir', is then converted to a 'simulation model of the reservoir' in order to enter the 'history matching phase' 15*c*1 of FIG. 3. In general, in the 'history matching phase' 15*c*1 of FIG. 3, previously known 'historical data' (having 'known historical results') will be introduced into the aforementioned 'simulation model of the reservoir'. Responsive thereto, the 'simulation model of the reservoir' will generate 'results'. The 'results' generated by the 'simulation model of the reservoir' will be compared to the 'known historical results'. If the 'results' approximately equal the 'known historical results', the 'simulation model of the reservoir' has successfully passed the 'history matching phase' 15*c*1. At this point, the processor 10*a* can now commence the 'prediction phase' 15*c*2 wherein the future behavior of the reservoir can be predicted. In particular, in the 'history matching phase' 15*c*1 of FIG. 3, recall that the 'history matching phase' 15*c*1 involves correction of log derived permeability by matching model generated pressure with actual transient FPWD pressure if available. During this process, correction for supercharging effects due to the invasion of drilling fluid is performed. The history matching process also results in a calculation of formation skin for the well. After the 'history matching phase' 15*c*1 is complete, in the 'prediction phase' 15*c*2 of FIG. 3, the 'while drilling deck' 14*b*2 can be combined with the 'prediction data deck' 14*c* to thereby create an 'ensemble of simulation models'. Collectively, the 'ensemble of simulation models', which are collectively embodied in the 'prediction phase' 15*c*2 of FIG. 3, can be used to model the impact of the production steered well on future production from the reservoir field into which the 'wellbore' is being drilled (function 12*a* of FIG. 2). The 'ensemble of simulation models', embodied in the 'prediction phase' 15*c*2, are used to optimize the 'Net Present Value (NPV)', subject to constraints C1 to C10 (see step 18 of FIG. 3). That is, the 'ensemble of simulation models', embodied in the 'prediction phase' 15*c*2, are used to optimize the Objective Function 'NPV=f(WOPT, Ccosts-of-well)' (see step 18 of FIG. 3), where 'WOPT' is the cumulative amount of oil that can be produced from a production steered well, and 'Ccosts-of-well' are the total costs of starting and maintaining production from the well. When the 'Net Present Value (NPV)' is optimized, the 'wellbore' can be redesigned. For example, when the 'wellbore' is redesigned, the trajectory of the 'wellbore' can be changed, or the drilling methods, for drilling the wellbore, can be changed. The aforementioned 'ensemble of simulation models' (hereinafter, the 'simulation model') can then be used to predict the pressure-production performance of the 'wellbore'. As drilling of the 'wellbore' proceeds, more of the data required for the production steering is acquired from the production steered well, and this data is used to update the 'posterior model' 15*b* of FIG. 3 and then repeat the optimization of 'NPV' in the 'optimize NPV . . . ' step 18 in the 'prediction phase' 15*c*2 of FIG. 3. The above described steps of 'updating the base model 15*a* to produce the posterior model 15*b*' and 'constructing the flow simulation model' 16 are then repeated at several 'stations' during the drilling of the production steered 'wellbore'; therefore, increment 'N', from 'N=1' to 'N=N+1' (where 'N=1' represents the 'first station' and 'N=N+1' represents the 'second station') and repeat the above referenced steps. However, the drilling of the 'wellbore' in the reservoir is terminated when the modeling of the production steered well indicates that it is unlikely that the 'NPV' can be further optimized.

In FIG. 3, in this specification, the simulator 15*c* of FIG. 3 is used for the purposes of automatic history matching 15*c*1, and optimization and production prediction 15*c*2. The simulator 15*c* includes a set of initial and bound conditions and a governing equation.

The 'Initial and boundary conditions and the governing equation' associated with the simulator 15*c* of FIG. 3 are set forth below in the following paragraphs.

Mathematical Solution of the Layered Reservoir Flow Simulation Problem

In FIG. 3, the workflow of FIG. 3 includes a fast, gridless, analytical simulator 15*c* which is particularly suitable for handling pressure and rate transient data. The generalized analytical simulator 15*c* of FIG. 3 supports horizontal, vertical and deviated wells in a multilayer heterogeneous reservoir. The reservoir boundary can be modeled as no-flow or constant pressure (signifying an aquifer) or a combination of both. The simulator 15*c* can model both naturally fractured (dual porosity) reservoirs and hydraulic fractures at individual wells. The hydraulic fracture model accounts for non-Darcy flow in the fracture. Even though the well is represented by a line source, suitable industry standard corrections have been applied to account for wellbore storage effects and finite wellbore radius. The wells may have finite and infinite conductivity hydraulic fractures. Interference effects from multiple wells are simulated. In this invention, the simulator is used for the purposes of automatic history matching, optimization and production prediction.

Initial and Boundary Conditions and the Governing Equation.

$$\frac{\partial p_j(0,y,z,t)}{\partial x} = -\left(\frac{\mu}{k_x}\right)_j \psi_{0yzj}(y,z,t),$$

$$\frac{\partial p_j(a,y,z,t)}{\partial x} = -\left(\frac{\mu}{k_x}\right)_j \psi_{ayzj}(y,z,t),$$

$$\frac{\partial p_j(x,0,z,t)}{\partial y} = -\left(\frac{\mu}{k_y}\right)_j \psi_{x0zj}(x,z,t),$$

$$\frac{\partial p_j(x,b,z,t)}{\partial y} = -\left(\frac{\mu}{k_y}\right)_j \psi_{xbzj}(x,z,t),\ d_j < z < d_{j+1},$$

$\forall\ j = 0, 1, \ldots, N-1$. At $z = d_0$, $$\frac{\partial p(x,y,d_0,t)}{\partial z} = -\left(\frac{\mu}{k_z}\right)_0 \psi_{xy00}(x,y,t), \text{ and at } z = d_N,$$

$$\frac{\partial p(x,y,d_N,t)}{\partial z} = -\left(\frac{\mu}{k_z}\right)_N \psi_{xydN}(x,y,t),\ 0 < x < a,$$

$0 < y < b$. At the interface $z = d_j$, $$\psi_j(x,y,t) = -\left(\frac{k_z}{\mu}\right)_j \left(\frac{\partial p_j(x,y,d_j,t)}{\partial y}\right)$$

$$= -\left(\frac{k_z}{\mu}\right)_{j-1} \left(\frac{\partial p_{j-1}(x,y,d_j,t)}{\partial y}\right) \text{ and}$$

$\check{\lambda}_j\psi_j(x,y,t)=\{p_{j-1}(x,y,d_j,t)-p_j(x,y,d_j,t)\}, \forall j=1, \ldots, N-1$. The initial pressure $p_j(x,y,z,0)=\phi_j(x,y,z)$.

In the interval $d_j \leqq z \leqq d_{j+1}$, $j=0, 1, \ldots, N-1$, we find $p_j$, the pressure response corresponding any perturbation, from the partial differential equation $$\frac{\partial p_j}{\partial t} = \eta_{xj}\frac{\partial^2 p_j}{\partial x^2} + \eta_{yj}\frac{\partial^2 p_j}{\partial y^2} + +\eta_{zj}\frac{\partial^2 p_j}{\partial z^2} + U(t-t_{0j})\frac{q_j(t-t_{0j})}{(\phi c_t)_j}\delta(x-x_{0j})\delta(y-y_{0j})\delta(z-z_{0j}) \tag{0.1}$$

where $\eta_{xj} = \left(\frac{k_x}{\phi c_t \mu}\right)_j$, $\eta_{yj} = \left(\frac{k_y}{\phi c_t \mu}\right)_j$ and $\eta_{zj} = \left(\frac{k_z}{\phi c_t \mu}\right)_j$.

The Production Steered Well

An inclined line of finite length $[(z_{02j}-z_{01j})\sin\theta_0]$ passing through $(x_{0j}, y_{0j}, z_{0j})$. The solutions for a continuous source is given by $$p = \frac{U(t-t_{0j})\sin\vartheta_{0j}}{8(\phi c_t)_j ab(d_{j+1}-d_j)}\int_0^{t-t_{0j}} q_j(t-t_{0j}-\tau)\times\times \int_{z_{01j}}^{z_{02j}}\left[\left\{\Theta_3\left(\frac{\pi}{2a}\{x-(z_{0j}-\gamma_{0j})\cot\vartheta_{0j}\cos\theta_{0j}\}, e^{-\left(\frac{\pi}{a}\right)^2\eta_{xj}\tau}\right)++\Theta_3\left(\frac{\pi}{2a}\{x+(z_{0j}-\gamma_{0j})\cot\vartheta_{0j}\cos\theta_{0j}\}, e^{-\left(\frac{\pi}{a}\right)^2\eta_{xj}\tau}\right)\right\}\times\times \left\{\Theta_3\left(\frac{\pi}{2b}\{y-(z_{0j}-\gamma_{0j})\cot\vartheta_{0j}\sin\theta_{0j}\}, e^{-\left(\frac{\pi}{b}\right)^2\eta_{yj}\tau}\right)++\Theta_3\left(\frac{\pi}{2b}\{y+(z_{0j}-\gamma_{0j})\cot\vartheta_{0j}\sin\theta_{0j}\}, e^{-\left(\frac{\pi}{b}\right)^2\eta_{yj}\tau}\right)\right\}\times\times \tag{0.2}$$

-continued $$\left\{\Theta_3\left(\frac{\pi(z-z_{0j})}{2(d_{j+1}-d_j)},\ e^{-\left(\frac{\pi}{d_{j+1}-d_j}\right)^2\eta_{yj}\tau}\right)+\Theta_3\left(\frac{\pi(z+z_{0j}-2d_j)}{2(d_{j+1}-d_j)},\ e^{-\left(\frac{\pi}{d_{j+1}-d_j}\right)^2\eta_{yj}\tau}\right)\right\}\Bigg]$$

$$d z_{0j} d\tau + + \frac{1}{4(\phi c_t)_j ab(d_{j+1}-d_j)}$$

$$\int_0^t\int_0^a\int_0^b\Bigg[\psi_j(u,v,\tau)\Theta_3\left\{\frac{\pi(z-d_j)}{2(d_{j+1}-d_j)},\ e^{-\left(\frac{\pi}{d_{j+1}-d_j}\right)^2\eta_{xj}(t-\tau)}\right\} - -\psi_{j+1}(u,v,\tau)\Theta_4\left\{\frac{\pi(z-d_j)}{2(d_{j+1}-d_j)},\ e^{-\left(\frac{\pi}{d_{j+1}-d_j}\right)^2\eta_{zj}(t-\tau)}\right\}\Bigg]\times\times$$

$$\left[\Theta_3\left\{\frac{\pi(x-u)}{2a},\ e^{-\left(\frac{\pi}{a}\right)^2\eta_{xj}(t-\tau)}\right\}+\Theta_3\left\{\frac{\pi(x+u)}{2a},\ e^{-\left(\frac{\pi}{a}\right)^2\eta_{xj}(t-\tau)}\right\}\right]\times\times$$

$$\left[\Theta_3\left\{\frac{\pi(y-v)}{2b},\ e^{-\left(\frac{\pi}{b}\right)^2\eta_{yj}(t-\tau)}\right\}+\Theta_3\left\{\frac{\pi(y+v)}{2b},\ e^{-\left(\frac{\pi}{b}\right)^2\eta_{vj}(t-\tau)}\right\}\right]du\,dv$$

$$d\tau + + \frac{1}{4(\phi c_t)_j ab(d_{j+1}-d_j)}\times\times$$

$$\int_0^t\int_0^b\int_0^{d_{j+1}-d_j}\Big\{\psi_{0yzj}(v,w,\tau)\Theta_3\left(\frac{\pi x}{2a},\ e^{-\left(\frac{\pi}{a}\right)^2\eta_{xj}(t-\tau)}\right)-\psi_{ayzj}(v,w,\tau)\Theta_4\left(\frac{\pi x}{2a},\ e^{-\left(\frac{\pi}{a}\right)^2\eta_{xj}(t-\tau)}\right)\Big\}\times\times$$

$$\left[\Theta_3\left\{\frac{\pi(y-v)}{2b},\ e^{-\left(\frac{\pi}{b}\right)^2\eta_{yj}(t-\tau)}\right\}+\Theta_3\left\{\frac{\pi(y+v)}{2b},\ e^{-\left(\frac{\pi}{b}\right)^2\eta_{vj}(t-\tau)}\right\}\right]\times\times$$

$$\Bigg[\Theta_3\left\{\frac{\pi(z-d_j-w)}{2(d_{j+1}-d_j)},\ e^{-\left(\frac{\pi}{d_{j+1}-d_j}\right)^2\eta_{zj}(t-\tau)}\right\}+\Theta_3\left\{\frac{\pi(z-d_j+w)}{2(d_{j+1}-d_j)},\ e^{-\left(\frac{\pi}{d_{j+1}-d_j}\right)^2\eta_{zj}(t-\tau)}\right\}\Bigg]dv\,dw\,d\tau + +$$

$$\frac{1}{4(\phi c_t)_j ab(d_{j+1}-d_j)}\times\times$$

$$\int_0^t\int_0^a\int_0^{d_{j+1}-d_j}\Big\{\psi_{x0zj}(u,w,\tau)\Theta_3\left(\frac{\pi y}{2b},\ e^{-\left(\frac{\pi}{b}\right)^2\eta_{yj}(t-\tau)}\right)-\psi_{xbzj}(u,w,\tau)\Theta_4\left(\frac{\pi y}{2b},\ e^{-\left(\frac{\pi}{b}\right)^2\eta_{yj}(t-\tau)}\right)\Big\}\times\times$$

$$\left[\Theta_3\left\{\frac{\pi(x-u)}{2a},\ e^{-\left(\frac{\pi}{a}\right)^2\eta_{xj}(t-\tau)}\right\}+\Theta_3\left\{\frac{\pi(x+u)}{2a},\ e^{-\left(\frac{\pi}{a}\right)^2\eta_{xj}(t-\tau)}\right\}\right]\times\times\Bigg[\Theta_3\left\{\frac{\pi(z-d_j-w)}{2(d_{j+1}-d_j)},\ e^{-\left(\frac{\pi}{d_{j+1}-d_j}\right)^2\eta_{zj}(t-\tau)}\right\}+$$

$$\Theta_3\left\{\frac{\pi(z-d_j+w)}{2(d_{j+1}-d_j)},\ e^{-\left(\frac{\pi}{d_{j+1}-d_j}\right)^2\eta_{zj}(t-\tau)}\right\}\Bigg]du\,dv\,dw$$

$$d\tau + + \frac{1}{8ab(d_{j+1}-d_j)}\times\times$$

$$\int_0^{d_{j+1}-d_j}\int_0^b\int_0^a\varphi_j(u,v,w+d_j)$$

$$\Bigg[\left\{\Theta_3\left(\frac{\pi(x-u)}{2a},\ e^{-\left(\frac{\pi}{a}\right)^2\eta_{xj}t}\right)+\Theta_3\left(\frac{\pi(x+u)}{2a},\ e^{-\left(\frac{\pi}{a}\right)^2\eta_{xj}t}\right)\right\}\times\times$$

$$\left\{\Theta_3\left(\frac{\pi(y-v)}{2b},\ e^{-\left(\frac{\pi}{b}\right)^2\eta_{yj}t}\right)+\Theta_3\left(\frac{\pi(y+v)}{2b},\ e^{-\left(\frac{\pi}{b}\right)^2\eta_{yj}t}\right)\right\}\times\times\Bigg\{\Theta_3\left\{\frac{\pi(z-d_j-w)}{2(d_{j+1}-d_j)},\ e^{-\left(\frac{\pi}{d_{j+1}-d_j}\right)^2\eta_{zj}t}\right\}+$$

$$\Theta_3\left\{\frac{\pi(z-d_j+w)}{2(d_{j+1}-d_j)},\ e^{-\left(\frac{\pi}{d_{j+1}-d_j}\right)^2\eta_{zj}t}\right\}\Bigg\}\Bigg]du\,dv\,dw$$

Where $\theta_{0j}$ is the inclination to the x-y plane and $\gamma_{0j}$ is the intercept to the z axis.

We employ, in time domain, the interfacial boundary condition. Substituting for $p_j(x,y,d_j,t)$ and $p_{j-1}(x,y,d_j,t)$ from equation (0.2) in $$\breve{\lambda}_j\psi_j(x,y,t)=\{p_{j-1}(x,y,d_j,t)-p_j(x,y,d_j,t)\},\forall j=1,2,\ldots,N-1$$

we obtain a three-point recurrence integral equation relationship in time and space $$\breve{\lambda}_j\psi_j(x,y,t)=\int_0^t\int_0^a\int_0^b A_j(x,u,y,v,t-\tau)\psi_j(u,v,\tau)\,dv\,du\,d\tau + + \int_0^t\int_0^a\int_0^b B_j(x,u,y,v,t-\tau)\psi_{j+1}(u,v,\tau)\,dv\,du\,d\tau + + \int_0^t\int_0^a\int_0^b C_j(x,u,y,v,t-\tau)\psi_{j-1}\,dv\,du\,d\tau+\Omega_j(x,y,t) \tag{0.3}$$

The coefficients of the recurrence integral equation (0.3) for $d_j<z<d_{j+1}$, $\forall j=1, 2, \ldots, N-1$, are given by $$A_j(x,u,y,v,t)=g_j(x,u,y,v,t)+g_{j-1}(x,u,y,v,t) \tag{0.4}$$

where $$g_j(x,u,y,v,t)=-\frac{\Theta_3\left\{0,\ e^{-\left(\frac{\pi}{d_{j+1}-d_j}\right)^2\eta_{zj}(t-\tau)}\right\}}{4(\phi c_t)_j ab(d_{j+1}-d_j)}\times\times\left[\Theta_3\left\{\frac{\pi(x-u)}{2a},\ e^{-\left(\frac{\pi}{a}\right)^2\eta_{xj}(t-\tau)}\right\}+\Theta_3\left\{\frac{\pi(x+u)}{2a},\ e^{-\left(\frac{\pi}{a}\right)^2\eta_{xj}(t-\tau)}\right\}\right]\times\times\left[\Theta_3\left\{\frac{\pi(y-v)}{2b},\ e^{-\left(\frac{\pi}{b}\right)^2\eta_{yj}(t-\tau)}\right\}+\Theta_3\left\{\frac{\pi(y+v)}{2b},\ e^{-\left(\frac{\pi}{b}\right)^2\eta_{yj}(t-\tau)}\right\}\right] \tag{0.5}$$

-continued $$B_j(x,u,y,v,t)=\frac{\Theta_4\left\{0,\ e^{-\left(\frac{\pi}{d_{j+1}-d_j}\right)^2\eta_{zj}(t-\tau)}\right\}}{4(\phi c_t)_j ab(d_{j+1}-d_j)}\times\times \tag{0.6}$$

$$\left[\Theta_3\left\{\frac{\pi(x-u)}{2a},\ e^{-\left(\frac{\pi}{a}\right)^2\eta_{xj}(t-\tau)}\right\}+\Theta_3\left\{\frac{\pi(x+u)}{2a},\ e^{-\left(\frac{\pi}{a}\right)^2\eta_{xj}(t-\tau)}\right\}\right]\times\times$$

$$\left[\Theta_3\left\{\frac{\pi(y-v)}{2b},\ e^{-\left(\frac{\pi}{b}\right)^2\eta_{yj}(t-\tau)}\right\}+\Theta_3\left\{\frac{\pi(y+v)}{2b},\ e^{-\left(\frac{\pi}{b}\right)^2\eta_{yj}(t-\tau)}\right\}\right]$$

$$C_j(x,u,y,v,t)=B_{j-1}(x,u,y,v,t) \tag{0.7}$$

and $$\Omega_j(x,y,t)=\frac{U(t-t_{0j-1})\sin\vartheta_{0j-1}}{4(\phi c_t)_{j-1}ab(d_j-d_{j-1})}\int_0^{t-t_{0j-1}}q_{j-1}(t-t_{0j-1}-\tau)\times\times \tag{0.8}$$

$$\int_{z_{01j-1}}^{z_{02j-1}}\left[\left\{\Theta_3\left(\frac{\pi}{2a}\{x-(z_{0j-1}-\gamma_{0j-1})\cot\vartheta_{0j-1}\cos\theta_{0j-1}\},\ e^{-\left(\frac{\pi}{a}\right)^2\eta_{xj-1}\tau}\right)++\right.\right.$$

$$\left.\Theta_3\left(\frac{\pi}{2a}\{x+(z_{0j-1}-\gamma_{0j-1})\cot\vartheta_{0j-1}\cos\theta_{0j-1}\},\ e^{-\left(\frac{\pi}{a}\right)^2\eta_{xj-1}\tau}\right)\right\}\times\times$$

$$\left\{\Theta_3\left(\frac{\pi}{2b}\{y-(z_{0j-1}-\gamma_{0j-1})\cot\vartheta_{0j-1}\sin\theta_{0j-1}\},\ e^{-\left(\frac{\pi}{b}\right)^2\eta_{yj-1}\tau}\right)++\right.$$

$$\left.\Theta_3\left(\frac{\pi}{2b}\{y+(z_{0j-1}-\gamma_{0j-1})\cot\vartheta_{0j-1}\sin\theta_{0j-1}\},\ e^{-\left(\frac{\pi}{b}\right)^2\eta_{yj-1}\tau}\right)\right\}\times\times$$

$$\left\{\Theta_3\left(\frac{\pi(d_j-z_{0j-1})}{2(d_j-d_{j-1})},\ e^{-\left(\frac{\pi}{d_j-d_{j-1}}\right)^2\eta_{yj-1}\tau}\right)++\right.$$

$$\left.\left.\Theta_3\left(\frac{\pi(d_j+z_{0j-1}-2d_{j-1})}{2(d_j-d_{j-1})},\ e^{-\left(\frac{\pi}{d_j-d_{j-1}}\right)^2\eta_{yj-1}\tau}\right)\right\}\right]dz_{0j-1}d\tau++$$

$$\frac{1}{4(\phi c_t)_{j-1}ab(d_j-d_{j-1})}\int_0^t\int_0^b\int_0^{(d_j-d_{j-1})}$$

$$\left[\psi_{0yzj-1}(v,w,\tau)\Theta_3\left(\frac{\pi x}{2a},\ e^{-\left(\frac{\pi}{a}\right)^2\eta_{xj-1}(t-\tau)}\right)--\right.$$

$$\left.\psi_{ayzj-1}(v,w,\tau)\Theta_4\left(\frac{\pi x}{2a},\ e^{-\left(\frac{\pi}{a}\right)^2\eta_{xj-1}(t-\tau)}\right)\right]\times\times$$

$$\left[\Theta_3\left\{\frac{\pi(y-v)}{2b},\ e^{-\left(\frac{\pi}{b}\right)^2\eta_{yj-1}(t-\tau)}\right\}+\Theta_3\left\{\frac{\pi(y+v)}{2b},\ e^{-\left(\frac{\pi}{b}\right)^2\eta_{yj-1}(t-\tau)}\right\}\right]\times\times$$

$$\left[\Theta_3\left\{\frac{\pi(d_j-d_{j-1}-w)}{2(d_j-d_{j-1})},\ e^{-\left(\frac{\pi}{d_j-d_{j-1}}\right)^2\eta_{zj-1}(t-\tau)}\right\}++\right.$$

$$\left.\Theta_3\left\{\frac{\pi(d_j-d_{j-1}+w)}{2(d_j-d_{j-1})},\ e^{-\left(\frac{\pi}{d_j-d_{j-1}}\right)^2\eta_{zj-1}(t-\tau)}\right\}\right]dvdwd\tau++$$

$$\frac{1}{4(\phi c_t)_{j-1}ab(d_j-d_{j-1})}$$

$$\int_0^t\int_0^a\int_0^{d_j-d_{j-1}}\left[\psi_{x0zj-1}(u,w,\tau)\Theta_3\left(\frac{\pi y}{2b},\ e^{-\left(\frac{\pi}{b}\right)^2\eta_{yj-1}(t-\tau)}\right)--\right.$$

$$\left.\psi_{xbzj-1}(u,w,\tau)\Theta_4\left(\frac{\pi y}{2b},\ e^{-\left(\frac{\pi}{b}\right)^2\eta_{yj-1}(t-\tau)}\right)\right]\times\times$$

$$\left[\Theta_3\left\{\frac{\pi(x-u)}{2a},\ e^{-\left(\frac{\pi}{a}\right)^2\eta_{xj-1}(t-\tau)}\right\}+\Theta_3\left\{\frac{\pi(x+u)}{2a},\ e^{-\left(\frac{\pi}{a}\right)^2\eta_{xj-1}(t-\tau)}\right\}\right]\times\times$$

$$\left[\Theta_3\left\{\frac{\pi(d_j-d_{j-1}-w)}{2(d_j-d_{j-1})},\ e^{-\left(\frac{\pi}{d_j-d_{j-1}}\right)^2\eta_{zj-1}(t-\tau)}\right\}++\right.$$

-continued $$\left.\Theta_3\left\{\frac{\pi(d_j-d_{j-1}+w)}{2(d_j-d_{j-1})},\ e^{-\left(\frac{\pi}{d_j-d_{j-1}}\right)^2\eta_{zj-1}(t-\tau)}\right\}\right]dudwd\tau++$$

$$\frac{1}{8ab(d_j-d_{j-1})}\times\times\int_0^{d_j-d_{j-1}}\int_0^b\int_0^a\varphi(u,v,w+d_{j-1})\times\times$$

$$\left[\Theta_3\left(\frac{\pi(x-u)}{2a},\ e^{-\left(\frac{\pi}{a}\right)^2\eta_{xj-1}t}\right)+\Theta_3\left(\frac{\pi(x+u)}{2a},\ e^{-\left(\frac{\pi}{a}\right)^2\eta_{xj-1}t}\right)\right]\times\times$$

$$\left[\Theta_3\left(\frac{\pi(y-v)}{2b},\ e^{-\left(\frac{\pi}{b}\right)^2\eta_{yj-1}t}\right)+\Theta_3\left(\frac{\pi(y+v)}{2b},\ e^{-\left(\frac{\pi}{b}\right)^2\eta_{yj-1}t}\right)\right]\times\times$$

$$\left[\Theta_3\left(\frac{\pi(d_j-d_{j-1}+w)}{2(d_j-d_{j-1})},\ e^{-\left(\frac{\pi}{d_j-d_{j-1}}\right)^2\eta_{zj-1}t}\right)++\right.$$

$$\left.\Theta_3\left(\frac{\pi(d_j-d_{j-1}+w)}{2(d_j-d_{j-1})},\ e^{-\left(\frac{\pi}{d_{j+1}-d_j}\right)^2\eta_{zj-1}t}\right)\right]dudvdw--$$

$$\frac{U(t-t_{0j})\sin\vartheta_{0j}}{4(\phi c_t)_j ab(d_{j+1}-d_j)}\times\times\int_0^{t-t_{0j}}q_j(t-t_{0j}-\tau)$$

$$\int_{z_{01j}}^{z_{02j}}\left[\left\{\Theta_3\left(\frac{\pi}{2a}\{x-(z_{0j}-\gamma_{0j})\cot\vartheta_{0j}\cos\theta_{0j}\},\ e^{-\left(\frac{\pi}{a}\right)^2\eta_{xj}\tau}\right)++\right.\right.$$

$$\left.\Theta_3\left(\frac{\pi}{2a}\{x+(z_{0j}-\gamma_{0j})\cot\vartheta_{0j}\cos\theta_{0j}\},\ e^{-\left(\frac{\pi}{a}\right)^2\eta_{xj}\tau}\right)\right\}\times\times$$

$$\left\{\Theta_3\left(\frac{\pi}{2b}\{y-(z_{0j}-\gamma_{0j})\cot\vartheta_{0j}\sin\theta_{0j}\},\ e^{-\left(\frac{\pi}{b}\right)^2\eta_{yj}\tau}\right)++\right.$$

$$\left.\Theta_3\left(\frac{\pi}{2b}\{y+(z_{0j}-\gamma_{0j})\cot\vartheta_{0j}\sin\theta_{0j}\},\ e^{-\left(\frac{\pi}{b}\right)^2\eta_{yj}\tau}\right)\right\}\times\times$$

$$\left.\Theta_3\left(\frac{\pi(d_j-z_{0j})}{2(d_{j+1}-d_j)},\ e^{-\left(\frac{\pi}{d_{j+1}-d_j}\right)^2\eta_{yj}\tau}\right)\right]dz_{0j}d\tau--$$

$$\frac{1}{2(\phi c_t)_j ab(d_{j+1}-d_j)}\int_0^t\int_0^b\int_0^{d_{j+1}-d_j}$$

$$\left[\psi_{0yzj}(v,w,\tau)\Theta_3\left(\frac{\pi x}{2a},\ e^{-\left(\frac{\pi}{a}\right)^2\eta_{xj}(t-\tau)}\right)--\right.$$

$$\left.\psi_{ayzj}(v,w,\tau)\Theta_4\left(\frac{\pi x}{2a},\ e^{-\left(\frac{\pi}{a}\right)^2\eta_{xj}(t-\tau)}\right)\right]$$

$$\Theta_3\left(\frac{\pi w}{2(d_{j+1}-d_j)},\ e^{-\left(\frac{\pi}{d_{j+1}-d_j}\right)^2\eta_{zj}(t-\tau)}\right)\times\times$$

$$\left[\Theta_3\left\{\frac{\pi(y-v)}{2b},\ e^{-\left(\frac{\pi}{b}\right)^2\eta_{yj}(t-\tau)}\right\}+\Theta_3\left\{\frac{\pi(y+v)}{2b},\ e^{-\left(\frac{\pi}{b}\right)^2\eta_{yj}(t-\tau)}\right\}\right]dvdwd\tau--$$

$$\frac{1}{2(\phi c_t)_j ab(d_{j+1}-d_j)}$$

$$\int_0^t\int_0^a\int_0^{d_{j+1}-d_j}\left[\psi_{x0zj}(u,w,\tau)\Theta_3\left(\frac{\pi y}{2b},\ e^{-\left(\frac{\pi}{b}\right)^2\eta_{yj}(t-\tau)}\right)--\right.$$

$$\left.\psi_{xbzj}(u,w,\tau)\Theta_4\left(\frac{\pi y}{2b},\ e^{-\left(\frac{\pi}{b}\right)^2\eta_{yj}(t-\tau)}\right)\right]$$

$$\Theta_3\left(\frac{\pi w}{2(d_{j+1}-d_j)},\ e^{-\left(\frac{\pi}{d_{j+1}-d_j}\right)^2\eta_{zj}(t-\tau)}\right)\times\times$$

$$\left[\Theta_3\left\{\frac{\pi(x-u)}{2a},\ e^{-\left(\frac{\pi}{a}\right)^2\eta_{xj}(t-\tau)}\right\}+\Theta_3\left\{\frac{\pi(x+u)}{2a},\ e^{-\left(\frac{\pi}{a}\right)^2\eta_{xj}(t-\tau)}\right\}\right]dudwd\tau--$$

$$\frac{1}{4ab(d_{j+1}-d_j)}\int_0^{d_{j+1}-d_j}\int_0^b\int_0^a\varphi(u,v,w+d_j)$$

-continued $$\Theta_3\left(\frac{\pi w}{2(d_{j+1}-d_j)}, e^{-\left(\frac{\pi}{d_{j+1}-d_j}\right)^2\eta_{zj}t}\right)\times\times$$

$$\left[\Theta_3\left(\frac{\pi(x-u)}{2a}, e^{-\left(\frac{\pi}{a}\right)^2\eta_{xj}t}\right)+\Theta_3\left(\frac{\pi(x+u)}{2a}, e^{-\left(\frac{\pi}{a}\right)^2\eta_{xj}t}\right)\right]\times\times$$

$$\left[\Theta_3\left(\frac{\pi(y-v)}{2b}, e^{-\left(\frac{\pi}{b}\right)^2\eta_{yj}t}\right)+\Theta_3\left(\frac{\pi(y+v)}{2b}, e^{-\left(\frac{\pi}{b}\right)^2\eta_{yj}t}\right)\right]dudvdw$$

The spatial average pressure response of the inclined line $[(z_{02j}-z_{01j})\sin\theta_{0j}]$ is obtained by a further integration $$p=\frac{U(t-t_{0j})\sin\vartheta_{0j}}{8(\phi c_t)_j ab(d_{j+1}-d_j)(z_{02j}-_{01j})}\int_0^{t-t_{0j}} q_j(t-t_{0j}-\tau)\times\times \tag{0.9}$$

$$\int_{z_{01j}}^{z_{02j}}\int_{z_{01j}}^{z_{02j}}\left[\left\{\Theta_3\left(\frac{\pi}{2a}\{(z-z_{0j})\cot\vartheta_{0j}\cos\theta_{0j}\}, e^{-\left(\frac{\pi}{a}\right)^2\eta_{xj}\tau}\right)++\right.\right.$$

$$\Theta_3\left(\frac{\pi}{2a}\{(z+z_{0j}-2\gamma_{0j})\cot\vartheta_{0j}\cos\theta_{0j}\},\right.$$

$$\left.e^{-\left(\frac{\pi}{a}\right)^2\eta_{xj}\tau}\right)\Big\}\times\times$$

$$\left\{\Theta_3\left(\frac{\pi}{2b}\{(z-z_{0j})\cot\vartheta_{0j}\sin\theta_{0j}\}, e^{-\left(\frac{\pi}{b}\right)^2\eta_{yj}\tau}\right)++\right.$$

$$\Theta_3\left(\frac{\pi}{2b}\{(z+z_{0j}-2\gamma_{0j})\cot\vartheta_{0j}\sin\theta_{0j}\},\right.$$

$$\left.e^{-\left(\frac{\pi}{b}\right)^2\eta_{yj}\tau}\right)\Big\}\times\times$$

$$\left\{\Theta_3\left(\frac{\pi(z-z_{0j})}{2(d_{j+1}-d_j)}, e^{-\left(\frac{\pi}{d_{j+1}-d_j}\right)^2\eta_{yj}\tau}\right)+\right.$$

$$\left.\left.\Theta_3\left(\frac{\pi(z+z_{0j}-2d_j)}{2(d_{j+1}-d_j)}, e^{-\left(\frac{\pi}{d_{j+1}-d_j}\right)^2\eta_{yj}\tau}\right)\right\}\right]dz_{0j}$$

$$dzd\tau++\frac{4}{(\phi c_t)_j ab(d_{j+1}-d_j)(z_{02j}-z_{01j})}\times\times$$

$$\sum_{m=0}^{\infty}\sum_{l=0}^{\infty}\ni_m\ \ni_l$$

$$\int_{z_{01j}}^{z_{02j}}\cos\left(\frac{m\pi(z-\gamma_{0j})\cot\vartheta_{0j}\sin\theta_{0j}}{b}\right)$$

$$\cos\left\{\frac{l\pi(z-d_j)}{d_{j+1}-d_j}\right\}\times\times$$

$$\int_0^t\left\{\bar{\bar{\psi}}_{0yz}(m,l,\tau)\Theta_3\left(\frac{\pi(z-\gamma_{0j})\cot\vartheta_{0j}\cos\theta_{0j}}{2a}, e^{-\left(\frac{\pi}{a}\right)^2\eta_{xj}(t-\tau)}\right)--\right.$$

$$\bar{\bar{\psi}}_{ayz}(m,l,\tau)$$

$$\left.\Theta_4\left(\frac{\pi(z-\gamma_{0j})\cot\vartheta_{0j}\cos\theta_{0j}}{2a}, e^{-\left(\frac{\pi}{a}\right)^2\eta_{xj}(t-\tau)}\right)\right\}\times\times$$

$$e^{-\left\{\left(\frac{m\pi}{b}\right)^2\eta_{yj}+\left(\frac{l\pi}{d_{j+1}-d_j}\right)^2\eta_{zj}\right\}(t-\tau)}d\tau dz++$$

$$\frac{4}{(\phi c_t)_j ab(d_{j+1}-d_j)(z_{02j}-z_{01j})}\times\times$$

$$\sum_{n=0}^{\infty}\sum_{l=0}^{\infty}\ni_n\ \ni_l$$

$$\int_{z_{01j}}^{z_{02j}}\cos\left(\frac{n\pi(z-\gamma_{0j})\cot\vartheta_{0j}\cos\theta_{0j}}{a}\right)$$

$$\cos$$

$$\left\{\frac{l\pi(z-d_j)}{d_{j+1}-d_j}\right\}\times\times$$

-continued $$\int_0^t\left\{\bar{\bar{\psi}}_{x0z}(n,l,\tau)\right.$$

$$\Theta_3\left(\frac{\pi(z_{02j}-z_{01j})\sin\vartheta_{0j}}{2b}, e^{-\left(\frac{\pi}{b}\right)^2\eta_{yj}(t-\tau)}\right)--\bar{\bar{\psi}}_{xbz}(n,l,\tau)$$

$$\left.\Theta_4\left(\frac{\pi(z_{02j}-z_{01j})\sin\vartheta_{0j}}{2b}, e^{-\left(\frac{\pi}{b}\right)^2\eta_{yj}(t-\tau)}\right)\right\}\times\times$$

$$e^{-\left\{\left(\frac{n\pi}{a}\right)^2\eta_{xj}+\left(\frac{l\pi}{d_{j+1}-d_j}\right)^2\eta_{zj}\right\}(t-\tau)}d\tau dz++$$

$$\frac{4}{(\phi c_t)_j ab(d_{j+1}-d_j)(z_{02j}-z_{01j})}\times\times\sum_{n=0}^{\infty}\sum_{m=0}^{\infty}\ni_n\ \ni_m$$

$$\int_{z_{01j}}^{z_{02j}}\cos\left(\frac{n\pi(z-\gamma_{0j})\cot\vartheta_{0j}\cos\theta_{0j}}{a}\right)\cos$$

$$\left(\frac{m\pi(z-\gamma_{0j})\cot\vartheta_{0j}\sin\theta_{0j}}{b}\right)\times\times$$

$$\int_0^t\left\{\bar{\bar{\psi}}_{xy0}(n,m,\tau)\Theta_3\left(\frac{\pi(z-d_j)}{2(d_{j+1}-d_j)}, e^{-\left(\frac{\pi}{d_{j+1}-d_j}\right)^2\eta_{zj}(t-\tau)}\right)--\right.$$

$$\bar{\psi}_{xyd}(n,m,\tau)\Theta_4\left(\frac{\pi(z-d_j)}{2(d_{j+1}-d_j)},\right.$$

$$\left.\left.e^{-\left(\frac{\pi}{d_{j+1}-d_j}\right)^2\eta_{zj}(t-\tau)}\right)\right\}\times\times e^{-\left\{\left(\frac{n\pi}{a}\right)^2\eta_{xj}+\left(\frac{m\pi}{b}\right)^2\eta_{yj}\right\}(t-\tau)}$$

$$d\tau dz++\frac{1}{8ab(d_{j+1}-d_j)(z_{02j}-z_{01j})}$$

$$\int_0^d\int_0^b\int_0^a\varphi(u,v,w+d_j)\times\times$$

$$\int_{z_{01j}}^{z_{02j}}\left[\left\{\Theta_3\left(\frac{\pi}{2a}((z-\gamma_{0j})\cot\vartheta_{0j}\cos\theta_{0j}-u), e^{-\left(\frac{\pi}{a}\right)^2\eta_{xj}t}\right)+\right.\right.$$

$$\Theta_3\left(\frac{\pi}{2a}((z-\gamma_{0j})\cot\vartheta_{0j}\cos\theta_{0j}+u),\right.$$

$$\left.e^{-\left(\frac{\pi}{a}\right)^2\eta_{xj}t}\right)\Big\}\times\times$$

$$\left\{\Theta_3\left(\frac{\pi}{2b}((z-\gamma_{0j})\cot\vartheta_{0j}\sin\theta_{0j}-v),\right.\right.$$

$$e^{-\left(\frac{\pi}{b}\right)^2\eta_{yj}t}\Big)+\Theta_3\left(\frac{\pi}{2b}((z-\gamma_{0j})\cot\right.$$

$$\left.\left.\vartheta_{0j}\sin\theta_{0j}+v), e^{-\left(\frac{\pi}{b}\right)^2\eta_{yj}t}\right)\Big\}\times\times$$

$$\left\{\Theta_3\left(\frac{\pi(z-d_j-w)}{2(d_{j+1}-d_j)}, e^{-\left(\frac{\pi}{d_{j+1}-d_j}\right)^2\eta_{zj}t}\right)+\right.$$

$$\Theta_3\left(\frac{\pi(z-d_j+w)}{2(d_{j+1}-d_j)},\right.$$

$$\left.\left.\left.e^{-\left(\frac{\pi}{d_{j+1}-d_j}\right)^2\eta_{zj}t}\right)\right\}\right]dudvdwdz$$

The Production Steered Well and Other Wells (Vertical, Horizontal and Fractured) in the Reservoir.

When hydrocarbon production is occurring through multiple line sources of finite lengths $[z_{02\iota j}-z_{01\iota j}]$, $[x_{02\iota j}-x_{01\iota j}]$ and $[y_{02\iota j}-y_{01\iota j}]$ passing through $(x_{0\iota j}, y_{0\iota j})$ for $\iota=1, 2\ldots, L_l$, $(y_{0\iota j}, z_{0\iota j})$ for $\iota=L_l+1, \ldots, M_l$, and $(x_{0\iota j}, z_{0\iota j})$ for $\iota=M_l+1, \ldots, N_l$ and multiple deviated wells $[(z_{02\iota j}-z_{01\iota j})\sin\theta_{0\iota j}]$ passing through $(x_{0\iota j}, y_{0\iota j}, z_{0\iota j})$ for $\iota=N_l+1, \ldots, N_d$ and multiple rectangular sources of finite area $[x_{02\iota j}-x_{01\iota j}][y_{02\iota j}-y_{01\iota j}]$, $[y_{02\iota j}-y_{01\iota j}][z_{02\iota j}-z_{01\iota j}]$ and $[x_{02\iota j}-x_{01\iota j}][z_{02\iota j}-z_{01\iota j}]$ passing through $z_{0\iota j}$ for $\iota=N_d+1, \ldots, L_r$, $x_{0\iota j}$ for $\iota=L_r+1, \ldots, M_r$, and $y_{0\iota j}$ for $\iota=M_r+1, \ldots, N_r$ respectively*. Where $(L_l<M_l<N_l<N_d L_r<M_r<N_r)$.

*For $\iota=1, 2, \ldots N_l$ $q_{\iota j}$ is flux per unit length in layer j and for $\iota=N_l=1, \ldots N_r$ $q_{\iota j}$ is flux per unit area in layer j The pressure solution at any given point [x, y, z] in space at time ι is obtained by replacing the source term in equations (0.2) by $$p_j = \frac{1}{4(\phi c_t)_j ab}\sum_{\iota=1}^{L_l} U(t-t_{0\iota j}) \tag{0.10}$$

$$\int_0^{t-t_{0\iota j}} q_{\iota j}(t-t_{0\iota j}-\tau)\times\times\left\{\Theta_3\left(\frac{\pi(x-x_{0\iota j})}{2a}, e^{-\left(\frac{\pi}{a}\right)^2\eta_{xj}\tau}\right)+\Theta_3\left(\frac{\pi(x+x_{0\iota j})}{2a}, e^{-\left(\frac{\pi}{a}\right)^2\eta_{xj}\tau}\right)\right\}\times\times\left\{\Theta_3\left(\frac{\pi(y-y_{0\iota j})}{2b}, e^{-\left(\frac{\pi}{b}\right)^2\eta_{yj}\tau}\right)+\Theta_3\left(\frac{\pi(y+y_{0\iota j})}{2b}, e^{-\left(\frac{\pi}{b}\right)^2\eta_{yj}\tau}\right)\right\}\times\times$$

$$\left\{\Theta_3\left(\frac{\pi(z-z_{01\iota j})}{2(d_{j+1}-d_j)}, e^{-\left(\frac{\pi}{d_{j+1}-d_j}\right)^2\eta_{zj}\tau}\right)-\Theta_3\left(\frac{\pi(z+z_{01\iota j}-2d_j)}{2(d_{j+1}-d_j)}, e^{-\left(\frac{\pi}{d_{j+1}-d_j}\right)^2\eta_{zj}\tau}\right)--\Theta_3\left(\frac{\pi(z-z_{02\iota j})}{2(d_{j+1}-d_j)}, e^{-\left(\frac{\pi}{d_{j+1}-d_j}\right)^2\eta_{zj}\tau}\right)+\Theta_3\left(\frac{\pi(z+z_{02\iota j}-2d_j)}{2(d_{j+1}-d_j)}, e^{-\left(\frac{\pi}{d_{j+1}-d_j}\right)^2\eta_{zj}\tau}\right)\right\}$$

$$d\tau++\frac{1}{4(\phi c_t)_j b(d_{j+1}-d_j)}$$

$$\sum_{\iota=L_l+1}^{M_l} U(t-t_{0\iota j})\int_0^{t-t_{0\iota j}} q_{\iota j}(t-t_{0\iota j}-\tau)\times\times$$

$$\left\{\Theta_3\left(\frac{\pi(y-y_{0\iota j})}{2b}, e^{-\left(\frac{\pi}{b}\right)^2\eta_{yj}\tau}\right)+\Theta_3\left(\frac{\pi(y+y_{0\iota j})}{2b}, e^{-\left(\frac{\pi}{b}\right)^2\eta_{yj}\tau}\right)\right\}\times\times$$

$$\left\{\Theta_3\left(\frac{\pi(z-z_{0\iota j})}{2(d_{j+1}-d_j)}, e^{-\left(\frac{\pi}{d_{j+1}-d_j}\right)^2\eta_{zj}\tau}\right)+\Theta_3\left(\frac{\pi(z+z_{0\iota j}-2d_j)}{2(d_{j+1}-d_j)}, e^{-\left(\frac{\pi}{d_{j+1}-d_j}\right)^2\eta_{zj}\tau}\right)\right\}\times\times$$

$$\left\{\Theta_3\left(\frac{\pi(x-x_{01\iota j})}{2a}, e^{-\left(\frac{\pi}{a}\right)^2\eta_{xj}\tau}\right)-\Theta_3\left(\frac{\pi(x+x_{01\iota j})}{2a}, e^{-\left(\frac{\pi}{a}\right)^2\eta_{xj}\tau}\right)--\Theta_3\left(\frac{\pi(x-x_{02\iota j})}{2a}, e^{-\left(\frac{\pi}{a}\right)^2\eta_{xj}\tau}\right)+\Theta_3\left(\frac{\pi(x+x_{02\iota j})}{2a}, e^{-\left(\frac{\pi}{a}\right)^2\eta_{xj}\tau}\right)\right\}d\tau++\frac{1}{4(\phi c_t)_j a(d_{j+1}-d_j)}$$

$$\sum_{\iota=M_l+1}^{N_l} U(t-t_{0\iota j})\int_0^{t-t_{0\iota j}} q_{\iota j}(t-t_{0\iota j}-\tau)\times\times$$

$$\left\{\Theta_3\left(\frac{\pi(x-x_{0\iota j})}{2a}, e^{-\left(\frac{\pi}{a}\right)^2\eta_{xj}\tau}\right)+\Theta_3\left(\frac{\pi(x+x_{0\iota j})}{2a}, e^{-\left(\frac{\pi}{a}\right)^2\eta_{xj}\tau}\right)\right\}\times\times$$

$$\left\{\Theta_3\left(\frac{\pi(z-z_{0\iota j})}{2(d_{j+1}-d_j)}, e^{-\left(\frac{\pi}{d_{j+1}-d_j}\right)^2\eta_{zj}\tau}\right)+$$

-continued $$\Theta_3\left(\frac{\pi(z+z_{0\iota j}-2d_j)}{2(d_{j+1}-d_j)}, e^{-\left(\frac{\pi}{d_{j+1}-d_j}\right)^2\eta_{zj}\tau}\right)\right\}\times\times$$

$$\left\{\Theta_3\left(\frac{\pi(y-y_{01\iota j})}{2b}, e^{-\left(\frac{\pi}{b}\right)^2\eta_{yj}\tau}\right)-\Theta_3\left(\frac{\pi(y+y_{01\iota j})}{2b}, e^{-\left(\frac{\pi}{b}\right)^2\eta_{yj}\tau}\right)--\Theta_3\left(\frac{\pi(y-y_{02\iota j})}{2b}, e^{-\left(\frac{\pi}{b}\right)^2\eta_{yj}\tau}\right)+\Theta_3\left(\frac{\pi(y+y_{02\iota j})}{2b}, e^{-\left(\frac{\pi}{b}\right)^2\eta_{yj}\tau}\right)\right\}$$

$$d\tau++\frac{1}{8(\phi c_t)_j ab(d_{j+1}-d_j)}\times\times$$

$$\sum_{\iota=N_l+1}^{N_d} U(t-t_{0\iota j})\sin\vartheta_{0\iota j}$$

$$\int_0^{t-t_{0\iota j}} q_{\iota j}(t-t_{0\iota j}-\tau)\times\times$$

$$\int_{z_{01\iota j}}^{z_{02\iota j}}\left[\left\{\Theta_3\left(\frac{\pi}{2a}\{x-(z_{0\iota j}-\gamma_{0\iota j})\cot\vartheta_{0\iota j}\cos\theta_{0\iota j}\}, e^{-\left(\frac{\pi}{a}\right)^2\eta_{xj}\tau}\right)++\Theta_3\left(\frac{\pi}{2a}\{x+(z_{0\iota j}-\gamma_{0\iota j})\cot\vartheta_{0\iota j}\cos\theta_{0\iota j}\}, e^{-\left(\frac{\pi}{a}\right)^2\eta_{xj}\tau}\right)\right\}\times\times\right.$$

$$\left\{\Theta_3\left(\frac{\pi}{2b}\{y-(z_{0\iota j}-\gamma_{0\iota j})\cot\vartheta_{0\iota j}\sin\theta_{0\iota j}\}, e^{-\left(\frac{\pi}{b}\right)^2\eta_{yj}\tau}\right)++\Theta_3\left(\frac{\pi}{2b}\{y+(z_{0\iota j}-\gamma_{0\iota j})\cot\vartheta_{0\iota j}\sin\theta_{0\iota j}\}, e^{-\left(\frac{\pi}{b}\right)^2\eta_{yj}\tau}\right)\right\}\times\times\left\{\Theta_3\left(\frac{\pi(z-z_{0\iota j})}{2(d_{j+1}-d_j)}, e^{-\left(\frac{\pi}{d_{j+1}-d_j}\right)^2\eta_{yj}\tau}\right)+\Theta_3\left(\frac{\pi(z+z_{0\iota j}-2d_j)}{2(d_{j+1}-d_j)}, e^{-\left(\frac{\pi}{d_{j+1}-d_j}\right)^2\eta_{yj}\tau}\right)\right\}\Bigg]dz_{0\iota j}d\tau++$$

$$\frac{1}{2(\phi c_t)_j(d_{j+1}-d_j)}\sum_{\iota=N_d+1}^{L_r} U(t-t_{0\iota j})$$

$$\int_0^{t-t_{0\iota j}} q_{\iota j}(t-t_{0\iota j}-\tau)\times\times$$

$$\left\{\Theta_3\left(\frac{\pi(x-x_{0\iota j})}{2a}, e^{-\left(\frac{\pi}{a}\right)^2\eta_{xj}\tau}\right)-\Theta_3\left(\frac{\pi(x+x_{01\iota j})}{2a}, e^{-\left(\frac{\pi}{a}\right)^2\eta_{xj}\tau}\right)--\Theta_3\left(\frac{\pi(x-x_{02\iota j})}{2a}, e^{-\left(\frac{\pi}{a}\right)^2\eta_{xj}\tau}\right)+\Theta_3\left(\frac{\pi(x+x_{02\iota j})}{2a}, e^{-\left(\frac{\pi}{a}\right)^2\eta_{xj}\tau}\right)\right\}\times\times$$

-continued $$\left\{\Theta_3^f\left(\frac{\pi(y-y_{01i,j})}{2b}, e^{-\left(\frac{\pi}{b}\right)^2\eta_{yj}\tau}\right)-\Theta_3^f\left(\frac{\pi(y+y_{01i,j})}{2b}, e^{-\left(\frac{\pi}{b}\right)^2\eta_{yj}\tau}\right)--\Theta_3^f\left(\frac{\pi(y-y_{02i,j})}{2b}, e^{-\left(\frac{\pi}{b}\right)^2\eta_{yj}\tau}\right)+\Theta_3^f\left(\frac{\pi(y+y_{02i,j})}{2b}, e^{-\left(\frac{\pi}{b}\right)^2\eta_{yj}\tau}\right)\right\}\times\times$$

$$\left\{\Theta_3\left(\frac{\pi(z-z_{0i,j})}{2(d_{j+1}-d_j)}, e^{-\left(\frac{\pi}{d_{j+1}-d_j}\right)^2\eta_{zj}\tau}\right)+\Theta_3\left(\frac{\pi(z+z_{0i,j}-2d_j)}{2(d_{j+1}-d_j)}, e^{-\left(\frac{\pi}{d_{j+1}-d_j}\right)^2\eta_{zj}\tau}\right)\right\}d\tau++$$

$$\frac{1}{2(\phi c_t)_j a}\sum_{i=L_r+1}^{M_r} U(t-t_{0i,j})\int_0^{t-t_{0i,j}} q_{i,j}(t-t_{0i,j})-\tau\Big)\times\times$$

$$\left\{\Theta_3\left(\frac{\pi(x-x_{0i,j})}{2a}, e^{-\left(\frac{\pi}{a}\right)^2\eta_{xj}\tau}\right)+\Theta_3\left(\frac{\pi(x+x_{0i,j})}{2a}, e^{-\left(\frac{\pi}{a}\right)^2\eta_{xj}\tau}\right)\right\}\times\times$$

$$\left\{\Theta_3^f\left(\frac{\pi(y-y_{01i,j})}{2b}, e^{-\left(\frac{\pi}{b}\right)^2\eta_{yj}\tau}\right)-\Theta_3^f\left(\frac{\pi(y+y_{01i,j})}{2b}, e^{-\left(\frac{\pi}{b}\right)^2\eta_{yj}\tau}\right)--\Theta_3^f\left(\frac{\pi(y-y_{02i,j})}{2b}, e^{-\left(\frac{\pi}{b}\right)^2\eta_{yj}\tau}\right)+\Theta_3^f\left(\frac{\pi(y+y_{02i,j})}{2b}, e^{-\left(\frac{\pi}{b}\right)^2\eta_{yj}\tau}\right)\right\}\times\times$$

$$\left\{\Theta_3^f\left(\frac{\pi(z-z_{01i,j})}{2(d_{j+1}-d_j)}, e^{-\left(\frac{\pi}{d_{j+1}-d_j}\right)^2\eta_{zj}\tau}\right)-\Theta_3^f\left(\frac{\pi(z+z_{01i,j}-2d_j)}{2(d_{j+1}-d_j)}, e^{-\left(\frac{\pi}{d_{j+1}-d_j}\right)^2\eta_{zj}\tau}\right)--\Theta_3^f\left(\frac{\pi(z-z_{02i,j})}{2(d_{j+1}-d_j)}, e^{-\left(\frac{\pi}{d_{j+1}-d_j}\right)^2\eta_{zj}\tau}\right)+\Theta_3^f\left(\frac{\pi(z+z_{02i,j}-2d_j)}{2(d_{j+1}-d_j)}, e^{-\left(\frac{\pi}{d_{j+1}-d_j}\right)^2\eta_{zj}\tau}\right)\right\}d\tau++\frac{1}{2(\phi c_t)_j b}$$

-continued $$\sum_{i=M_r+1}^{N_r} U(t-t_{0i,j})\int_0^{t-t_{0i,j}} q_{i,j}(t-t_{0i,j}-\tau)\times\times\left\{\Theta_3^f\left(\frac{\pi(x-x_{01i,j})}{2a}, e^{-\left(\frac{\pi}{a}\right)^2\eta_{xj}\tau}\right)-\Theta_3^f\left(\frac{\pi(x+x_{01i,j})}{2a}, e^{-\left(\frac{\pi}{a}\right)^2\eta_{xj}\tau}\right)--\Theta_3^f\left(\frac{\pi(x-x_{02i,j})}{2a}, e^{-\left(\frac{\pi}{a}\right)^2\eta_{xj}\tau}\right)+\Theta_3^f\left(\frac{\pi(x+x_{02i,j})}{2a}, e^{-\left(\frac{\pi}{a}\right)^2\eta_{xj}\tau}\right)\right\}\times\times\left\{\Theta_3\left(\frac{\pi(y-y_{0i,j})}{2b}, e^{-\left(\frac{\pi}{b}\right)^2\eta_{yj}\tau}\right)+\Theta_3\left(\frac{\pi(y+y_{0i,j})}{2b}, e^{-\left(\frac{\pi}{b}\right)^2\eta_{yj}\tau}\right)\right\}\times\times\left\{\Theta_3^f\left(\frac{\pi(z-z_{01i,j})}{2(d_{j+1}-d_j)}, e^{-\left(\frac{\pi}{d_{j+1}-d_j}\right)^2\eta_{zj}\tau}\right)-\Theta_3^f\left(\frac{\pi(z+z_{01i,j}-2d_j)}{2(d_{j+1}-d_j)}, e^{-\left(\frac{\pi}{d_{j+1}-d_j}\right)^2\eta_{zj}\tau}\right)--\Theta_3^f\left(\frac{\pi(z-z_{02i,j})}{2(d_{j+1}-d_j)}, e^{-\left(\frac{\pi}{d_{j+1}-d_j}\right)^2\eta_{zj}\tau}\right)+\Theta_3^f\left(\frac{\pi(z+z_{02i,j}-2d_j)}{2(d_{j+1}-d_j)}, e^{-\left(\frac{\pi}{d_{j+1}-d_j}\right)^2\eta_{zj}\tau}\right)\right\}d\tau$$

The coefficients of the recurrence integral equation (0.3), $A_j(\xi_n, \xi_m, t-\tau)$, $B_j(\xi_n, \xi_m, t-\tau)$, and $C_j(\xi_n, \xi_m, t-\tau)$ are given by equations (0.4), (0.6) and (0.7) respectively. The coefficient $\Omega_j^{cc}(x,y,t)$ is given by $$\Omega_j(x, y, t) = \tag{0.11}$$

$$\frac{1}{4(\phi c_t)_{j-1} ab}\sum_{i=1}^{L_i} U(t-t_{0i,j-1})\int_0^{t-t_{0i,j-1}} q_{i,j-1}(t-t_{0i,j-1}-\tau)\times\times$$

$$\left\{\Theta_3\left(\frac{\pi(x-x_{0ij-1})}{2a}, e^{-\left(\frac{\pi}{a}\right)^2\eta_{xj-1}\tau}\right)+\Theta_3\left(\frac{\pi(x+x_{0i,j-1})}{2a}, e^{-\left(\frac{\pi}{a}\right)^2\eta_{xj-1}\tau}\right)\right\}\times\times$$

$$\left\{\Theta_3\left(\frac{\pi(y-y_{0i,j-1})}{2b}, e^{-\left(\frac{\pi}{b}\right)^2\eta_{yj-1}\tau}\right)+\Theta_3\left(\frac{\pi(y+y_{0i,j-1})}{2b}, e^{-\left(\frac{\pi}{b}\right)^2\eta_{yj-1}\tau}\right)\right\}\times\times$$

$$\left\{\Theta_3^f\left(\frac{\pi(d_j-z_{01i,j-1})}{2(d_j-d_j)}, e^{-\left(\frac{\pi}{d_j-d_{j-1}}\right)^2\eta_{zj-1}\tau}\right)--\right.$$

-continued $$\Theta_3^f\left(\frac{\pi(d_j+z_{01i,j-1}-2d_{j-1})}{2(d_j-d_{j-1})},\ e^{-\left(\frac{\pi}{d_j-d_{j-1}}\right)^2\eta_{zj-1}\tau}\right)--$$

$$\Theta_3^f\left(\frac{\pi(d_j-z_{02i,j-1})}{2(d_j-d_{j-1})},\ e^{-\left(\frac{\pi}{d_j-d_{j-1}}\right)^2\eta_{zj-1}\tau}\right)++$$

$$\Theta_3^f\left(\frac{\pi(d_j+z_{02i,j-1}-2d_{j-1})}{2(d_j-d_{j-1})},\ e^{-\left(\frac{\pi}{d_j-d_{j-1}}\right)^2\eta_{zj-1}\tau}\right)\Bigg\}d\tau++$$

$$\frac{1}{4(\phi c_t)_{j-1}b(d_j-d_{j-1})}\sum_{i=L_i+1}^{M_i}U(t-t_{0i,j-1})$$

$$\int_0^{t-t_{0i,j-1}}q_{i,j-1}(t-t_{0i,j-1}-\tau)\times\times\Bigg\{\Theta_3\left(\frac{\pi(y-y_{0i,j-1})}{2b},\ e^{-\left(\frac{\pi}{b}\right)^2\eta_{yj-1}\tau}\right)+$$

$$\Theta_3\left(\frac{\pi(y+y_{0i,j-1})}{2b},\ e^{-\left(\frac{\pi}{b}\right)^2\eta_{yj-1}\tau}\right)\Bigg\}\times\times$$

$$\Bigg\{\Theta_3\left(\frac{\pi(d_j-z_{0i,j-1})}{2(d_j-d_{j-1})},\ e^{-\left(\frac{\pi}{d_j-d_{j-1}}\right)^2\eta_{zj-1}\tau}\right)++$$

$$\Theta_3\left(\frac{\pi(d_j+z_{0i,j-1}-2d_{j-1})}{2(d_j-d_{j-1})},\ e^{-\left(\frac{\pi}{d_j-d_{j-1}}\right)^2\eta_{zj-1}\tau}\right)\Bigg\}\times\times$$

$$\Bigg\{\Theta_3\left(\frac{\pi(x-x_{01i,j-1})}{2a},\ e^{-\left(\frac{\pi}{a}\right)^2\eta_{xj-1}\tau}\right)-$$

$$\Theta_3^f\left(\frac{\pi(x+x_{01i,j-1})}{2a},\ e^{-\left(\frac{\pi}{a}\right)^2\eta_{xj-1}\tau}\right)--\Theta_3^f\left(\frac{\pi(x-x_{02i,j-1})}{2a},\ e^{-\left(\frac{\pi}{a}\right)^2\eta_{xj-1}\tau}\right)$$

$$\Theta_3^f\left(\frac{\pi(x+x_{02i,j-1})}{2a},\ e^{-\left(\frac{\pi}{a}\right)^2\eta_{xj-1}\tau}\right)\Bigg\}$$

$$d\tau++\frac{1}{4(\phi c_t)_{j-1}a(d_j-d_{j-1})}$$

$$\sum_{i=M_i+1}^{N_i}U(t-t_{0i,j-1})\int_0^{t-t_{0i,j-1}}q_{i,j-1}(t-t_{0i,j-1}-\tau)\times\times$$

$$\Bigg\{\Theta_3\left(\frac{\pi(x-x_{0i,j-1})}{2a},\ e^{-\left(\frac{\pi}{a}\right)^2\eta_{xj-1}\tau}\right)+$$

$$\Theta_3\left(\frac{\pi(x+x_{0i,j-1})}{2a},\ e^{-\left(\frac{\pi}{a}\right)^2\eta_{xj-1}\tau}\right)\Bigg\}\times\times$$

$$\Bigg\{\Theta_3\left(\frac{\pi(d_j-z_{0i,j-1})}{2(d_j-d_{j-1})},\ e^{-\left(\frac{\pi}{d_j-d_{j-1}}\right)^2\eta_{zj-1}\tau}\right)++$$

$$\Theta_3\left(\frac{\pi(d_j+z_{0i,j-1}-2d_{j-1})}{2(d_j-d_{j-1})},\ e^{-\left(\frac{\pi}{d_j-d_{j-1}}\right)^2\eta_{zj-1}\tau}\right)\Bigg\}\times\times$$

$$\Bigg\{\Theta_3^f\left(\frac{\pi(y-y_{01i,j-1})}{2b},\ e^{-\left(\frac{\pi}{b}\right)^2\eta_{yj-1}\tau}\right)-$$

$$\Theta_3^f\left(\frac{\pi(y+y_{01i,j-1})}{2b},\ e^{-\left(\frac{\pi}{b}\right)^2\eta_{yj-1}\tau}\right)--$$

$$\Theta_3^f\left(\frac{\pi(y-y_{02i,j-1})}{2b},\ e^{-\left(\frac{\pi}{b}\right)^2\eta_{yj-1}\tau}\right)+$$

$$\Theta_3^f\left(\frac{\pi(y+y_{02i,j-1})}{2b},\ e^{-\left(\frac{\pi}{b}\right)^2\eta_{yj-1}\tau}\right)\Bigg\}d\tau++\frac{1}{8(\phi c_t)_{j-1}ab(d_j-d_{j-1})}$$

$$\sum_{i=N_i+1}^{N_d}U(t-t_{0i,j-1})\sin\vartheta_{0i,j-1}\int_0^{t-t_{0i,j-1}}q_{i,j-1}(t-t_{0i,j-1}-\tau)\times\times$$

$$\int_{z_{01i,j-1}}^{z_{02i,j-1}}\Bigg[\Bigg\{\Theta_3\Bigg(\frac{\pi}{2a}\{x-(z_{0i,j-1}-\gamma_{0i,j-1})\cot\vartheta_{0i,j-1}\cos\theta_{0i,j-1}\},$$

-continued $$e^{-\left(\frac{\pi}{a}\right)^2\eta_{xj-1}\tau}\Bigg)++\Theta_3\Bigg(\frac{\pi}{2a}\{x+(z_{0i,j-1}-\gamma_{0i,j-1})\cot\vartheta_{0i,j-1}\cos\theta_{0i,j-1}\},$$

$$e^{-\left(\frac{\pi}{a}\right)^2\eta_{xj-1}\tau}\Bigg)\Bigg\}\times\times\Bigg\{\Theta_3\Bigg(\frac{\pi}{2b}\{y-(z_{0i,j-1}-\gamma_{0i,j-1})\cot\vartheta_{0i,j-1}\sin\theta_{0i,j-1}\},$$

$$e^{-\left(\frac{\pi}{b}\right)^2\eta_{yj-1}\tau}\Bigg)++\Theta_3\Bigg(\frac{\pi}{2b}\{y+(z_{0i,j-1}-\gamma_{0i,j-1})\cot\vartheta_{0i,j-1}\sin\theta_{0i,j-1}\},$$

$$e^{-\left(\frac{\pi}{b}\right)^2\eta_{yj-1}\tau}\Bigg)\Bigg\}\times\times\Bigg\{\Theta_3\left(\frac{\pi(d_j-z_{0i,j-1})}{2(d_j-d_{j-1})},\ e^{-\left(\frac{\pi}{d_j-d_{j-1}}\right)^2\eta_{yj-1}\tau}\right)++$$

$$\Theta_3\left(\frac{\pi(d_j+z_{0i,j-1}-2d_{j-1})}{2(d_j-d_{j-1})},\ e^{-\left(\frac{\pi}{d_j-d_{j-1}}\right)^2\eta_{yj-1}\tau}\right)\Bigg\}\Bigg]dz_{0i,j-1}$$

$$d\tau++\frac{1}{2(\phi c_t)_{j-1}(d_j-d_{j-1})}\sum_{i=N_d+1}^{L_r}$$

$$U(t-t_{0i,j-1})\int_0^{t-t_{0i,j-1}}q_{i,j-1}(t-t_{0i,j-1}-\tau)\times\times$$

$$\Bigg\{\Theta_3^f\left(\frac{\pi(x-x_{01i,j-1})}{2a},\ e^{-\left(\frac{\pi}{a}\right)^2\eta_{xj-1}\tau}\right)-$$

$$\Theta_3^f\left(\frac{\pi(x+x_{01i,j-1})}{2a},\ e^{-\left(\frac{\pi}{a}\right)^2\eta_{xj-1}\tau}\right)--$$

$$\Theta_3^f\left(\frac{\pi(x-x_{02i,j-1})}{2a},\ e^{-\left(\frac{\pi}{a}\right)^2\eta_{xj-1}\tau}\right)+$$

$$\Theta_3^f\left(\frac{\pi(x+x_{02i,j-1})}{2a},\ e^{-\left(\frac{\pi}{a}\right)^2\eta_{xj-1}\tau}\right)\Bigg\}\times\times$$

$$\Bigg\{\Theta_3^f\left(\frac{\pi(y-y_{01i,j-1})}{2b},\ e^{-\left(\frac{\pi}{b}\right)^2\eta_{yj-1}\tau}\right)-$$

$$\Theta_3^f\left(\frac{\pi(y+y_{01i,j-1})}{2b},\ e^{-\left(\frac{\pi}{b}\right)^2\eta_{yj-1}\tau}\right)--$$

$$\Theta_3^f\left(\frac{\pi(y-y_{02i,j-1})}{2b},\ e^{-\left(\frac{\pi}{b}\right)^2\eta_{yj-1}\tau}\right)+$$

$$\Theta_3^f\left(\frac{\pi(y+y_{02i,j-1})}{2b},\ e^{-\left(\frac{\pi}{b}\right)^2\eta_{yj-1}\tau}\right)\Bigg\}\times\times$$

$$\Bigg\{\Theta_3\left(\frac{\pi(d_j-z_{0i,j-1})}{2(d_j-d_{j-1})},\ e^{-\left(\frac{\pi}{d_j-d_{j-1}}\right)^2\eta_{zj-1}\tau}\right)++$$

$$\Theta_3\left(\frac{\pi(d_j+z_{0i,j-1}-2d_{j-1})}{2(d_j-d_{j-1})},\ e^{-\left(\frac{\pi}{d_j-d_{j-1}}\right)^2\eta_{zj-1}\tau}\right)\Bigg\}d\tau++$$

$$\frac{1}{2(\phi c_t)_{j-1}a}\sum_{i=L_r+1}^{M_r}U(t-t_{0i,j-1})\int_0^{t-t_{0i,j-1}}q_{ij-1}(t-t_{0i,j-1}-\tau)\times\times$$

$$\Bigg\{\Theta_3\left(\frac{\pi(x-x_{0i,j-1})}{2a},\ e^{-\left(\frac{\pi}{a}\right)^2\eta_{xj-1}\tau}\right)+$$

$$\Theta_3\left(\frac{\pi(x+x_{0i,j-1})}{2a},\ e^{-\left(\frac{\pi}{a}\right)^2\eta_{xj-1}\tau}\right)\Bigg\}\times\times$$

$$\Bigg\{\Theta_3^f\left(\frac{\pi(y-y_{01i,j-1})}{2b},\ e^{-\left(\frac{\pi}{b}\right)^2\eta_{yj-1}\tau}\right)-$$

$$\Theta_3^f\left(\frac{\pi(y+y_{01i,j-1})}{2b},\ e^{-\left(\frac{\pi}{b}\right)^2\eta_{yj-1}\tau}\right)--$$

$$\Theta_3^f\left(\frac{\pi(y-y_{02i,j-1})}{2b},\ e^{-\left(\frac{\pi}{b}\right)^2\eta_{yj-1}\tau}\right)+$$

$$\Theta_3^f\left(\frac{\pi(y+y_{02i,j-1})}{2b},\ e^{-\left(\frac{\pi}{b}\right)^2\eta_{yj-1}\tau}\right)\Bigg\}\times\times$$

-continued $$\left\{\Theta_3^f\left(\frac{\pi(d_j - z_{01i,j-1})}{2(d_j - d_{j-1})}, e^{-\left(\frac{\pi}{d_j - d_{j-1}}\right)^2 \eta_{zj-1}\tau}\right) - -\right.$$

$$\Theta_3^f\left(\frac{\pi(d_j + z_{01i,j-1} - 2d_{j-1})}{2(d_j - d_{j-1})}, e^{-\left(\frac{\pi}{d_j - d_{j-1}}\right)^2 \eta_{zj-1}\tau}\right) - -$$

$$\Theta_3^f\left(\frac{\pi(d_j - z_{02i,j-1})}{2(d_j - d_{j-1})}, e^{-\left(\frac{\pi}{d_j - d_{j-1}}\right)^2 \eta_{zj-1}\tau}\right) + +$$

$$\left.\Theta_3^f\left(\frac{\pi(d_j + z_{02i,j-1} - 2d_{j-1})}{2(d_j - d_{j-1})}, e^{-\left(\frac{\pi}{d_j - d_{j-1}}\right)^2 \eta_{zj-1}\tau}\right)\right\} d\tau + +$$

$$\frac{1}{2(\phi c_t)_{j-1} b} \sum_{i=M_r+1}^{N_r} U(t - t_{0i,j-1}) \int_0^{t - t_{0i,j-1}} q_{i,j-1}(t - t_{0i,j-1} - \tau) \times \times$$

$$\left\{\Theta_3^f\left(\frac{\pi(x - x_{01i,j-1})}{2a}, e^{-\left(\frac{\pi}{a}\right)^2 \eta_{xj-1}\tau}\right) - \right.$$

$$\Theta_3^f\left(\frac{\pi(x + x_{01i,j-1})}{2a}, e^{-\left(\frac{\pi}{a}\right)^2 \eta_{xj-1}\tau}\right) - -$$

$$\Theta_3^f\left(\frac{\pi(x - x_{02i,j-1})}{2a}, e^{-\left(\frac{\pi}{a}\right)^2 \eta_{xj-1}\tau}\right) +$$

$$\left.\Theta_3^f\left(\frac{\pi(x + x_{02i,j-1})}{2a}, e^{-\left(\frac{\pi}{a}\right)^2 \eta_{xj-1}\tau}\right)\right\} \times \times$$

$$\left\{\Theta_3\left(\frac{\pi(y - y_{0i,j-1})}{2b}, e^{-\left(\frac{\pi}{b}\right)^2 \eta_{yj-1}\tau}\right) + \right.$$

$$\left.\Theta_3\left(\frac{\pi(y + y_{0i,j-1})}{2b}, e^{-\left(\frac{\pi}{b}\right)^2 \eta_{yj-1}\tau}\right)\right\} \times \times$$

$$\left\{\Theta_3^f\left(\frac{\pi(d_j - z_{01i,j-1})}{2(d_j - d_{j-1})}, e^{-\left(\frac{\pi}{d_j - d_{j-1}}\right)^2 \eta_{zj-1}\tau}\right) - -\right.$$

$$\Theta_3^f\left(\frac{\pi(d_j + z_{01i,j-1} - 2d_{j-1})}{2(d_j - d_{j-1})}, e^{-\left(\frac{\pi}{d_j - d_{j-1}}\right)^2 \eta_{zj-1}\tau}\right) - -$$

$$\Theta_3^f\left(\frac{\pi(d_j - z_{02i,j-1})}{2(d_j - d_{j-1})}, e^{-\left(\frac{\pi}{d_j - d_{j-1}}\right)^2 \eta_{zj-1}\tau}\right) + +$$

$$\Theta_3^f\left(\frac{\pi(d_j + z_{02i,j-1} - 2d_{j-1})}{2(d_j - d_{j-1})}, e^{-\left(\frac{\pi}{d_j - d_{j-1}}\right)^2 \eta_{zj-1}\tau}\right) d\tau + +$$

$$\frac{1}{4(\phi c_t)_{j-1} ab(d_j - d_{j-1})} \int_0^a \int_0^b \int_0^{(d_j - d_{j-1})} \left[\psi_{0yzj-1}(v, w, t)\Theta_3\left(\frac{\pi x}{2a}, \right.\right.$$

$$\left.\left. e^{-\left(\frac{\pi}{a}\right)^2 \eta_{xj-1}(t-\tau)}\right) - -\psi_{ayzj-1}(v, w, \tau)\Theta_4\left(\frac{\pi x}{2a}, e^{-\left(\frac{\pi}{a}\right)^2 \eta_{xj-1}(t-\tau)}\right)\right] \times \times$$

$$\left[\Theta_3\left\{\frac{\pi(y - v)}{2b}, e^{-\left(\frac{\pi}{b}\right)^2 \eta_{yj-1}(t-\tau)}\right\} + \right.$$

$$\left.\Theta_3\left\{\frac{\pi(y + v)}{2b}, e^{-\left(\frac{\pi}{b}\right)^2 \eta_{yj-1}(t-\tau)}\right\}\right] \times \times$$

$$\left[\Theta_3\left\{\frac{\pi(d_j - d_{j-1} - w)}{2(d_j - d_{j-1})}, e^{-\left(\frac{\pi}{d_j - d_{j-1}}\right)^2 \eta_{zj-1}(t-\tau)}\right\} + +\right.$$

$$\left.\Theta_3\left\{\frac{\pi(d_j - d_{j-1} + w)}{2(d_j - d_{j-1})}, e^{-\left(\frac{\pi}{d_j - d_{j-1}}\right)^2 \eta_{zj-1}(t-\tau)}\right\}\right] dv\, dw\, d\tau + +$$

$$\frac{1}{4(\phi c_t)_{j-1} ab(d_j - d_{j-1})} \int_0^b \int_0^a \int_0^{d_j - d_{j-1}} \left[\psi_{x0zj-1}(u, w, \tau)\Theta_3\left(\frac{\pi y}{2b}, \right.\right.$$

$$\left.\left. e^{-\left(\frac{\pi}{b}\right)^2 \eta_{yj-1}(t-\tau)}\right) - -\psi_{xbzj-1}(u, w, \tau)\Theta_4\left(\frac{\pi y}{2b}, e^{-\left(\frac{\pi}{b}\right)^2 \eta_{yj-1}(t-\tau)}\right)\right] \times \times$$

-continued $$\left[\Theta_3\left\{\frac{\pi(x - u)}{2a}, e^{-\left(\frac{\pi}{a}\right)^2 \eta_{xj-1}(t-\tau)}\right\} + \right.$$

$$\left.\Theta_3\left\{\frac{\pi(x + u)}{2a}, e^{-\left(\frac{\pi}{a}\right)^2 \eta_{xj-1}(t-\tau)}\right\}\right] \times \times \left[\Theta_3\left\{\frac{\pi(d_j - d_{j-1} - w)}{2(d_j - d_{j-1})}, \right.\right.$$

$$\left.\left. e^{-\left(\frac{\pi}{d_j - d_{j-1}}\right)^2 \eta_{zj-1}(t-\tau)}\right\} + +\Theta_3\left\{\frac{\pi(d_j - d_{j-1} + w)}{2(d_j - d_{j-1})}, \right.$$

$$\left.\left. e^{-\left(\frac{\pi}{d_j - d_{j-1}}\right)^2 \eta_{zj-1}(t-\tau)}\right\}\right] du\, dw\, d\tau + + \frac{1}{8ab(d_j - d_{j-1})} \times \times$$

$$\int_0^{d_j - d_{j-1}} \int_0^b \int_0^a \varphi(u, v, w + d_{j-1})\left[\Theta_3\left(\frac{\pi(x - u)}{2a}, \right.\right.$$

$$\left.\left. e^{-\left(\frac{\pi}{a}\right)^2 \eta_{xj-1} t}\right) + \Theta_3\left(\frac{\pi(x + u)}{2a}, e^{-\left(\frac{\pi}{a}\right)^2 \eta_{xj-1} t}\right)\right] \times \times \left[\Theta_3\left(\frac{\pi(y - v)}{2b}, \right.\right.$$

$$\left.\left. e^{-\left(\frac{\pi}{b}\right)^2 \eta_{yj-1} t}\right) + \Theta_3\left(\frac{\pi(y + v)}{2b}, e^{-\left(\frac{\pi}{b}\right)^2 \eta_{yj-1} t}\right)\right] \times \times$$

$$\left[\Theta_3\left(\frac{\pi(d_j - d_{j-1} - w)}{2(d_j - d_{j-1})}, e^{-\left(\frac{\pi}{d_j - d_{j-1}}\right)^2 \eta_{zj-1} t}\right) + +\right.$$

$$\left.\Theta_3\left(\frac{\pi(d_j - d_{j-1} + w)}{2(d_j - d_{j-1})}, e^{-\left(\frac{\pi}{d_{j+1} - d_j}\right)^2 \eta_{zj-1} t}\right)\right] du\, dv\, dw - -$$

$$\frac{1}{2(\phi c_t)_j ab} \sum_{i=1}^{L_l} U(t - t_{0i,j}) \int_0^{t - t_{0i,j}} q_{i,j}(t - t_{0i,j} - \tau) \times \times$$

$$\left\{\Theta_3\left(\frac{\pi(x - x_{0i,j})}{2a}, e^{-\left(\frac{\pi}{a}\right)^2 \eta_{xj}\tau}\right) + \Theta_3\left(\frac{\pi(x + x_{0i,j})}{2a}, e^{-\left(\frac{\pi}{a}\right)^2 \eta_{xj}\tau}\right)\right\} \times \times$$

$$\left\{\Theta_3\left(\frac{\pi(y - y_{0i,j})}{2b}, e^{-\left(\frac{\pi}{b}\right)^2 \eta_{yj}\tau}\right) + \Theta_3\left(\frac{\pi(y + y_{0i,j})}{2b}, e^{-\left(\frac{\pi}{b}\right)^2 \eta_{yj}\tau}\right)\right\} \times \times$$

$$\left\{\Theta_3^f\left(\frac{\pi(d_j - z_{01i,j})}{2(d_{j+1} - d_j)}, e^{-\left(\frac{\pi}{d_{j+1} - d_j}\right)^2 \eta_{zj}\tau}\right) - \right.$$

$$\left.\Theta_3^f\left(\frac{\pi(d_j - z_{02i,j})}{2(d_{j+1} - d_j)}, e^{-\left(\frac{\pi}{d_{j+1} - d_j}\right)^2 \eta_{zj}\tau}\right)\right\} d\tau - -\frac{1}{2(\phi c_t)_j b(d_{j+1} - d_j)} \times \times$$

$$\sum_{i=L_l+1}^{M_l} U(t - t_{0i,j}) \int_0^{t - t_{0i,j}} q_{i,j}(t - t_{0i,j} - \tau)\Theta_3\left(\frac{\pi(d_j - z_{0ij})}{2(d_{j+1} - d_j)}, \right.$$

$$\left. e^{-\left(\frac{\pi}{d_{j+1} - d_j}\right)^2 \eta_{zj}\tau}\right) \times \times$$

$$\left\{\Theta_3\left(\frac{\pi(y - y_{0i,j})}{2b}, e^{-\left(\frac{\pi}{b}\right)^2 \eta_{yj}\tau}\right) + \Theta_3\left(\frac{\pi(y + y_{0i,j})}{2b}, e^{-\left(\frac{\pi}{b}\right)^2 \eta_{yj}\tau}\right)\right\} \times \times$$

$$\left\{\Theta_3^f\left(\frac{\pi(x - x_{01i,j})}{2a}, e^{-\left(\frac{\pi}{a}\right)^2 \eta_{xj}\tau}\right) - \Theta_3^f\left(\frac{\pi(x + x_{01i,j})}{2a}, e^{-\left(\frac{\pi}{a}\right)^2 \eta_{xj}\tau}\right) - -\right.$$

$$\left.\Theta_3^f\left(\frac{\pi(x - x_{01i,j})}{2a}, e^{-\left(\frac{\pi}{a}\right)^2 \eta_{xj}\tau}\right) + \Theta_3^f\left(\frac{\pi(x + x_{02i,j})}{2a}, e^{-\left(\frac{\pi}{a}\right)^2 \eta_{xj}\tau}\right)\right\} d\tau - -$$

$$\frac{1}{2(\phi c_t)_j a(d_{j+1} - d_j)} \times \times$$

$$\sum_{i=M_{l+1}}^{N_l} U(t - t_{0i,j}) \int_0^{t - t_{0i,j}} q_{i,j}(t - t_{0i,j} - \tau)\Theta_3\left(\frac{\pi(d_j - z_{0i,j})}{2(d_{j+1} - d_j)}, \right.$$

$$\left. e^{-\left(\frac{\pi}{d_{j+1} - d_j}\right)^2 \eta_{zj}\tau}\right) \times \times \left\{\Theta_3\left(\frac{\pi(x - x_{0i,j})}{2a}, e^{-\left(\frac{\pi}{a}\right)^2 \eta_{xj}\tau}\right) + \right.$$

$$\left.\Theta_3\left(\frac{\pi(x + x_{0i,j})}{2a}, e^{-\left(\frac{\pi}{a}\right)^2 \eta_{xj}\tau}\right)\right\} \times \times \left\{\Theta_3^f\left(\frac{\pi(y - y_{0i,j})}{2b}, e^{-\left(\frac{\pi}{b}\right)^2 \eta_{yj}\tau}\right) - \right.$$

-continued $$\Theta_3^{\int}\left(\frac{\pi(y+y_{01\iota j})}{2b}, e^{-\left(\frac{\pi}{b}\right)^2\eta_{yj}\tau}\right)-\Theta_3^{\int}\left(\frac{\pi(y-y_{02\iota j})}{2b}, e^{-\left(\frac{\pi}{b}\right)^2\eta_{yj}\tau}\right)+$$

$$\Theta_3^{\int}\left(\frac{\pi(y+y_{02\iota j})}{2b}, e^{-\left(\frac{\pi}{b}\right)^2\eta_{yj}\tau}\right)\Big\}d\tau--\frac{1}{4(\phi c_t)_j ab(d_{j+1}-d_j)}$$

$$\sum_{\iota=N_l+1}^{N_d} U(t-t_{0\iota j})\sin\vartheta_{0\iota j}\int_0^{t-t_{0\iota j}} q_{\iota j}(t-t_{0\iota j}-\tau)\times\times$$

$$\int_{z_{01\iota j}}^{z_{02\iota j}}\Big[\Big\{\Theta_3\Big(\frac{\pi}{2a}\{x-(z_{0\iota j}-\gamma_{0\iota j})\cot\vartheta_{0\iota j}\cos\theta_{0\iota j}\}, e^{-\left(\frac{\pi}{a}\right)^2\eta_{xj}\tau}\Big)++$$

$$\Theta_3\Big(\frac{\pi}{2a}\{x+(z_{0\iota j}-\gamma_{0\iota j})\cot\vartheta_{0\iota j}\cos\theta_{0\iota j}\}, e^{-\left(\frac{\pi}{a}\right)^2\eta_{xj}\tau}\Big)\Big\}\times\times$$

$$\Big\{\Theta_3\Big(\frac{\pi}{2b}\{y-(z_{0\iota j}-\gamma_{0\iota j})\cot\vartheta_{0\iota j}\sin\theta_{0\iota j}\}, e^{-\left(\frac{\pi}{b}\right)^2\eta_{yj}\tau}\Big)++$$

$$\Theta_3\Big(\frac{\pi}{2b}\{y+(z_{0\iota j}-\gamma_{0\iota j})\cot\vartheta_{0\iota j}\sin\theta_{0\iota j}\}, e^{-\left(\frac{\pi}{b}\right)^2\eta_{yj}\tau}\Big)\Big\}\times\times$$

$$\Theta_3\left(\frac{\pi(d_j-z_{0\iota j})}{2(d_{j+1}-d_j)}, e^{-\left(\frac{\pi}{d_{j+1}-d_j}\right)^2\eta_{yj}\tau}\right)\Big]dz_{0\iota j}d\tau--$$

$$\frac{1}{(\phi c_t)_j(d_{j+1}-d_j)}\sum_{\iota=N_d+1}^{L_r} U(t-t_{0\iota j})\int_0^{t-t_{0\iota j}} q_{\iota j}(t-$$

$$t_{0\iota j}-\tau)\Theta_3\left(\frac{\pi(d_j-z_{0\iota j})}{2(d_{j+1}-d_j)}, e^{-\left(\frac{\pi}{d_{j+1}-d_j}\right)^2\eta_{zj}\tau}\right)\times\times$$

$$\Big\{\Theta_3^{\int}\left(\frac{\pi(x-x_{01\iota j})}{2a}, e^{-\left(\frac{\pi}{a}\right)^2\eta_{xj}\tau}\right)-\Theta_3^{\int}\left(\frac{\pi(x+x_{01\iota j})}{2a}, e^{-\left(\frac{\pi}{a}\right)^2\eta_{xj}\tau}\right)--$$

$$\Theta_3^{\int}\left(\frac{\pi(x-x_{02\iota j})}{2a}, e^{-\left(\frac{\pi}{a}\right)^2\eta_{xj}\tau}\right)+\Theta_3^{\int}\left(\frac{\pi(x+x_{02\iota j})}{2a}, e^{-\left(\frac{\pi}{a}\right)^2\eta_{xj}\tau}\right)\Big\}\times\times$$

$$\Big\{\Theta_3^{\int}\left(\frac{\pi(x-y_{01\iota j})}{2b}, e^{-\left(\frac{\pi}{b}\right)^2\eta_{yj}\tau}\right)-\Theta_3^{\int}\left(\frac{\pi(y+y_{01\iota j})}{2b}, e^{-\left(\frac{\pi}{b}\right)^2\eta_{yj}\tau}\right)--$$

$$\Theta_3^{\int}\left(\frac{\pi(y-y_{02\iota j})}{2b}, e^{-\left(\frac{\pi}{b}\right)^2\eta_{yj}\tau}\right)+\Theta_3^{\int}\left(\frac{\pi(y+y_{02\iota j})}{2b}, e^{-\left(\frac{\pi}{b}\right)^2\eta_{yj}\tau}\right)\Big\}d\tau--$$

$$\frac{1}{(\phi c_t)_j a}\sum_{\iota=L_r+1}^{M_r} U(t-t_{0\iota j})\int_0^{t-t_{0\iota j}} q_{\iota j}(t-t_{0\iota j}-\tau)\times\times$$

$$\Big\{\Theta_3\left(\frac{\pi(x-x_{0\iota j})}{2a}, e^{-\left(\frac{\pi}{a}\right)^2\eta_{xj}\tau}\right)+\Theta_3\left(\frac{\pi(x+x_{0\iota j})}{2a}, e^{-\left(\frac{\pi}{a}\right)^2\eta_{xj}\tau}\right)\Big\}\times\times$$

$$\Big\{\Theta_3^{\int}\left(\frac{\pi(y-y_{01\iota j})}{2b}, e^{-\left(\frac{\pi}{b}\right)^2\eta_{yj}\tau}\right)-\Theta_3^{\int}\left(\frac{\pi(y+y_{01\iota j})}{2b}, e^{-\left(\frac{\pi}{b}\right)^2\eta_{yj}\tau}\right)--$$

$$\Theta_3^{\int}\left(\frac{\pi(y-y_{02\iota j})}{2b}, e^{-\left(\frac{\pi}{b}\right)^2\eta_{yj}\tau}\right)+\Theta_3^{\int}\left(\frac{\pi(y+y_{02\iota j})}{2b}, e^{-\left(\frac{\pi}{b}\right)^2\eta_{yj}\tau}\right)\Big\}\times\times$$

$$\Big\{\Theta_3^{\int}\left(\frac{\pi(d_j-z_{01\iota j})}{2(d_{j+1}-d_j)}, e^{-\left(\frac{\pi}{d_{j+1}-d_j}\right)^2\eta_{zj}\tau}\right)-$$

$$\Theta_3^{\int}\left(\frac{\pi(d_j-z_{02\iota j})}{2(d_{j+1}-d_j)}, e^{-\left(\frac{\pi}{d_{j+1}-d_j}\right)^2\eta_{zj}\tau}\right)\Big\}d\tau--$$

$$\frac{1}{(\phi c_t)_j b}\sum_{\iota=M_r+1}^{N_r} U(t-t_{0\iota j})\int_0^{t-t_{0\iota j}} q_{\iota j}(t-t_{0\iota j}-\tau)\times\times$$

$$\Big\{\Theta_3^{\int}\left(\frac{\pi(x-x_{01\iota j})}{2a}, e^{-\left(\frac{\pi}{a}\right)^2\eta_{xj}\tau}\right)-\Theta_3^{\int}\left(\frac{\pi(x+x_{01\iota j})}{2a}, e^{-\left(\frac{\pi}{a}\right)^2\eta_{xj}\tau}\right)--$$

$$\Theta_3^{\int}\left(\frac{\pi(x-x_{02\iota j})}{2a}, e^{-\left(\frac{\pi}{a}\right)^2\eta_{xj}\tau}\right)+\Theta_3^{\int}\left(\frac{\pi(x+x_{02\iota j})}{2a}, e^{-\left(\frac{\pi}{a}\right)^2\eta_{xj}\tau}\right)\Big\}\times\times$$

-continued $$\Big\{\Theta_3\left(\frac{\pi(y-y_{0\iota j})}{2b}, e^{-\left(\frac{\pi}{b}\right)^2\eta_{yj}\tau}\right)+\Theta_3\left(\frac{\pi(y+y_{0\iota j})}{2b}, e^{-\left(\frac{\pi}{b}\right)^2\eta_{yj}\tau}\right)\Big\}\times\times$$

$$\Big\{\Theta_3^{\int}\left(\frac{\pi(d_j-z_{01\iota j})}{2(d_{j+1}-d_j)}, e^{-\left(\frac{\pi}{d_{j+1}-d_j}\right)^2\eta_{zj}\tau}\right)-$$

$$\Theta_3^{\int}\left(\frac{\pi(d_j-z_{02\iota j})}{2(d_{j+1}-d_j)}, e^{-\left(\frac{\pi}{d_{j+1}-d_j}\right)^2\eta_{zj}\tau}\right)\Big\}d\tau--$$

$$\frac{1}{2(\phi c_t)_j ab(d_{j+1}-d_j)}$$

$$\int_0^t\int_0^b\int_0^{d_{j+1}-d_j}\Big[\psi_{0yzj}(v,w,\tau)\Theta_3\Big(\frac{\pi x}{2a}, e^{-\left(\frac{\pi}{a}\right)^2\eta_{xj(t-\tau)}}\Big)--$$

$$\psi_{ayzj}(v,w,\tau)\Theta_4\Big(\frac{\pi x}{2a}, e^{-\left(\frac{\pi}{a}\right)^2\eta_{xj(t-\tau)}}\Big)\Big]$$

$$\Theta_3\left(\frac{\pi w}{2(d_{j+1}-d_j)}, e^{-\left(\frac{\pi}{d_{j+1}-d_j}\right)^2\eta_{zj(t-\tau)}}\right)\times\times$$

$$\Big[\Theta_3\Big\{\frac{\pi(y-v)}{2b}, e^{-\left(\frac{\pi}{b}\right)^2\eta_{yj(t-\tau)}}\Big\}+$$

$$\Theta_3\Big\{\frac{\pi(y+v)}{2b}, e^{-\left(\frac{\pi}{b}\right)^2\eta_{yj(t-\tau)}}\Big\}\Big]dv\,dw\,d\tau--$$

$$\frac{1}{2(\phi c_t)_j ab(d_{j+1}-d_j)}$$

$$\int_0^t\int_0^a\int_0^{d_{j+1}-d_j}\Big[\psi_{x0zj}(u,w,\tau)\Theta_3\Big(\frac{\pi x}{2b}, e^{-\left(\frac{\pi}{b}\right)^2\eta_{yj(t-\tau)}}\Big)--$$

$$\psi_{xbzj}(u,w,\tau)\Theta_4\Big(\frac{\pi y}{2b}, e^{-\left(\frac{\pi}{b}\right)^2\eta_{yj(t-\tau)}}\Big)\Big]$$

$$\Theta_3\left(\frac{\pi w}{2(d_{j+1}-d_j)}, e^{-\left(\frac{\pi}{d_{j+1}-d_j}\right)^2\eta_{zj(t-\tau)}}\right)\times\times$$

$$\Big[\Theta_3\Big\{\frac{\pi(x-u)}{2a}, e^{-\left(\frac{\pi}{a}\right)^2\eta_{xj(t-\tau)}}\Big\}+$$

$$\Theta_3\Big\{\frac{\pi(x+u)}{2a}, e^{-\left(\frac{\pi}{a}\right)^2\eta_{xj(t-\tau)}}\Big\}\Big]du\,dw\,d\tau--$$

$$\frac{1}{4ab(d_{j+1}-d_j)}\int_0^{d_{j+1}-d_j}\int_0^b\int_0^a\varphi_j(u,v,w+d_j)$$

$$\Theta_3\left(\frac{\pi w}{2(d_{j+1}-d_j)}, e^{-\left(\frac{\pi}{d_{j+1}-d_j}\right)^2\eta_{zj(t-\tau)}}\right)\times\times$$

$$\Big[\Theta_3\Big(\frac{\pi(x-u)}{2a}, e^{-\left(\frac{\pi}{a}\right)^2\eta_{xj^t}}\Big)+\Theta_3\Big(\frac{\pi(x+u)}{2a}, e^{-\left(\frac{\pi}{a}\right)^2\eta_{xj^t}}\Big)\Big]\times\times$$

$$\Big[\Theta_3\Big(\frac{\pi(y-v)}{2b}, e^{-\left(\frac{\pi}{b}\right)^2\eta_{yj^t}}\Big)+\Theta_3\Big(\frac{\pi(y+v)}{2b}, e^{-\left(\frac{\pi}{b}\right)^2\eta_{yj^t}}\Big)\Big]du\,dv\,dw$$

The spatial average pressure response of the line $[z_{02\diamond j}-z_{01\diamond j}]$, $\iota=\diamond$, $1\leqq\diamond\leqq L_l$ is given by.

$$p_j = \tag{0.12}$$

$$\frac{(d_{j+1}-d_j)}{2(\phi c_t)_j ab(z_{02\diamond j}-z_{01\diamond j})}\sum_{\iota=1}^{L_l} U(t-t_{0\iota j})\int_0^{t-t_{0\iota j}} q_{\iota j}(t-t_{0\iota j}-\tau)\times\times$$

-continued $$\left\{\Theta_3\left(\frac{\pi(x-x_{0\iota j})}{2a}, e^{-\left(\frac{\pi}{a}\right)^2\eta_{xj}\tau}\right)+\Theta_3\left(\frac{\pi(x+x_{0\iota j})}{2a}, e^{-\left(\frac{\pi}{a}\right)^2\eta_{xj}\tau}\right)\right\}\times\times\left\{\Theta_3\left(\frac{\pi(y-y_{0\iota j})}{2b}, e^{-\left(\frac{\pi}{b}\right)^2\eta_{yj}\tau}\right)+\Theta_3\left(\frac{\pi(y+y_{0\iota j})}{2b}, e^{-\left(\frac{\pi}{b}\right)^2\eta_{yj}\tau}\right)\right\}\times\times$$

$$\left\{\Theta_3\int\left(\frac{\pi(z_{02\diamond j}-z_{01\iota j})}{2(d_{j+1}-d_j)}, e^{-\left(\frac{\pi}{d_{j+1}-d_j}\right)^2\eta_{zj}\tau}\right)-\Theta_3\int\left(\frac{\pi(z_{01\diamond j}-z_{01\iota j})}{2(d_{j+1}-d_j)}, e^{-\left(\frac{\pi}{d_{j+1}-d_j}\right)^2\eta_{zj}\tau}\right)--\Theta_3\int\left(\frac{\pi(z_{02\diamond j}+z_{01\iota j}-2d_j)}{2(d_{j+1}-d_j)}, e^{-\left(\frac{\pi}{d_{j+1}-d_j}\right)^2\eta_{zj}\tau}\right)+\Theta_3\int\left(\frac{\pi(z_{01\diamond j}+z_{01\iota j}-2d_j)}{2(d_{j+1}-d_j)}, e^{-\left(\frac{\pi}{d_{j+1}-d_j}\right)^2\eta_{zj}\tau}\right)--\Theta_3\int\left(\frac{\pi(z_{02\diamond j}-z_{02\iota j})}{2(d_{j+1}-d_j)}, e^{-\left(\frac{\pi}{d_{j+1}-d_j}\right)^2\eta_{zj}\tau}\right)+\Theta_3\int\left(\frac{\pi(z_{02\diamond j}-z_{01\iota j})}{2(d_{j+1}-d_j)}, e^{-\left(\frac{\pi}{d_{j+1}-d_j}\right)^2\eta_{zj}\tau}\right)++\Theta_3\int\left(\frac{\pi(z_{02\diamond j}+z_{02\iota j}-2d_j)}{2(d_{j+1}-d_j)}, e^{-\left(\frac{\pi}{d_{j+1}-d_j}\right)^2\eta_{zj}\tau}\right)-\Theta_3\int\left(\frac{\pi(z_{01\diamond j}+z_{02\iota j}-2d_j)}{2(d_{j+1}-d_j)}, e^{-\left(\frac{\pi}{d_{j+1}-d_j}\right)^2\eta_{zj}\tau}\right)\right\}d\tau+$$

$$+\frac{1}{2(\phi c_t)_j b(z_{02\diamond j}-z_{01\diamond j})}\sum_{\iota=L_{\iota+1}}^{M_l}U(t-t_{0\iota j})\int_0^{t-t_{0\iota j}}q_{\iota j}(t-t_{0\iota j}-\tau)\times\times$$

$$\left\{\Theta_3\left(\frac{\pi(y-y_{0\iota j})}{2b}, e^{-\left(\frac{\pi}{b}\right)^2\eta_{yj}\tau}\right)+\Theta_3\left(\frac{\pi(y+y_{0\iota j})}{2b}, e^{-\left(\frac{\pi}{b}\right)^2\eta_{yj}\tau}\right)\right\}\times\times$$

$$\left\{\Theta_3\int\left\{\frac{\pi(z_{02\diamond j}-z_{0\iota j})}{2(d_{j+1}-d_j)}, e^{-\left(\frac{\pi}{d_{j+1}-d_j}\right)^2\eta_{zj}(t-\tau)}\right\}-\Theta_3\int\left\{\frac{\pi(z_{01\diamond j}-z_{0\iota j})}{2(d_{j+1}-d_j)}, e^{-\left(\frac{\pi}{d_{j+1}-d_j}\right)^2\eta_{zj}(t-\tau)}\right\}++\Theta_3\int\left\{\frac{\pi(z_{02\diamond j}+z_{0\iota j}-2d_j)}{2(d_{j+1}-d_j)}, e^{-\left(\frac{\pi}{d_{j+1}-d_j}\right)^2\eta_{zj}(t-\tau)}\right\}-\Theta_3\int\left\{\frac{\pi(z_{01\diamond j}+z_{0\iota j}-2d_j)}{2(d_{j+1}-d_j)}, e^{-\left(\frac{\pi}{d_{j+1}-d_j}\right)^2\eta_{zj}(t-\tau)}\right\}\right\}\times\times$$

$$\left\{\Theta_3\int\left(\frac{\pi(x-x_{01\iota j})}{2a}, e^{-\left(\frac{\pi}{a}\right)^2\eta_{xj}\tau}\right)-\Theta_3\int\left(\frac{\pi(x+x_{01\iota j})}{2a}, e^{-\left(\frac{\pi}{a}\right)^2\eta_{xj}\tau}\right)--\Theta_3\int\left(\frac{\pi(x-x_{02\iota j})}{2a}, e^{-\left(\frac{\pi}{a}\right)^2\eta_{xj}\tau}\right)+\Theta_3\int\left(\frac{\pi(x+x_{02\iota j})}{2a}, e^{-\left(\frac{\pi}{a}\right)^2\eta_{xj}\tau}\right)\right\}d\tau+$$

$$+\frac{1}{2(\phi c_t)_j a(z_{02\diamond j}-z_{01\diamond j})}\sum_{\iota=M_l+1}^{N_l}U(t-t_{0\iota j})\int_0^{t-t_{0\iota j}}q_{\iota j}(t-t_{0\iota j}-\tau)\times\times$$

$$\left\{\Theta_3\left(\frac{\pi(x-x_{0\iota j})}{2a}, e^{-\left(\frac{\pi}{a}\right)^2\eta_{xj}\tau}\right)+\Theta_3\left(\frac{\pi(x+x_{0\iota j})}{2a}, e^{-\left(\frac{\pi}{a}\right)^2\eta_{xj}\tau}\right)\right\}\times\times$$

-continued $$\left\{\Theta_3\int\left\{\frac{\pi(z_{02\diamond j}-z_{0\iota j})}{2(d_{j+1}-d_j)}, e^{-\left(\frac{\pi}{d_{j+1}-d_j}\right)^2\eta_{zj}(t-\tau)}\right\}-\Theta_3\int\left\{\frac{\pi(z_{01\diamond j}-z_{0\iota j})}{2(d_{j+1}-d_j)}, e^{-\left(\frac{\pi}{d_{j+1}-d_j}\right)^2\eta_{zj}(t-\tau)}\right\}++\Theta_3\int\left\{\frac{\pi(z_{02\diamond j}+z_{0\iota j}-2d_j)}{2(d_{j+1}-d_j)}, e^{-\left(\frac{\pi}{d_{j+1}-d_j}\right)^2\eta_{zj}(t-\tau)}\right\}-\Theta_3\int\left\{\frac{\pi(z_{01\diamond j}+z_{0\iota j}-2d_j)}{2(d_{j+1}-d_j)}, e^{-\left(\frac{\pi}{d_{j+1}-d_j}\right)^2\eta_{zj}(t-\tau)}\right\}\right\}\times$$

$$\times\left\{\Theta_3\int\left(\frac{\pi(y-y_{01\iota j})}{2b}, e^{-\left(\frac{\pi}{b}\right)^2\eta_{yj}\tau}\right)-\Theta_3\int\left(\frac{\pi(y+y_{01\iota j})}{2b}, e^{-\left(\frac{\pi}{b}\right)^2\eta_{yj}\tau}\right)--\Theta_3\int\left(\frac{\pi(y-y_{02\iota j})}{2b}, e^{-\left(\frac{\pi}{b}\right)^2\eta_{yj}\tau}\right)+\Theta_3\int\left(\frac{\pi(y+y_{02\iota j})}{2b}, e^{-\left(\frac{\pi}{b}\right)^2\eta_{yj}\tau}\right)\right\}d\tau++$$

$$\frac{1}{4\pi(\phi c_t)_j ab(z_{02\diamond j}-z_{01\diamond j})}\sum_{\iota=N_l+1}^{N_d}U(t-t_{0\iota j})\sin\vartheta_{0\iota j}\times\times$$

$$\int_0^{t-t_{0\iota j}}q_j(t-t_{0\iota j}-\tau)\int_{z_{01\iota j}}^{z_{02\iota j}}$$

$$\left[\left\{\Theta_3\left(\frac{\pi}{2a}\{x-(z_{0\iota j}-\gamma_{0\iota j})\cot\vartheta_{0\iota j}\cos\theta_{0\iota j}\}, e^{-\left(\frac{\pi}{a}\right)^2\eta_{xj}\tau}\right)++\Theta_3\left(\frac{\pi}{2a}\{x+(z_{0\iota j}-\gamma_{0\iota j})\cot\vartheta_{0\iota j}\cos\theta_{0\iota j}\}, e^{-\left(\frac{\pi}{a}\right)^2\eta_{xj}\tau}\right)\right\}\times\times\right.$$

$$\left\{\Theta_3\left(\frac{\pi}{2b}\{y-(z_{0\iota j}-\gamma_{0\iota j})\cot\vartheta_{0\iota j}\sin\theta_{0\iota j}\}, e^{-\left(\frac{\pi}{b}\right)^2\eta_{yj}\tau}\right)++\Theta_3\left(\frac{\pi}{2b}\{y+(z_{0\iota j}-\gamma_{0\iota j})\cot\vartheta_{0\iota j}\sin\theta_{0\iota j}\}, e^{-\left(\frac{\pi}{b}\right)^2\eta_{yj}\tau}\right)\right\}\times\times$$

$$\left\{\Theta_3\int\left(\frac{\pi(z_{02\diamond j}-z_{0\iota j})}{2(d_{j+1}-d_j)}, e^{-\eta_{zj}\left(\frac{\pi}{d_{j+1}-d_j}\right)^2 t}\right)-\Theta_3\int\left(\frac{\pi(z_{01\diamond j}-z_{0\iota j})}{2(d_{j+1}-d_j)}, e^{-\eta_{zj}\left(\frac{\pi}{d_{j+1}-d_j}\right)^2 t}\right)++\Theta_3\int\left(\frac{\pi(z_{02\diamond j}+z_{0\iota j}-2d_j)}{2(d_{j+1}-d_j)}, e^{-\eta_{zj}\left(\frac{\pi}{d_{j+1}-d_j}\right)^2 t}\right)-\Theta_3\int\left(\frac{\pi(z_{01\diamond j}+z_{0\iota j}-2d_j)}{2(d_{j+1}-d_j)}, e^{-\eta_{zj}\left(\frac{\pi}{d_{j+1}-d_j}\right)^2 t}\right)\right\}\right]dz_{0\iota j}\,d\tau+$$

$$+\frac{1}{(\phi c_t)_j(z_{02\diamond j}-z_{01\diamond j})}\sum_{\iota=N_d+1}^{L_r}U(t-t_{0\iota j})\int_0^{t-t_{0\iota j}}q_{\iota j}(t-t_{0\iota j}-\tau)\times\times$$

$$\left\{\Theta_3\int\left(\frac{\pi(x-x_{01\iota j})}{2a}, e^{-\left(\frac{\pi}{a}\right)^2\eta_{xj}\tau}\right)-\Theta_3\int\left(\frac{\pi(x+x_{01\iota j})}{2a}, e^{-\left(\frac{\pi}{a}\right)^2\eta_{xj}\tau}\right)--\Theta_3\int\left(\frac{\pi(x-x_{02\iota j})}{2a}, e^{-\left(\frac{\pi}{a}\right)^2\eta_{xj}\tau}\right)+\Theta_3\int\left(\frac{\pi(x+x_{02\iota j})}{2a}, e^{-\left(\frac{\pi}{a}\right)^2\eta_{xj}\tau}\right)\right\}\times\times$$

$$\left\{\Theta_3\int\left(\frac{\pi(y-y_{01\iota j})}{2b}, e^{-\left(\frac{\pi}{b}\right)^2\eta_{yj}\tau}\right)-\Theta_3\int\left(\frac{\pi(y+y_{01\iota j})}{2b}, e^{-\left(\frac{\pi}{b}\right)^2\eta_{yj}\tau}\right)--\Theta_3\int\left(\frac{\pi(y-y_{02\iota j})}{2b}, e^{-\left(\frac{\pi}{b}\right)^2\eta_{yj}\tau}\right)+\Theta_3\int\left(\frac{\pi(y+y_{02\iota j})}{2b}, e^{-\left(\frac{\pi}{b}\right)^2\eta_{yj}\tau}\right)\right\}\times\times$$

$$\left\{\Theta_3\int\left(\frac{\pi(z_{02\diamond j}-z_{0\iota j})}{2(d_{j+1}-d_j)}, e^{-\left(\frac{\pi}{d_{j+1}-d_j}\right)^2\eta_{zj}(t-\tau)}\right\}-\Theta_3\int\left(\frac{\pi(z_{01\diamond j}-z_{0\iota j})}{2(d_{j+1}-d_j)}, e^{-\left(\frac{\pi}{d_{j+1}-d_j}\right)^2\eta_{zj}(t-\tau)}\right\}++$$

-continued $$\Theta_3^{\int}\left(\frac{\pi(z_{02\diamond j}+z_{0\iota j}-2d_j)}{2(d_{j+1}-d_j)},\ e^{-\left(\frac{\pi}{d_{j+1}-d_j}\right)^2\eta_{zj}(t-\tau)}\right)-$$

$$\Theta_3^{\int}\left(\frac{\pi(z_{01\diamond j}+z_{0\iota j}-2d_j)}{2(d_{j+1}-d_j)},\ e^{-\left(\frac{\pi}{d_{j+1}-d_j}\right)^2\eta_{zj}(t-\tau)}\right)\Bigg\}d\tau+$$

$$+\frac{1}{(\phi c_t)_j a(z_{02\diamond j}-z_{01\diamond j})}\sum_{\iota=L_r+1}^{M_r}U(t-t_{0\iota j})\int_0^{t-t_{0\iota j}}q_{\iota j}(t-t_{0\iota j}-\tau)\times\times$$

$$\left\{\Theta_3\left(\frac{\pi(x-x_{01\iota j})}{2a},\ e^{-\left(\frac{\pi}{a}\right)^2\eta_{xj}\tau}\right)+\Theta_3\left(\frac{\pi(x+x_{01\iota j})}{2a},\ e^{-\left(\frac{\pi}{a}\right)^2\eta_{xj}\tau}\right)\right\}\times\times$$

$$\left\{\Theta_3^{\int}\left(\frac{\pi(y-y_{01\iota j})}{2b},\ e^{-\left(\frac{\pi}{b}\right)^2\eta_{yj}\tau}\right)-\right.$$

$$\Theta_3^{\int}\left(\frac{\pi(y+y_{01\iota j})}{2b},\ e^{-\left(\frac{\pi}{b}\right)^2\eta_{yj}\tau}\right)--\Theta_3^{\int}\left(\frac{\pi(y-y_{02\iota j})}{2b},\right.$$

$$\left.e^{-\left(\frac{\pi}{b}\right)^2\eta_{yj}\tau}\right)+\Theta_3^{\int}\left(\frac{\pi(y+y_{02\iota j})}{2b},\ e^{-\left(\frac{\pi}{b}\right)^2\eta_{yj}\tau}\right)\Bigg\}\times\times$$

$$\left\{\Theta_3^{\int\int}\left(\frac{\pi(z_{02\diamond j}-z_{01\iota j})}{2(d_{j+1}-d_j)},\ e^{-\left(\frac{\pi}{d_{j+1}-d_j}\right)^2\eta_{zj}\tau}\right)-\right.$$

$$\Theta_3^{\int\int}\left(\frac{\pi(z_{01\diamond j}-z_{01\iota j})}{2(d_{j+1}-d_j)},\ e^{-\left(\frac{\pi}{d_{j+1}-d_j}\right)^2\eta_{zj}\tau}\right)--$$

$$\Theta_3^{\int\int}\left(\frac{\pi(z_{02\diamond j}+z_{01\iota j}-2d_j)}{2(d_{j+1}-d_j)},\ e^{-\left(\frac{\pi}{d_{j+1}-d_j}\right)^2\eta_{zj}\tau}\right)+$$

$$\Theta_3^{\int\int}\left(\frac{\pi(z_{01\diamond j}+z_{01\iota j}-2d_j)}{2(d_{j+1}-d_j)},\ e^{-\left(\frac{\pi}{d_{j+1}-d_j}\right)^2\eta_{zj}\tau}\right)--$$

$$\Theta_3^{\int\int}\left(\frac{\pi(z_{02\diamond j}-z_{02\iota j})}{2(d_{j+1}-d_j)},\ e^{-\left(\frac{\pi}{d_{j+1}-d_j}\right)^2\eta_{zj}\tau}\right)+$$

$$\Theta_3^{\int\int}\left(\frac{\pi(z_{02\diamond j}-z_{01\iota j})}{2(d_{j+1}-d_j)},\ e^{-\left(\frac{\pi}{d_{j+1}-d_j}\right)^2\eta_{zj}\tau}\right)++$$

$$\Theta_3^{\int\int}\left(\frac{\pi(z_{02\diamond j}+z_{02\iota j}-2d_j)}{2(d_{j+1}-d_j)},\ e^{-\left(\frac{\pi}{d_{j+1}-d_j}\right)^2\eta_{zj}\tau}\right)-$$

$$\Theta_3^{\int\int}\left(\frac{\pi(z_{01\diamond j}+z_{02\iota j}-2d_j)}{2(d_{j+1}-d_j)},\ e^{-\left(\frac{\pi}{d_{j+1}-d_j}\right)^2\eta_{zj}\tau}\right)\Bigg\}d\tau+$$

$$+\frac{1}{(\phi c_t)_j b(z_{02\diamond j}-z_{01\diamond j})}\sum_{\iota=M_r+1}^{N_r}U(t-t_{0\iota j})\int_0^{t-t_{0\iota j}}q_{\iota j}(t-t_{0\iota j}-\tau)\times\times$$

$$\left\{\Theta_3^{\int}\left(\frac{\pi(x-x_{01\iota j})}{2a},\ e^{-\left(\frac{\pi}{a}\right)^2\eta_{xj}\tau}\right)-\Theta_3^{\int}\left(\frac{\pi(x+x_{01\iota j})}{2a},\ e^{-\left(\frac{\pi}{a}\right)^2\eta_{xj}\tau}\right)--\right.$$

$$\Theta_3^{\int}\left(\frac{\pi(x-x_{02\iota j})}{2a},\ e^{-\left(\frac{\pi}{a}\right)^2\eta_{xj}\tau}\right)+$$

$$\left.\Theta_3^{\int}\left(\frac{\pi(x+x_{02\iota j})}{2a},\ e^{-\left(\frac{\pi}{a}\right)^2\eta_{xj}\tau}\right)\right\}\times\times\left\{\Theta_3\left(\frac{\pi(y-y_{0\iota j})}{2b},\right.\right.$$

$$\left.e^{-\left(\frac{\pi}{b}\right)^2\eta_{yj}\tau}\right)+\Theta_3\left(\frac{\pi(y+y_{0\iota j})}{2b},\ e^{-\left(\frac{\pi}{b}\right)^2\eta_{yj}\tau}\right)\Bigg\}\times\times$$

$$\left\{\Theta_3^{\int\int}\left(\frac{\pi(z_{02\diamond j}-z_{01\iota j})}{2(d_{j+1}-d_j)},\ e^{-\left(\frac{\pi}{d_{j+1}-d_j}\right)^2\eta_{zj}\tau}\right)-\right.$$

$$\Theta_3^{\int\int}\left(\frac{\pi(z_{01\diamond j}-z_{01\iota j})}{2(d_{j+1}-d_j)},\ e^{-\left(\frac{\pi}{d_{j+1}-d_j}\right)^2\eta_{zj}\tau}\right)--$$

-continued $$\Theta_3^{\int\int}\left(\frac{\pi(z_{02\diamond j}+z_{01\iota j}-2d_j)}{2(d_{j+1}-d_j)},\ e^{-\left(\frac{\pi}{d_{j+1}-d_j}\right)^2\eta_{zj}\tau}\right)+$$

$$\Theta_3^{\int\int}\left(\frac{\pi(z_{01\diamond j}+z_{01\iota j}-2d_j)}{2(d_{j+1}-d_j)},\ e^{-\left(\frac{\pi}{d_{j+1}-d_j}\right)^2\eta_{zj}\tau}\right)--$$

$$\Theta_3^{\int\int}\left(\frac{\pi(z_{02\diamond j}-z_{02\iota j})}{2(d_{j+1}-d_j)},\ e^{-\left(\frac{\pi}{d_{j+1}-d_j}\right)^2\eta_{zj}\tau}\right)+$$

$$\Theta_3^{\int\int}\left(\frac{\pi(z_{02\diamond j}-z_{01\iota j})}{2(d_{j+1}-d_j)},\ e^{-\left(\frac{\pi}{d_{j+1}-d_j}\right)^2\eta_{zj}\tau}\right)--$$

$$\Theta_3^{\int\int}\left(\frac{\pi(z_{02\diamond j}+z_{02\iota j}-2d_j)}{2(d_{j+1}-d_j)},\ e^{-\left(\frac{\pi}{d_{j+1}-d_j}\right)^2\eta_{zj}\tau}\right)-$$

$$\Theta_3^{\int\int}\left(\frac{\pi(z_{01\diamond j}+z_{02\iota j}-2d_j)}{2(d_{j+1}-d_j)},\ e^{-\left(\frac{\pi}{d_{j+1}-d_j}\right)^2\eta_{zj}\tau}\right)\Bigg\}d\tau+$$

$$+\frac{1}{2(\phi c_t)_j ab(z_{02\diamond j}-z_{01\diamond j})}$$

$$\int_0^t\int_0^a\int_0^b\left[\psi_j(u,v,\tau)\left\{\Theta_3^{\int}\left\{\frac{\pi(z_{02\diamond j}-d_j)}{2(d_{j+1}-d_j)},\ e^{-\left(\frac{\pi}{d_{j+1}-d_j}\right)^2\eta_{zj}(t-\tau)}\right\}--\right.\right.$$

$$\Theta_3^{\int}\left\{\frac{\pi(z_{01\diamond j}-d_j)}{2(d_{j+1}-d_j)},\ e^{-\left(\frac{\pi}{d_{j+1}-d_j}\right)^2\eta_{zj}(t-\tau)}\right\}\Bigg\}--$$

$$\psi_{j+1}(u,v,\tau)\left\{\Theta_4^{\int}\left\{\frac{\pi(z_{02\diamond j}-d_j)}{2(d_{j+1}-d_j)},\ e^{-\left(\frac{\pi}{d_{j+1}-d_j}\right)^2\eta_{zj}(t-\tau)}\right\}--\right.$$

$$\left.\left.\Theta_4^{\int}\left\{\frac{\pi(z_{01\diamond j}-d_j)}{2(d_{j+1}-d_j)},\ e^{-\left(\frac{\pi}{d_{j+1}-d_j}\right)^2\eta_{zj}(t-\tau)}\right\}\right\}\right]\times\times$$

$$\left[\Theta_3\left\{\frac{\pi(x-u)}{2a},\ e^{-\left(\frac{\pi}{a}\right)^2\eta_{xj}(t-\tau)}\right\}+\Theta_3\left\{\frac{\pi(x+u)}{2a},\ e^{-\left(\frac{\pi}{a}\right)^2\eta_{xj}(t-\tau)}\right\}\right]\times\times$$

$$\left[\Theta_3\left\{\frac{\pi(y-v)}{2b},\ e^{-\left(\frac{\pi}{b}\right)^2\eta_{yj}(t-\tau)}\right\}+\Theta_3\left\{\frac{\pi(y+v)}{2b},\ e^{-\left(\frac{\pi}{b}\right)^2\eta_{yj}(t-\tau)}\right\}\right]$$

$$du\,dv\,d\tau++\frac{1}{2(\phi c_t)_j ab(z_{02\diamond j}-z_{01\diamond j})}\times\times$$

$$\int_0^t\int_0^b\int_0^{d_{j+1}-d_j}\left\{\psi_{0yzj}(v,w,\tau)\Theta_3\left(\frac{\pi x}{2a},\ e^{-\left(\frac{\pi}{a}\right)^2\eta_{xj}(t-\tau)}\right)-\right.$$

$$\left.\psi_{ayzj}(v,w,\tau)\Theta_4\left(\frac{\pi x}{2a},\ e^{-\left(\frac{\pi}{a}\right)^2\eta_{xj}(t-\tau)}\right)\right\}\times\times$$

$$\left\{\Theta_3\left\{\frac{\pi(y-v)}{2b},\ e^{-\left(\frac{\pi}{b}\right)^2\eta_{yj}(t-\tau)}\right\}+\Theta_3\left\{\frac{\pi(y+v)}{2b},\ e^{-\left(\frac{\pi}{b}\right)^2\eta_{yj}(t-\tau)}\right\}\right\}\times\times$$

$$\left\{\Theta_3^{\int}\left\{\frac{\pi(z_{02\diamond j}-d_j-w)}{2(d_{j+1}-d_j)},\ e^{-\left(\frac{\pi}{d_{j+1}-d_j}\right)^2\eta_{zj}(t-\tau)}\right\}-\right.$$

$$\Theta_3^{\int}\left\{\frac{\pi(z_{01\diamond j}-d_j-w)}{2(d_{j+1}-d_j)},\ e^{-\left(\frac{\pi}{d_{j+1}-d_j}\right)^2\eta_{zj}(t-\tau)}\right\}+\times$$

$$\Theta_3^{\int}\left\{\frac{\pi(z_{02\diamond j}-d_j+w)}{2(d_{j+1}-d_j)},\ e^{-\left(\frac{\pi}{d_{j+1}-d_j}\right)^2\eta_{zj}(t-\tau)}\right\}-$$

$$\left.\Theta_3^{\int}\left\{\frac{\pi(z_{01\diamond j}-d_j+w)}{2(d_{j+1}-d_j)},\ e^{-\left(\frac{\pi}{d_{j+1}-d_j}\right)^2\eta_{zj}(t-\tau)}\right\}\right\}$$

$$dv\,dw\,d\tau++\frac{1}{2(\phi c_t)_j ab(z_{02\diamond j}-z_{01\diamond j})}\times$$

$$\times\int_0^t\int_0^a\int_0^{d_{j+1}-d_j}\left\{\psi_{x0zj}(u,w,\tau)\Theta_3\left(\frac{\pi y}{2b},\ e^{-\left(\frac{\pi}{b}\right)^2\eta_{yj}(t-\tau)}\right)-\right.$$

-continued $$\psi_{xbzj}(u, w, \tau)\Theta_4\left(\frac{\pi y}{2b}, e^{-\left(\frac{\pi}{b}\right)^2\eta_{yj}(t-\tau)}\right)\Big\}\times\times$$

$$\left[\Theta_3\left\{\frac{\pi(x-u)}{2a}, e^{-\left(\frac{\pi}{a}\right)^2\eta_{xj}(t-\tau)}\right\}+\Theta_3\left\{\frac{\pi(x+u)}{2a}, e^{-\left(\frac{\pi}{a}\right)^2\eta_{xj}(t-\tau)}\right\}\right]\times\times$$

$$\left\{\Theta_3^{\int}\left\{\frac{\pi(z_{02\diamond j}-d_j-w)}{2(d_{j+1}-d_j)}, e^{-\left(\frac{\pi}{d_{j+1}-d_j}\right)^2\eta_{zj}(t-\tau)}\right\}-\right.$$

$$\Theta_3^{\int}\left\{\frac{\pi(z_{01\diamond j}-d_j-w)}{2(d_{j+1}-d_j)}, e^{-\left(\frac{\pi}{d_{j+1}-d_j}\right)^2\eta_{zj}(t-\tau)}\right\}+\times$$

$$\Theta_3^{\int}\left\{\frac{\pi(z_{02\diamond j}-d_j+w)}{2(d_{j+1}-d_j)}, e^{-\left(\frac{\pi}{d_{j+1}-d_j}\right)^2\eta_{zj}(t-\tau)}\right\}-$$

$$\left.\Theta_3^{\int}\left\{\frac{\pi(z_{01\diamond j}-d_j+w)}{2(d_{j+1}-d_j)}, e^{-\left(\frac{\pi}{d_{j+1}-d_j}\right)^2\eta_{zj}(t-\tau)}\right\}\right\}$$

$$dv\,dw\,d\tau++\frac{1}{4ab(z_{02\diamond j}-z_{01\diamond j})}\times\times\int_0^{d_{j+1}-d_j}\int_0^b\int_0^a\varphi_j(u, v, w+d_j)$$

$$\left[\left\{\Theta_3\left(\frac{\pi(x-u)}{2a}, e^{-\left(\frac{\pi}{a}\right)^2\eta_{xj}t}\right)+\Theta_3\left(\frac{\pi(x+u)}{2a}, e^{-\left(\frac{\pi}{a}\right)^2\eta_{xj}t}\right)\right\}\times\times\right.$$

$$\left\{\Theta_3\left\{\frac{\pi(y-v)}{2b}, e^{-\left(\frac{\pi}{b}\right)^2\eta_{yj}t}\right)+\Theta_3\left(\frac{\pi(y+v)}{2b}, e^{-\left(\frac{\pi}{b}\right)^2\eta_{yj}t}\right)\right\}\times\times$$

$$\left\{\Theta_3^{\int}\left\{\frac{\pi(z_{02\diamond j}-d_j-w)}{2(d_{j+1}-d_j)}, e^{-\left(\frac{\pi}{d_{j+1}-d_j}\right)^2\eta_{zj}t}\right\}-\right.$$

$$\Theta_3^{\int}\left\{\frac{\pi(z_{01\diamond j}-d_j-w)}{2(d_{j+1}-d_j)}, e^{-\left(\frac{\pi}{d_{j+1}-d_j}\right)^2\eta_{zj}t}\right\}+\times$$

$$\Theta_3^{\int}\left\{\frac{\pi(z_{02\diamond j}-d_j+w)}{2(d_{j+1}-d_j)}, e^{-\left(\frac{\pi}{d_{j+1}-d_j}\right)^2\eta_{zj}t}\right\}-$$

$$\left.\Theta_3^{\int}\left\{\frac{\pi(z_{01\diamond j}-d_j+w)}{2(d_{j+1}-d_j)}, e^{-\left(\frac{\pi}{d_{j+1}-d_j}\right)^2\eta_{zj}}\right\}\right\}du\,dv\,dw$$

The spatial average pressure response of the line $[x_{02\diamond j}-x_{01\diamond j}]$, $\iota=\diamond$, $L_{l+1}\leqq\diamond\leqq M_l$ is given by.

$$p_j = \tag{0.13}$$

$$\frac{1}{2(\phi c_t)_j b(x_{02\diamond j}-x_{01\diamond j})}\sum_{\iota=1}^{L_l}U(t-t_{0\iota j})\int_0^{t-t_{0\iota j}}q_{\iota j}(t-t_{0\iota j}-\tau)\times\times$$

$$\left\{\Theta_3^{\int}\left(\frac{\pi(x_{02\diamond j}-x_{0\iota j})}{2a}, e^{-\left(\frac{\pi}{a}\right)^2\eta_{xj}\tau}\right)-\Theta_3^{\int}\left(\frac{\pi(x_{01\diamond j}-x_{0\iota j})}{2a},\right.\right.$$

$$\left.e^{-\left(\frac{\pi}{a}\right)^2\eta_{xj}\tau}\right)++\Theta_3^{\int}\left(\frac{\pi(x_{02\diamond j}+x_{0\iota j})}{2a}, e^{-\left(\frac{\pi}{a}\right)^2\eta_{xj}\tau}\right)-$$

$$\Theta_3^{\int}\left(\frac{\pi(x_{01\diamond j}+x_{0\iota j})}{2a},\right.$$

$$\left.\left.e^{-\left(\frac{\pi}{a}\right)^2\eta_{xj}\tau}\right)\right\}\times\times\left\{\Theta_3\left(\frac{\pi(y-y_{0\iota j})}{2b},\right.\right.$$

$$\left.e^{-\left(\frac{\pi}{b}\right)^2\eta_{yj}\tau}\right)+\Theta_3\left(\frac{\pi(y+y_{0\iota j})}{2b},\right.$$

$$\left.\left.e^{-\left(\frac{\pi}{b}\right)^2\eta_{yj}\tau}\right)\right\}\times\times\left\{\Theta_3^{\int}\left(\frac{\pi(z-z_{01\iota j})}{2(d_{j+1}-d_j)},\right.\right.$$

$$\left.e^{-\left(\frac{\pi}{d_{j+1}-d_j}\right)^2\eta_{zj}\tau}\right)-\Theta_3^{\int}\left(\frac{\pi(z+z_{01\iota j}-2d_j)}{2(d_{j+1}-d_j)}\right.$$

$$,$$

$$\left.e^{-\left(\frac{\pi}{d_{j+1}-d_j}\right)^2\eta_{zj}\tau}\right)--\Theta_3^{\int}\left(\frac{\pi(z-z_{02\iota j})}{2(d_{j+1}-d_j)}\right.$$

-continued $$,$$

$$\left.e^{-\left(\frac{\pi}{d_{j+1}-d_j}\right)^2\eta_{zj}\tau}\right)+\Theta_3^{\int}\left(\frac{\pi(z+z_{02\iota j}-2d_j)}{2(d_{j+1}-d_j)}, e^{-\left(\frac{\pi}{d_{j+1}-d_j}\right)^2\eta_{zj}\tau}\right)\Big\}d\tau++$$

$$\frac{a}{2(\phi c_t)_j b(d_{j+1}-d_j)(x_{02\diamond j}-x_{01\diamond j})}\sum_{\iota=L_l+1}^{M_l}$$

$$U(t-t_{0\iota j})\int_0^{t-t_{0\iota j}}q_{\iota j}(t-t_{0\iota j}-\tau)\times$$

$$\times\left\{\Theta_3\left(\frac{\pi(y-y_{0\iota j})}{2b}, e^{-\left(\frac{\pi}{b}\right)^2\eta_{yj}\tau}\right)+\right.$$

$$\left.\Theta_3\left(\frac{\pi(y+y_{0\iota j})}{2b}, e^{-\left(\frac{\pi}{b}\right)^2\eta_{yj}\tau}\right)\right\}\times\times$$

$$\left\{\Theta_3\left(\frac{\pi(z-z_{0\iota j})}{2(d_{j+1}-d_j)},\right.\right.$$

$$\left.e^{-\left(\frac{\pi}{d_{j+1}-d_j}\right)^2\eta_{zj}\tau}\right)+\Theta_3\left(\frac{\pi(z+z_{0\iota j}-2d_j)}{2(d_{j+1}-d_j)},\right.$$

$$\left.\left.e^{-\left(\frac{\pi}{d_{j+1}-d_j}\right)^2\eta_{zj}\tau}\right)\right\}\times$$

$$\times\left\{\Theta_3^{\int\int}\left(\frac{\pi(x_{02\diamond j}-x_{01\iota j})}{2a}, e^{-\left(\frac{\pi}{a}\right)^2\eta_{xj}\tau}\right)-\Theta_3^{\int\int}\left(\frac{\pi(x_{01\diamond j}-x_{01\iota j})}{2a}, e^{-\left(\frac{\pi}{a}\right)^2\eta_{xj}\tau}\right)--\right.$$

$$\Theta_3^{\int\int}\left(\frac{\pi(x_{02\diamond j}+x_{01\iota j})}{2a}, e^{-\left(\frac{\pi}{a}\right)^2\eta_{xj}\tau}\right)+$$

$$\Theta_3^{\int\int}\left(\frac{\pi(x_{01\diamond j}+x_{01\iota j})}{2a}, e^{-\left(\frac{\pi}{a}\right)^2\eta_{xj}\tau}\right)--\Theta_3^{\int\int}\left(\frac{\pi(x_{02\diamond j}-x_{02\iota j})}{2a},\right.$$

$$\left.e^{-\left(\frac{\pi}{a}\right)^2\eta_{xj}\tau}\right)+\Theta_3^{\int\int}\left(\frac{\pi(x_{01\diamond j}-x_{02\iota j})}{2a}, e^{-\left(\frac{\pi}{a}\right)^2\eta_{xj}\tau}\right)++\Theta_3^{\int\int}$$

$$\left(\frac{\pi(x_{02\diamond j}+x_{02\iota j})}{2a}, e^{-\left(\frac{\pi}{a}\right)^2\eta_{xj}\tau}\right)-\Theta_3^{\int\int}\left(\frac{\pi(x_{01\diamond j}+x_{02\iota j})}{2a},\right.$$

$$\left.\left.e^{-\left(\frac{\pi}{a}\right)^2\eta_{xj}\tau}\right)\right\}d\tau++$$

$$\frac{1}{2(\phi c_t)_j(d_{j+1}-d_j)(x_{02\diamond j}-x_{01\diamond j})}\sum_{\iota=M_l+1}^{N_l}U(t-t_{0\iota j})$$

$$\int_0^{t-t_{0\iota j}}q_{\iota j}(t-t_{0\iota j}-\tau)\times\times\left\{\Theta_3^{\int}\left(\frac{\pi(x_{02\diamond j}-x_{0\iota j})}{2a}, e^{-\left(\frac{\pi}{a}\right)^2\eta_{xj}\tau}\right)-\right.$$

$$\Theta_3^{\int}\left(\frac{\pi(x_{01\diamond j}-x_{0\iota j})}{2a}, e^{-\left(\frac{\pi}{a}\right)^2\eta_{xj}\tau}\right)++\Theta_3^{\int}\left(\frac{\pi(x_{02\diamond j}+x_{0\iota j})}{2a},\right.$$

$$\left.e^{-\left(\frac{\pi}{a}\right)^2\eta_{xj}\tau}\right)-\Theta_3^{\int}\left(\frac{\pi(x_{01\diamond j}+x_{0\iota j})}{2a}, e^{-\left(\frac{\pi}{a}\right)^2\eta_{xj}\tau}\right)\Big\}\times\times$$

$$\left\{\Theta_3\left(\frac{\pi(z-z_{0\iota j})}{2(d_{j+1}-d_j)}, e^{-\left(\frac{\pi}{d_{j+1}-d_j}\right)^2\eta_{zj}\tau}\right)+\right.$$

$$\left.\left(\Theta_3\ \frac{\pi(z+z_{0\iota j}-2d_j)}{2(d_{j+1}-d_j)}, e^{-\left(\frac{\pi}{d_{j+1}-d_j}\right)^2\eta_{zj}\tau}\right)\right\}\times$$

$$\times\left\{\Theta_3^{\int}\left(\frac{\pi(y-y_{01\iota j})}{2b}, e^{-\left(\frac{\pi}{b}\right)^2\eta_{yj}\tau}\right)-\Theta_3^{\int}\left(\frac{\pi(y+y_{01\iota j})}{2b}, e^{-\left(\frac{\pi}{b}\right)^2\eta_{yj}\tau}\right)--\right.$$

$$\left.\Theta_3^{\int}\left(\frac{\pi(y-y_{02\iota j})}{2b}, e^{-\left(\frac{\pi}{b}\right)^2\eta_{yj}\tau}\right)+\Theta_3^{\int}\left(\frac{\pi(y+y_{02\iota j})}{2b}, e^{-\left(\frac{\pi}{b}\right)^2\eta_{yj}\tau}\right)\right\}d\tau++$$

-continued $$\frac{1}{4\pi(\phi c_t)_j b(d_{j+1}-d_j)(x_{02\diamond j}-x_{01\diamond j})}\sum_{i=N_l+1}^{N_d} U(t-t_{0i,j})\sin\vartheta_{0i,j}\times\times$$

$$\int_0^{t-t_{0i,j}} q_{i,j}(t-t_{0i,j}-\tau)\Big)$$

$$\int_{z_{01i,j}}^{z_{02i,j}}\Big[\Big\{\Theta_3\Big(\frac{\pi}{2b}\{y-(z_{0i,j}-\gamma_{0i,j})\cot\vartheta_{0i,j}\cos\theta_{0i,j}\},\ e^{-\left(\frac{\pi}{b}\right)^2\eta_{yj}\tau}\Big)++$$

$$\Theta_3\Big(\frac{\pi}{2b}\{y+(z_{0i,j}-\gamma_{0i,j})\cot\vartheta_{0i,j}\cos\theta_{0i,j}\},\ e^{-\left(\frac{\pi}{b}\right)^2\eta_{yj}\tau}\Big)\Big\}\times\times$$

$$\Big\{\Theta_3^{\int}\Big(\frac{\pi}{2a}\{x_{02\diamond j}-(z_{0i,j}-\gamma_{0i,j})\cot\vartheta_{0i,j}\sin\theta_{0i,j}\},\ e^{-\left(\frac{\pi}{a}\right)^2\eta_{xj}\tau}\Big)--$$

$$\Theta_3^{\int}\Big(\frac{\pi}{2a}\{x_{01\diamond j}-(z_{0i,j}-\gamma_{0i,j})\cot\vartheta_{0i,j}\sin\theta_{0i,j}\},\ e^{-\left(\frac{\pi}{a}\right)^2\eta_{xj}\tau}\Big)++$$

$$\Theta_3^{\int}\Big(\frac{\pi}{2a}\{x_{02\diamond j}+(z_{0i,j}-\gamma_{0i,j})\cot\vartheta_{0i,j}\sin\theta_{0i,j}\},\ e^{-\left(\frac{\pi}{a}\right)^2\eta_{xj}\tau}\Big)--$$

$$\Theta_3^{\int}\Big(\frac{\pi}{2a}\{x_{01\diamond j}+(z_{0i,j}-\gamma_{0i,j})\cot\vartheta_{0i,j}\sin\theta_{0i,j}\},$$

$$e^{-\left(\frac{\pi}{a}\right)^2\eta_{xj}\tau}\Big)\Big\}\times\times\Big\{\Theta_3\Big(\frac{\pi}{2d}(z-z_{0i,j}),\ e^{-\left(\frac{\pi}{d}\right)^2\eta_{yj}\tau}\Big)+$$

$$\Theta_3\Big(\frac{\pi}{2d}(z+z_{0i,j}),\ e^{-\left(\frac{\pi}{d}\right)^2\eta_{yj}\tau}\Big)\Big\}\Big]dz_{0i,j}d\tau+$$

$$+\frac{a}{(\phi c_t)_j(d_{j+1}-d_j)(x_{02\diamond j}-x_{01\diamond j})}$$

$$\sum_{i=N_d+1}^{L_r} U(t-t_{0i,j})\int_0^{t-t_{0i,j}} q_{i,j}(t-t_{0i,j}-\tau)\times\times$$

$$\Big\{\Theta_3^{\iint}\Big(\frac{\pi(x_{02\diamond j}-x_{01i,j})}{2a},\ e^{-\left(\frac{\pi}{a}\right)^2\eta_{xj}\tau}\Big)-\Theta_3^{\iint}\Big(\frac{\pi(x_{01\diamond j}-x_{01i,j})}{2a},$$

$$e^{-\left(\frac{\pi}{a}\right)^2\eta_{xj}\tau}\Big)--\Theta_3^{\iint}\Big(\frac{\pi(x_{02\diamond j}+x_{01i,j})}{2a},\ e^{-\left(\frac{\pi}{a}\right)^2\eta_{xj}\tau}\Big)+$$

$$\Theta_3^{\iint}\Big(\frac{\pi(x_{01\diamond j}+x_{01i,j})}{2a},\ e^{-\left(\frac{\pi}{a}\right)^2\eta_{xj}\tau}\Big)--\Theta_3^{\iint}\Big(\frac{\pi(x_{02\diamond j}-x_{02i,j})}{2a},$$

$$e^{-\left(\frac{\pi}{a}\right)^2\eta_{xj}\tau}\Big)+\Theta_3^{\iint}\Big(\frac{\pi(x_{01\diamond j}-x_{02i,j})}{2a},\ e^{-\left(\frac{\pi}{a}\right)^2\eta_{xj}\tau}\Big)++$$

$$\Theta_3^{\iint}\Big(\frac{\pi(x_{02\diamond j}+x_{02i,j})}{2a},\ e^{-\left(\frac{\pi}{a}\right)^2\eta_{xj}\tau}\Big)-$$

$$\Theta_3^{\iint}\Big(\frac{\pi(x_{01\diamond j}+x_{02i,j})}{2a},\ e^{-\left(\frac{\pi}{a}\right)^2\eta_{xj}\tau}\Big)\Big\}\times\times$$

$$\Big\{\Theta_3^{\int}\Big(\frac{\pi(y-y_{01i,j})}{2b},\ e^{-\left(\frac{\pi}{b}\right)^2\eta_{yj}\tau}\Big)-$$

$$\Theta_3^{\int}\Big(\frac{\pi(y+y_{01i,j})}{2b},\ e^{-\left(\frac{\pi}{b}\right)^2\eta_{yj}\tau}\Big)--\Theta_3^{\int}\Big(\frac{\pi(y-y_{02i,j})}{2b},\ e^{-\left(\frac{\pi}{b}\right)^2\eta_{yj}\tau}\Big)+$$

$$\Theta_3^{\int}\Big(\frac{\pi(y+y_{02i,j})}{2b},\ e^{-\left(\frac{\pi}{b}\right)^2\eta_{yj}\tau}\Big)\Big\}\times\times$$

$$\Big\{\Theta_3\Big(\frac{\pi(z-z_{0i,j})}{2(d_{j+1}-d_j)},\ e^{-\left(\frac{\pi}{d_{j+1}-d_j}\right)^2\eta_{zj}\tau}\Big)+$$

$$\Theta_3\Big(\frac{\pi(z+z_{0i,j}-2d_j)}{2(d_{j+1}-d_j)},\ e^{-\left(\frac{\pi}{d_{j+1}-d_j}\right)^2\eta_{zj}\tau}\Big)\Big\}d\tau++$$

$$\frac{1}{(\phi c_t)_j(x_{02\diamond j}-x_{01\diamond j})}\sum_{i=L_r+1}^{M_r} U(t-t_{0i,j})\int_0^{t-t_{0i,j}} q_{i,j}(t-t_{0i,j}-\tau)\times$$

$$\times\Big\{\Theta_3^{\int}\Big(\frac{\pi(x_{02\diamond j}-x_{01i,j})}{2a},\ e^{-\left(\frac{\pi}{a}\right)^2\eta_{xj}\tau}\Big)-$$

$$\Theta_3^{\int}\Big(\frac{\pi(x_{01\diamond j}-x_{0i,j})}{2a},\ e^{-\left(\frac{\pi}{a}\right)^2\eta_{xj}\tau}\Big)++\Theta_3^{\int}\Big(\frac{\pi(x_{02\diamond j}-x_{0i,j})}{2a},\ e^{-\left(\frac{\pi}{a}\right)^2\eta_{xj}\tau}\Big)-$$

$$\Theta_3^{\int}\Big(\frac{\pi(x_{01\diamond j}+x_{0i,j})}{2a},\ e^{-\left(\frac{\pi}{a}\right)^2\eta_{xj}\tau}\Big)\Big\}\times\times$$

$$\Big\{\Theta_3^{\int}\Big(\frac{\pi(y-y_{01i,j})}{2b},\ e^{-\left(\frac{\pi}{b}\right)^2\eta_{yj}\tau}\Big)-\Theta_3^{\int}\Big(\frac{\pi(y+y_{01i,j})}{2b},\ e^{-\left(\frac{\pi}{b}\right)^2\eta_{yj}\tau}\Big)--$$

$$\Theta_3^{\int}\Big(\frac{\pi(y-y_{02i,j})}{2b},\ e^{-\left(\frac{\pi}{b}\right)^2\eta_{yj}\tau}\Big)+\Theta_3^{\int}\Big(\frac{\pi(y+y_{02i,j})}{2b},\ e^{-\left(\frac{\pi}{b}\right)^2\eta_{yj}\tau}\Big)\Big\}\times\times$$

$$\Big\{\Theta_3^{\int}\Big(\frac{\pi(z-z_{01i,j})}{2(d_{j+1}-d_j)},\ e^{-\left(\frac{\pi}{d_{j+1}-d_j}\right)^2\eta_{zj}\tau}\Big)-$$

$$\Theta_3^{\int}\Big(\frac{\pi(z+z_{01i,j}-2d_j)}{2(d_{j+1}-d_j)},\ e^{-\left(\frac{\pi}{d_{j+1}-d_j}\right)^2\eta_{zj}\tau}\Big)--$$

$$\Theta_3^{\int}\Big(\frac{\pi(z-z_{02i,j})}{2(d_{j+1}-d_j)},\ e^{-\left(\frac{\pi}{d_{j+1}-d_j}\right)^2\eta_{zj}\tau}\Big)+$$

$$\Theta_3^{\int}\Big(\frac{\pi(z+z_{02i,j}-2d_j)}{2(d_{j+1}-d_j)},\ e^{-\left(\frac{\pi}{d_{j+1}-d_j}\right)^2\eta_{zj}\tau}\Big)\Big\}d\tau+$$

$$+\frac{a}{(\phi c_t)_j b(x_{02\diamond j}-x_{01\diamond j})}$$

$$\sum_{i=M_r+1}^{N_r} U(t-t_{0i,j})\int_0^{t-t_{0i,j}} q_{i,j}(t-t_{0i,j}-\tau)\times\times\Big\{\Theta_3^{\iint}\Big(\frac{\pi(x_{02\diamond j}-x_{01i,j})}{2a},$$

$$e^{-\left(\frac{\pi}{a}\right)^2\eta_{xj}\tau}\Big)-\Theta_3^{\iint}\Big(\frac{\pi(x_{01\diamond j}-x_{01i,j})}{2a},\ e^{-\left(\frac{\pi}{a}\right)^2\eta_{xj}\tau}\Big)--$$

$$\Theta_3^{\iint}\Big(\frac{\pi(x_{02\diamond j}+x_{01i,j})}{2a},\ e^{-\left(\frac{\pi}{a}\right)^2\eta_{xj}\tau}\Big)+$$

$$\Theta_3^{\iint}\Big(\frac{\pi(x_{01\diamond j}+x_{01i,j})}{2a},\ e^{-\left(\frac{\pi}{a}\right)^2\eta_{xj}\tau}\Big)--\Theta_3^{\iint}\Big(\frac{\pi(x_{02\diamond j}-x_{02i,j})}{2a},$$

$$e^{-\left(\frac{\pi}{a}\right)^2\eta_{xj}\tau}\Big)+\Theta_3^{\iint}\Big(\frac{\pi(x_{01\diamond j}-x_{02i,j})}{2a},\ e^{-\left(\frac{\pi}{a}\right)^2\eta_{xj}\tau}\Big)++$$

$$\Theta_3^{\iint}\Big(\frac{\pi(x_{02\diamond j}+x_{02i,j})}{2a},\ e^{-\left(\frac{\pi}{a}\right)^2\eta_{xj}\tau}\Big)-$$

$$\Theta_3^{\iint}\Big(\frac{\pi(x_{01\diamond j}+x_{02i,j})}{2a},\ e^{-\left(\frac{\pi}{a}\right)^2\eta_{xj}\tau}\Big)\Big\}\times\times$$

$$\Big\{\Theta_3\Big(\frac{\pi(y-y_{0i,j})}{2b},\ e^{-\left(\frac{\pi}{b}\right)^2\eta_{yj}\tau}\Big)+\Theta_3\Big(\frac{\pi(y+y_{0i,j})}{2b},\ e^{-\left(\frac{\pi}{b}\right)^2\eta_{yj}\tau}\Big)\Big\}\times\times$$

$$\Big\{\Theta_3^{\int}\Big(\frac{\pi(z-z_{01i,j})}{2(d_{j+1}-d_j)},\ e^{-\left(\frac{\pi}{d_{j+1}-d_j}\right)^2\eta_{zj}\tau}\Big)-$$

$$\Theta_3^{\int}\Big(\frac{\pi(z+z_{01i,j}-2d_j)}{2(d_{j+1}-d_j)},\ e^{-\left(\frac{\pi}{d_{j+1}-d_j}\right)^2\eta_{zj}\tau}\Big)--$$

$$\Theta_3^{\int}\Big(\frac{\pi(z-z_{02i,j})}{2(d_{j+1}-d_j)},\ e^{-\left(\frac{\pi}{d_{j+1}-d_j}\right)^2\eta_{zj}\tau}\Big)+$$

$$\Theta_3^{\int}\Big(\frac{\pi(z+z_{02i,j}-2d_j)}{2(d_{j+1}-d_j)},\ e^{-\left(\frac{\pi}{d_{j+1}-d_j}\right)^2\eta_{zj}\tau}\Big)\Big\}d\tau+$$

$$+\frac{1}{2(\phi c_t)_j b(d_{j+1}-d_j)(x_{02\diamond j}-x_{01\diamond j})}$$

$$\int_0^t\int_0^a\int_0^b\left[\psi_j(u,v,\tau)\Theta_3\left\{\frac{\pi(z-d_j)}{2(d_{j+1}-d_j)},\ e^{-\left(\frac{\pi}{d_{j+1}-d_j}\right)^2\eta_{zj}(t-\tau)}\right\}-\right.$$

$$\left.-\psi_{j+1}(u,v,\tau)\Theta_4\left\{\frac{\pi(z-d_j)}{2(d_{j+1}-d_j)},\ e^{-\left(\frac{\pi}{d_{j+1}-d_j}\right)^2\eta_{zj}(t-\tau)}\right\}\right]\times$$

$$\times\left[\Theta_3^{\int}\left(\frac{\pi(x_{02\diamond j}-u)}{2a},\ e^{-\left(\frac{\pi}{a}\right)^2\eta_{xj}(t-\tau)}\right\}-\right.$$

$$\Theta_3^{\int}\left(\frac{\pi(x_{01\diamond j}-u)}{2a},\ e^{-\left(\frac{\pi}{a}\right)^2\eta_{xj}(t-\tau)}\right\}++\Theta_3^{\int}\left(\frac{\pi(x_{02\diamond j}+u)}{2a},\right.$$

$$\left.e^{-\left(\frac{\pi}{a}\right)^2\eta_{xj}(t-\tau)}\right\}-\Theta_3^{\int}\left(\frac{\pi(x_{01\diamond j}+u)}{2a},\ e^{-\left(\frac{\pi}{a}\right)^2\eta_{xj}(t-\tau)}\right\}\Bigg]\times\times\Bigg[$$

$$\Theta_3\left(\frac{\pi(y-v)}{2b},\ e^{-\left(\frac{\pi}{b}\right)^2\eta_{yj}(t-\tau)}\right\}+\Theta_3\left(\frac{\pi(y+v)}{2b},\ e^{-\left(\frac{\pi}{b}\right)^2\eta_{yj}(t-\tau)}\right\}\Bigg]$$

$$dudvd\tau++\frac{1}{2(\phi c_t)_j b(d_{j+1}-d_j)(x_{02\diamond j}-x_{01\diamond j})}\times\times$$

$$\int_0^t\int_0^b\int_0^{d_{j+1}-d_j}\left\{\psi_{0yzj}(v,w,\tau)\right.$$

$$\left\{\Theta_3^{\int}\left(\frac{\pi x_{02\diamond j}}{2a},\ e^{-\left(\frac{\pi}{a}\right)^2\eta_{xj}(t-\tau)}\right)-\Theta_3^{\int}\left(\frac{\pi x_{01\diamond j}}{2a},\right.\right.$$

$$\left.\left.e^{-\left(\frac{\pi}{a}\right)^2\eta_{xj}(t-\tau)}\right)\right\}-$$

$$-\psi_{ayzj}(v,w,\tau)$$

$$\left\{\Theta_4^{\int}\left(\frac{\pi x_{02\diamond j}}{2a},\ e^{-\left(\frac{\pi}{a}\right)^2\eta_{xj}(t-\tau)}\right)-\Theta_4^{\int}\left(\frac{\pi x_{01\diamond j}}{2a},\ e^{-\left(\frac{\pi}{a}\right)^2\eta_{xj}(t-\tau)}\right)\right\}\right\}\times\times\Bigg[$$

$$\Theta_3\left\{\frac{\pi(y-v)}{2b},\ e^{-\left(\frac{\pi}{b}\right)^2\eta_{yj}(t-\tau)}\right\}+\Theta_3\left\{\frac{\pi(y+v)}{2b},\ e^{-\left(\frac{\pi}{b}\right)^2\eta_{yj}(t-\tau)}\right\}\Bigg]\times\times$$

$$\left[\Theta_3\left\{\frac{\pi(z-d_j-w)}{2(d_{j+1}-d_j)},\ e^{-\left(\frac{\pi}{d_{j+1}-d_j}\right)^2\eta_{zj}(t-\tau)}\right\}+\right.$$

$$\left.\Theta_3\left\{\frac{\pi(z-d_j+w)}{2(d_{j+1}-d_j)},\ e^{-\left(\frac{\pi}{d_{j+1}-d_j}\right)^2\eta_{zj}(t-\tau)}\right\}\right]$$

$$dudwd\tau++\frac{1}{2(\phi c_t)_j b(d_{j+1}-d_j)(x_{02\diamond j}-x_{01\diamond j})}\times\times$$

$$\int_0^t\int_0^a\int_0^{d_{j+1}-d_j}\left\{\psi_{x0zj}(u,w,\tau)\Theta_3\left(\frac{\pi y}{2b},\ e^{-\left(\frac{\pi}{b}\right)^2\eta_{yj}(t-\tau)}\right)-\right.$$

$$\left.\psi_{xbzj}(u,w,\tau)\Theta_4\left(\frac{\pi y}{2b},\ e^{-\left(\frac{\pi}{b}\right)^2\eta_{yj}(t-\tau)}\right)\right\}\times\times$$

$$\left[\Theta_3^{\int}\left\{\frac{\pi(x_{02\diamond j}-u)}{2a},\ e^{-\left(\frac{\pi}{a}\right)^2\eta_{xj}(t-\tau)}\right\}-\right.$$

$$\Theta_3^{\int}\left\{\frac{\pi(x_{01\diamond j}-u)}{2a},\ e^{-\left(\frac{\pi}{a}\right)^2\eta_{xj}(t-\tau)}\right\}++$$

$$\Theta_3^{\int}\left\{\frac{\pi(x_{02\diamond j}+u)}{2a},\ e^{-\left(\frac{\pi}{a}\right)^2\eta_{xj}(t-\tau)}\right\}-$$

$$\left.\Theta_3^{\int}\left\{\frac{\pi(x_{01\diamond j}+u)}{2a},\ e^{-\left(\frac{\pi}{a}\right)^2\eta_{xj}(t-\tau)}\right\}\right]\times\times$$

$$\left[\Theta_3\left\{\frac{\pi(z-d_j-w)}{2(d_{j+1}-d_j)},\ e^{-\left(\frac{\pi}{d_{j+1}-d_j}\right)^2\eta_{zj}(t-\tau)}\right\}+\right.$$

$$\left.\Theta_3\left\{\frac{\pi(z-d_j+w)}{2(d_{j+1}-d_j)},\ e^{-\left(\frac{\pi}{d_{j+1}-d_j}\right)^2\eta_{zj}(t-\tau)}\right\}\right]dudwd\tau++$$

$$\frac{1}{4b(d_{j+1}-d_j)(x_{02\diamond j}-x_{01\diamond j})}\int_0^{d_{j+1}-d_j}\int_0^b\int_0^a\varphi_j(u,v,w+d_j)\times\times$$

-continued $$\left[\Theta_3^{\int}\left\{\frac{\pi(x_{02\diamond j}-u)}{2a},\ e^{-\left(\frac{\pi}{a}\right)^2\eta_{xj}(t-\tau)}\right\}-\right.$$

$$\Theta_3^{\int}\left\{\frac{\pi(x_{01\diamond j}-u)}{2a},\ e^{-\left(\frac{\pi}{a}\right)^2\eta_{xj}(t-\tau)}\right\}++$$

$$\Theta_3^{\int}\left\{\frac{\pi(x_{02\diamond j}+u)}{2a},\ e^{-\left(\frac{\pi}{a}\right)^2\eta_{xj}(t-\tau)}\right\}-$$

$$\left.\Theta_3^{\int}\left\{\frac{\pi(x_{01\diamond j}+u)}{2a},\ e^{-\left(\frac{\pi}{a}\right)^2\eta_{xj}(t-\tau)}\right\}\right]\times\times$$

$$\left\{\Theta_3\left(\frac{\pi(y-v)}{2b},\ e^{-\left(\frac{\pi}{b}\right)^2\eta_{yj}t}\right)+\right.$$

$$\left.\Theta_3\left(\frac{\pi(y+v)}{2b},\ e^{-\left(\frac{\pi}{b}\right)^2\eta_{yj}t}\right)\right\}\times\times$$

$$\left\{\Theta_3\left\{\frac{\pi(z-d_j-w)}{2(d_{j+1}-d_j)},\ e^{-\left(\frac{\pi}{d_{j+1}-d_j}\right)^2\eta_{zj}t}\right\}+\right.$$

$$\left.\Theta_3\left\{\frac{\pi(z-d_j+w)}{2(d_{j+1}-d_j)},\ e^{-\left(\frac{\pi}{d_{j+1}-d_j}\right)^2\eta_{zj}t}\right\}\right\}dudvdw$$

The spatial average pressure response of the inclined line $[(z_{02\diamond j}-z_{01\diamond j})\sin\theta_{0\diamond j}]$, $\iota=\diamond j$, $N_l+1\leqq\diamond\leqq N_d$ is given by $$p=\frac{1}{4\pi ab(\phi c_t)_j(z_{02\diamond j}-z_{01\diamond j})}\times\times \tag{0.14}$$

$$\sum_{\iota=1}^{L_l}U(t-t_{0\iota j})\int_0^{t-t_{0\iota j}}[q_{\iota j}(t-t_{0\iota j}-\tau)$$

$$\int_{z_{01\diamond j}}^{z_{02\diamond j}}\left\{\Theta_3\left(\frac{\pi}{2a}\left((z-\gamma_{0\diamond j})\right.\right.\right.$$

$$\left.\left.\cot\vartheta_{0\diamond j}\cos\theta_{0\diamond j}-x_{0\iota j}\right),\ e^{-\left(\frac{\pi}{a}\right)^2\eta_{xj}\tau}\right)++$$

$$\Theta_3\left(\frac{\pi}{2a}((z-\gamma_{0\diamond j})\cot\vartheta_{0\diamond j}\cos\theta_{0\diamond j}+x_{0\iota j}),\right.$$

$$\left.\left.e^{-\left(\frac{\pi}{a}\right)^2\eta_{xj}\tau}\right)\right\}\times\times\left\{\Theta_3\left(\frac{\pi}{2b}((z-\gamma_{0\diamond j})\right.\right.$$

$$\left.\left.\cot\vartheta_{0\diamond j}\sin\theta_{0\diamond j}-y_{0\iota j}\right),e^{-\left(\frac{\pi}{b}\right)^2\eta_{yj}\tau}\right)+$$

$$+\Theta_3\left(\frac{\pi}{2b}\left((z-\gamma_{0\diamond j})\cot\vartheta_{0\diamond j}\sin\theta_{0\diamond j}+y_{0\iota j}\right),\ e^{-\left(\frac{\pi}{b}\right)^2\eta_{yj}\tau}\right)\right\}\times\times$$

$$\left\{\Theta_3^{\int}\left(\frac{\pi(z-z_{01\iota j})}{2(d_{j+1}-d_j)},\ e^{-\left(\frac{\pi}{d_{j+1}-d_j}\right)^2\eta_{zj}\tau}\right)+\right.$$

$$\Theta_3^{\int}\left(\frac{\pi(z+z_{01\iota j}-2d_j)}{2(d_{j+1}-d_j)},\ e^{-\left(\frac{\pi}{d_{j+1}-d_j}\right)^2\eta_{zj}\tau}\right)++$$

$$\Theta_3^{\int}\left(\frac{\pi(z-z_{02\iota j})}{2(d_{j+1}-d_j)},\ e^{-\left(\frac{\pi}{d_{j+1}-d_j}\right)^2\eta_{zj}\tau}\right)+$$

$$\left.\Theta_3^{\int}\left(\frac{\pi(z+z_{02\iota j}-2d_j)}{2(d_{j+1}-d_j)},\ e^{-\left(\frac{\pi}{d_{j+1}-d_j}\right)^2\eta_{zj}\tau}\right)\right\}$$

$$dz]d\tau++\frac{1}{4\pi b(d_{j+1}-d_j)(\phi c_t)_j(z_{02\diamond j}-z_{01\diamond j})}\times\times$$

$$\sum_{\iota=L_l+1}^{M_l}U(t-t_{0\iota j})$$

$$\int_0^{t-t_{0\iota j}}\left[q_{\iota j}(t-t_{0\iota j}-\tau)\right.$$

-continued $$\int_{z_{01\diamond j}}^{z_{02\diamond j}}\left\{\Theta_3\left(\frac{\pi(z-z_{0ij})}{2(d_{j+1}-d_j)},\ e^{-\left(\frac{\pi}{d_{j+1}-d_j}\right)^2\eta_{zj}\tau}\right)+\right.$$

$$\left.+\Theta_3\left(\frac{\pi(z+z_{0ij}-2d_j)}{2(d_{j+1}-d_j)},\ e^{-\left(\frac{\pi}{d_{j+1}-d_j}\right)^2\eta_{zj}\tau}\right)\right\}\times\times$$

$$\left\{\Theta_3\left(\frac{\pi}{2b}((z-\gamma_{0\diamond j})\cot\vartheta_{0\diamond j}\sin\theta_{0\diamond j}-y_{0ij}),e^{-\left(\frac{\pi}{b}\right)^2\eta_{yj}\tau}\right)++\Theta_3\left(\frac{\pi}{2b}((z-\gamma_{0\diamond j})\cot\vartheta_{0\diamond j}\sin\theta_{0\diamond j}+y_{0ij}),\ e^{-\left(\frac{\pi}{b}\right)^2\eta_{yj}\tau}\right)\right\}\times\times$$

$$\left\{\Theta_3^{\int}\left(\frac{\pi}{2a}((z-\gamma_{0\diamond j})\cot\vartheta_{0\diamond j}\cos\theta_{0\diamond j}-x_{01ij}),\ e^{-\left(\frac{\pi}{a}\right)^2\eta_{xj}\tau}\right)++\Theta_3^{\int}\left(\frac{\pi}{2a}((z-\gamma_{0\diamond j})\cot\vartheta_{0\diamond j}\cos\theta_{0\diamond j}+x_{01ij}),\ e^{-\left(\frac{\pi}{a}\right)^2\eta_{xj}\tau}\right)++\right.$$

$$\left.\Theta_3^{\int}\left(\frac{\pi}{2a}((z-\gamma_{0\diamond j})\cot\vartheta_{0\diamond j}\cos\theta_{0\diamond j}-x_{02ij}),\ e^{-\left(\frac{\pi}{a}\right)^2\eta_{xj}\tau}\right)+\Theta_3^{\int}\left(\frac{\pi}{2a}((z-\gamma_{0\diamond j})\cot\vartheta_{0\diamond j}\cos\theta_{0\diamond j}+x_{02ij}),\ e^{-\left(\frac{\pi}{a}\right)^2\eta_{xj}\tau}\right)\right\}dz\Bigg]d\tau++$$

$$\frac{1}{4\pi a(d_{j+1}-d_j)(\phi c_t)_j(z_{02\diamond j}-z_{01\diamond j})}\sum_{i=M_l+1}^{N_l}U(t-t_{0ij})\times\times\int_0^{t-t_{0ij}}\Bigg[q_i(t-t_{0ij}-\tau)$$

$$\int_{z_{01\diamond j}}^{z_{02\diamond j}}\left\{\Theta_3\left(\frac{\pi}{2a}((z-\gamma_{0\diamond j})\cot\vartheta_{0\diamond j}\cos\theta_{0\diamond j}-x_{0ij}),\ e^{-\left(\frac{\pi}{a}\right)^2\eta_{xj}\tau}\right)++\Theta_3\left(\frac{\pi}{2a}((z-\gamma_{0\diamond j})\cot\vartheta_{0\diamond j}\cos\theta_{0\diamond j}+x_{0ij}),\ e^{-\left(\frac{\pi}{a}\right)^2\eta_{xj}\tau}\right)\right\}\times\times$$

$$\left\{\Theta_3\left(\frac{\pi(z-z_{0ij})}{2(d_{j+1}-d_j)},\ e^{-\left(\frac{\pi}{d_{j+1}-d_j}\right)^2\eta_{zj}\tau}\right)+\Theta_3\left(\frac{\pi(z+z_{0ij}-2d_j)}{2(d_{j+1}-d_j)},\ e^{-\left(\frac{\pi}{d_{j+1}-d_j}\right)^2\eta_{zj}\tau}\right)\right\}\times$$

$$\times\left\{\Theta_3^{\int}\left(\frac{\pi}{2b}((z-\gamma_{0\diamond j})\cot\vartheta_{0\diamond j}\sin\theta_{0\diamond j}-y_{01ij}),\ e^{-\left(\frac{\pi}{b}\right)^2\eta_{yj}\tau}\right)++\Theta_3^{\int}\left(\frac{\pi}{2b}((z-\gamma_{0\diamond j})\cot\vartheta_{0\diamond j}\sin\theta_{0\diamond j}+y_{01ij}),\ e^{-\left(\frac{\pi}{b}\right)^2\eta_{yj}\tau}\right)++\right.$$

$$\Theta_3^{\int}\left(\frac{\pi}{2b}((z-\gamma_{0\diamond j})\cot\vartheta_{0\diamond j}\sin\theta_{0\diamond j}-y_{02ij}),\ e^{-\left(\frac{\pi}{b}\right)^2\eta_{yj}\tau}\right)++$$

$$\left.\Theta_3^{\int}\left(\frac{\pi}{2b}((z-\gamma_{0\diamond j})\cot\vartheta_{0\diamond j}\sin\theta_{0\diamond j}+y_{02ij}),\ e^{-\left(\frac{\pi}{b}\right)^2\eta_{yj}\tau}\right)\right\}dz\Bigg]$$

$$d\tau++\frac{1}{8(\phi c_t)_j ab(d_{j+1}-d_j)(z_{02\diamond j}-z_{01\diamond j})}\times\times$$

-continued $$\sum_{i=N_l+1}^{N_d}U(t-t_{0ij})\sin\vartheta_{0ij}\int_0^{t-t_{0ij}}q_i(t-t_{0ij}-\tau)\times\times$$

$$\int_{z_{01ij}}^{z_{02ij}}\int_{z_{01\diamond j}}^{z_{02\diamond j}}\Bigg[\left\{\Theta_3\left(\frac{\pi}{2a}\{(z-\gamma_{0\diamond j})\cot\vartheta_{0\diamond j}\cos\theta_{0\diamond j}-(z_{0ij}-\gamma_{0ij})\cot\vartheta_{0ij}\cos\theta_{0ij}\},\ e^{-\left(\frac{\pi}{a}\right)^2\eta_{xj}\tau}\right)++\Theta_3\left(\frac{\pi}{2a}\{(z-\gamma_{0\diamond j})\cot\vartheta_{0\diamond j}\cos\theta_{0\diamond j}+(z_{0ij}-\gamma_{0ij})\cot\vartheta_{0ij}\cos\theta_{0ij}\},\ e^{-\left(\frac{\pi}{a}\right)^2\eta_{xj}\tau}\right)\right\}\times\times$$

$$\left\{\Theta_3\left(\frac{\pi}{2b}\{(z-\gamma_{0\diamond j})\cot\vartheta_{0\diamond j}\sin\theta_{0\diamond j}-(z_{0ij}-\gamma_{0ij})\cot\vartheta_{0ij}\sin\theta_{0ij}\},\ e^{-\left(\frac{\pi}{b}\right)^2\eta_{yj}\tau}\right)++\Theta_3\left(\frac{\pi}{2b}\{(z-\gamma_{0\diamond j})\cot\vartheta_{0\diamond j}\sin\theta_{0\diamond j}+(z_{0ij}-\gamma_{0ij})\cot\vartheta_{0ij}\sin\theta_{0ij}\},\ e^{-\left(\frac{\pi}{b}\right)^2\eta_{yj}\tau}\right)\right\}\times\times$$

$$\left\{\Theta_3\left(\frac{\pi(z-z_{0ij})}{2(d_{j+1}-d_j)},\ e^{-\left(\frac{\pi}{d_{j+1}-d_j}\right)^2\eta_{yj}\tau}\right)+\Theta_3\left(\frac{\pi(z+z_{0ij}-2d_j)}{2(d_{j+1}-d_j)},\ e^{-\left(\frac{\pi}{d_{j+1}-d_j}\right)^2\eta_{yj}\tau}\right)\right\}\Bigg]dz\,dz_{0ij}d\tau+$$

$$+\frac{1}{2\pi^2(d_{j+1}-d_j)(\phi c_t)_j(z_{02\diamond j}-z_{01\diamond j})}\sum_{i=N_d+1}^{L_r}U(t-t_{0ij})\times\times$$

$$\int_0^{t-t_{0ij}}\Bigg[q_{ij}(t-t_{0ij}-\tau)\int_{z_{01\diamond j}}^{z_{02\diamond j}}\left\{\Theta_3\left(\frac{\pi(z-z_{0ij})}{2(d_{j+1}-d_j)},\ e^{-\left(\frac{\pi}{d_{j+1}-d_j}\right)^2\eta_{zj}\tau}\right)++\Theta_3\left(\frac{\pi(z+z_{0ij}-2d_j)}{2(d_{j+1}-d_j)},\ e^{-\left(\frac{\pi}{d_{j+1}-d_j}\right)^2\eta_{zj}\tau}\right)\right\}\times\times$$

$$\left\{\Theta_3^{\int}\left(\frac{\pi}{2b}((z-\gamma_{0\diamond j})\cot\vartheta_{0\diamond j}\sin\theta_{0\diamond j}-y_{01i}),\ e^{-\left(\frac{\pi}{b}\right)^2\eta_{yj}\tau}\right)++\Theta_3^{\int}\left(\frac{\pi}{2b}((z-\gamma_{0\diamond j})\cot\vartheta_{0\diamond j}\sin\theta_{0\diamond j}+y_{01i}),\ e^{-\left(\frac{\pi}{b}\right)^2\eta_{yj}\tau}\right)++\right.$$

$$\left.\Theta_3^{\int}\left(\frac{\pi}{2b}((z-\gamma_{0\diamond j})\cot\vartheta_{0\diamond j}\sin\theta_{0\diamond j}-y_{02i}),\ e^{-\left(\frac{\pi}{b}\right)^2\eta_{yj}\tau}\right)++\right.$$

-continued $$\Theta_3^{\int}\left(\frac{\pi}{2b}((z-\gamma_{0\diamond j})\cot\vartheta_{0\diamond j}\sin\theta_{0\diamond j}+y_{02t}),\ e^{-\left(\frac{\pi}{b}\right)^2\eta_{yj}\tau}\right)\Bigg\}\times\times$$

$$\Theta_3^{\int}\left(\frac{\pi}{2a}((z-\gamma_{0\diamond j})\cot\vartheta_{0\diamond j}\cos\theta_{0\diamond j}-x_{01t}),\ e^{-\left(\frac{\pi}{a}\right)^2\eta_{xj}\tau}\right)++$$

$$\Theta_3^{\int}\left(\frac{\pi}{2a}((z-\gamma_{0\diamond j})\cot\vartheta_{0\diamond j}\cos\theta_{0\diamond j}+x_{01t}),\ e^{-\left(\frac{\pi}{a}\right)^2\eta_{xj}\tau}\right)++$$

$$\Theta_3^{\int}\left(\frac{\pi}{2a}((z-\gamma_{0\diamond j})\cot\vartheta_{0\diamond j}\cos\theta_{0\diamond j}-x_{02t}),\ e^{-\left(\frac{\pi}{a}\right)^2\eta_{xj}\tau}\right)++$$

$$\Theta_3^{\int}\left(\frac{\pi}{2a}((z-\gamma_{0\diamond j})\cot\vartheta_{0\diamond j}\cos\theta_{0\diamond j}+x_{02t}),\ e^{-\left(\frac{\pi}{a}\right)^2\eta_{xj}\tau}\right)\Bigg\}\,dz\Bigg]\,d\tau+$$

$$+\frac{1}{2\pi^2a(\phi c_t)_j(z_{02\diamond j}-z_{01\diamond j})}\sum_{t=L_r+1}^{M_r}U(t-t_{0tj})\times\times$$

$$\int_0^{t-t_{0tj}}\Bigg[q_{tj}(t-t_{0tj}-\tau)\int_{z_{01\diamond j}}^{z_{02\diamond j}}\Bigg\{\Theta_3\left(\frac{\pi}{2a}((z-\gamma_{0\diamond j})\cot\vartheta_{0\diamond j}\cos\theta_{0\diamond j}-x_{0tj}),\ e^{-\left(\frac{\pi}{a}\right)^2\eta_{xj}\tau}\right)++$$

$$\Theta_3\left(\frac{\pi}{2a}((z-\gamma_{0\diamond j})\cot\vartheta_{0\diamond j}\cos\theta_{0\diamond j}+x_{0tj}),\ e^{-\left(\frac{\pi}{a}\right)^2\eta_{xj}\tau}\right)\Bigg\}\times\times$$

$$\Bigg\{\Theta_3^{\int}\left(\frac{\pi}{2b}((z-\gamma_{0\diamond j})\cot\vartheta_{0\diamond j}\sin\theta_{0\diamond j}-y_{01t}),\ e^{-\left(\frac{\pi}{b}\right)^2\eta_{yj}\tau}\right)++\Theta_3^{\int}\left(\frac{\pi}{2b}((z-\gamma_{0\diamond j})\cot\vartheta_{0\diamond j}\sin\theta_{0\diamond j}+y_{01t}),\ e^{-\left(\frac{\pi}{b}\right)^2\eta_{yj}\tau}\right)++$$

$$\Theta_3^{\int}\left(\frac{\pi}{2b}((z-\gamma_{0\diamond j})\cot\vartheta_{0\diamond j}\sin\theta_{0\diamond j}-y_{02t}),\ e^{-\left(\frac{\pi}{a}\right)^2\eta_{yj}\tau}\right)+$$

$$\Theta_3^{\int}\left(\frac{\pi}{2b}((z-\gamma_{0\diamond j})\cot\vartheta_{0\diamond j}\sin\theta_{0\diamond j}+y_{02t}),\ e^{-\left(\frac{\pi}{b}\right)^2\eta_{yj}\tau}\right)\Bigg\}\times\times$$

$$\Bigg\{\Theta_3^{\int}\left(\frac{\pi(z-z_{01t})}{2(d_{j+1}-d_j)},\ e^{-\left(\frac{\pi}{d_{j+1}-d_j}\right)^2\eta_{zj}\tau}\right)+$$

$$\Theta_3^{\int}\left(\frac{\pi(z+z_{01tj}-2d_j)}{2(d_{j+1}-d_j)},\ e^{-\left(\frac{\pi}{d_{j+1}-d_j}\right)^2\eta_{zj}\tau}\right)++$$

$$\Theta_3^{\int}\left(\frac{\pi(z-z_{01t})}{2(d_{j+1}-d_j)},\ e^{-\left(\frac{\pi}{d_{j+1}-d_j}\right)^2\eta_{zj}\tau}\right)+$$

$$\Theta_3^{\int}\left(\frac{\pi(z+z_{01tj}-2d_j)}{2(d_{j+1}-d_j)},\ e^{-\left(\frac{\pi}{d_{j+1}-d_j}\right)^2\eta_{zj}\tau}\right)\Bigg\}\,dz\Bigg]\,d\tau+$$

$$+\frac{1}{2\pi^2b(\phi c_t)_j(z_{02\diamond j}-z_{01\diamond j})}\times\times\sum_{t=M_r+1}^{N_r}U\left(t-t_{0tj}\right)\int_0^{t-t_{0tj}}\Bigg[q_t(t-t_{0tj}-\tau)$$

$$\int_{z_{01\diamond j}}^{z_{02\diamond j}}\Bigg\{\Theta_3\left(\frac{\pi}{2b}((z-\gamma_{0\diamond j})\cot\vartheta_{0\diamond j}\sin\theta_{0\diamond j}-y_{0tj}),\ e^{-\left(\frac{\pi}{b}\right)^2\eta_{yj}\tau}\right)++$$

$$\Theta_3\left(\frac{\pi}{2b}((z-\gamma_{0\diamond j})\cot\vartheta_{0\diamond j}\sin\theta_{0\diamond j}+y_{0tj}),\ e^{-\left(\frac{\pi}{b}\right)^2\eta_{yj}\tau}\right)\Bigg\}\times\times$$

$$\Bigg\{\Theta_3^{\int}\left(\frac{\pi}{2a}((z-\gamma_{0\diamond j})\cot\vartheta_{0\diamond j}\cos\theta_{0\diamond j}-x_{01t}),\ e^{-\left(\frac{\pi}{a}\right)^2\eta_{xj}\tau}\right)++$$

$$\Theta_3^{\int}\left(\frac{\pi}{2a}((z-\gamma_{0\diamond j})\cot\vartheta_{0\diamond j}\cos\theta_{0\diamond j}+x_{01t}),\ e^{-\left(\frac{\pi}{a}\right)^2\eta_{xj}\tau}\right)++$$

$$\Theta_3^{\int}\left(\frac{\pi}{2a}((z-\gamma_{0\diamond j})\cot\vartheta_{0\diamond j}\cos\theta_{0\diamond j}-x_{02t}),\ e^{-\left(\frac{\pi}{a}\right)^2\eta_{xj}\tau}\right)++$$

$$\Theta_3^{\int}\left(\frac{\pi}{2a}((z-\gamma_{0\diamond j})\cot\vartheta_{0\diamond j}\cos\theta_{0\diamond j}+x_{02t}),\ e^{-\left(\frac{\pi}{a}\right)^2\eta_{xj}\tau}\right)\Bigg\}\times\times$$

$$\Bigg\{\Theta_3^{\int}\left(\frac{\pi(z-z_{01t})}{2(d_{j+1}-d_j)},\ e^{-\left(\frac{\pi}{d_{j+1}-d_j}\right)^2\eta_{zj}\tau}\right)+$$

$$\Theta_3^{\int}\left(\frac{\pi(z+z_{01tj}-2d_j)}{2(d_{j+1}-d_j)},\ e^{-\left(\frac{\pi}{d_{j+1}-d_j}\right)^2\eta_{zj}\tau}\right)++$$

$$\Theta_3^{\int}\left(\frac{\pi(z-z_{02t})}{2(d_{j+1}-d_j)},\ e^{-\left(\frac{\pi}{d_{j+1}-d_j}\right)^2\eta_{zj}\tau}\right)+$$

$$\Theta_3^{\int}\left(\frac{\pi(z+z_{02tj}-2d_j)}{2(d_{j+1}-d_j)},\ e^{-\left(\frac{\pi}{d_{j+1}-d_j}\right)^2\eta_{zj}\tau}\right)\Bigg\}\,dz\Bigg]\,d\tau+$$

$$+\frac{4}{(\phi c_t)_j ab(d_{j+1}-d_j)(z_{02\diamond j}-z_{01\diamond j})}\sum_{m=0}^{\infty}\sum_{l=0}^{\infty}\ni_m\ \ni_l\int_{z_{01\diamond j}}^{z_{02\diamond j}}\cos\left(\frac{m\pi(z-\gamma_{0\diamond j})\cot\vartheta_{0\diamond j}\sin\theta_{0\diamond j}}{b}\right)\cos\left(\frac{l\pi(z-d_j)}{d_{j+1}-d_j}\right)\times\times$$

$$\int_0^t\Bigg\{\overline{\overline{\psi}}_{0yz}(m,l,\tau)\Theta_3\left(\frac{\pi(z-\gamma_{0\diamond j})\cot\vartheta_{0\diamond j}\sin\theta_{0\diamond j}}{2a},\ e^{-\left(\frac{\pi}{a}\right)^2\eta_{xj}(t-\tau)}\right)--$$

$$\overline{\overline{\psi}}_{ayz}(m,l,\tau)\Theta_4\left(\frac{\pi(z-\gamma_{0\diamond j})\cot\vartheta_{0\diamond j}\cos\theta_{0\diamond j}}{2a},\ e^{-\left(\frac{\pi}{a}\right)^2\eta_{xj}(t-\tau)}\right)\Bigg\}$$

$$e^{-\left\{\left(\frac{m\pi}{b}\right)^2\eta_{yj}+\left(\frac{l\pi}{d_{j+1}-d_j}\right)^2\eta_{xj}\right\}(t-\tau)}\,d\tau\,dz++$$

$$\frac{4}{(\phi c_t)_j ab(d_{j+1}-d_j)(z_{02\diamond j}-z_{01\diamond j})}$$

$$\sum_{n=0}^{\infty}\sum_{l=0}^{\infty}\ni_n\ \ni_l\int_{z_{01\diamond j}}^{z_{02\diamond j}}\cos\left(\frac{n\pi(z-\gamma_{0\diamond j})\cot\vartheta_{0\diamond j}\cos\theta_{0\diamond j}}{a}\right)$$

$$\cos\left(\frac{l\pi(z-d_j)}{d_{j+1}-d_j}\right)\times\times$$

$$\int_0^t\Bigg\{\overline{\overline{\psi}}_{x0z}(n,l,\tau)\Theta_3\left(\frac{\pi(z_{02\diamond j}-z_{01\diamond j})\sin\vartheta_{0\diamond j}}{2b},\ e^{-\left(\frac{\pi}{b}\right)^2\eta_{yj}(t-\tau)}\right)--$$

-continued $$\bar{\bar{\psi}}_{xbz}(n, l, \tau)\Theta_4\left(\frac{\pi(z_{02\diamond j} - z_{01\diamond j})\sin\vartheta_{0\diamond j}}{2b}, e^{-\left(\frac{\pi}{b}\right)^2\eta_{yj}(t-\tau)}\right)\Bigg\}$$

$$e^{-\left\{\left(\frac{m\pi}{a}\right)^2\eta_{xj}+\left(\frac{l\pi}{d_{j+1}-d_j}\right)^2\eta_{zj}\right\}(t-\tau)}d\tau dz++$$

$$\frac{4}{(\phi c_t)_j ab(d_{j+1} - d_j)(z_{02\diamond j} - z_{01\diamond j})}\times$$

$$\times\sum_{n=0}^{\infty}\sum_{m=0}^{\infty}\ni_n\ \ni_m\int_{z_{01\diamond j}}^{z_{02\diamond j}}\cos\left(\frac{n\pi(z-\gamma_{0\diamond j})\cot\vartheta_{0\diamond j}\cos\theta_{0\diamond j}}{a}\right)$$

$$\cos\left(\frac{m\pi(z-\gamma_{0\diamond j})\cot\vartheta_{0\diamond j}\sin\theta_{0\diamond j}}{b}\right)\times\times$$

$$\int_0^t\Bigg\{\bar{\bar{\psi}}_{xy0}(n, m, \tau)\Theta_3\left(\frac{\pi(z-d_j)}{2(d_{j+1}-d_j)}, e^{-\left(\frac{\pi}{d_{j+1}-d_j}\right)^2\eta_{zj}(t-\tau)}\right)--$$

$$\bar{\bar{\psi}}_{xyd}(n, m, \tau)\Theta_4\left(\frac{\pi(z-d_j)}{2(d_{j+1}-d_j)}, e^{-\left(\frac{\pi}{d_{j+1}-d_j}\right)^2\eta_{zj}(t-\tau)}\right)\Bigg\}$$

$$e^{-\left\{\left(\frac{n\pi}{a}\right)^2\eta_{xj}+\left(\frac{m\pi}{b}\right)^2\eta_{yj}\right\}(t-\tau)}d\tau dz+\frac{1}{8ab(d_{j+1}-d_j)(z_{02\diamond j}-z_{01\diamond j})}$$

$$\int_0^d\int_0^b\int_0^a\varphi_j(u, v, w+d_j)\times\times$$

$$\int_{z_{01\diamond j}}^{z_{02\diamond j}}\Bigg[\Bigg\{\Theta_3\left(\frac{\pi}{2a}((z-\gamma_{0\diamond j})\cot\vartheta_{0\diamond j}\cos\theta_{0\diamond j}-\right.$$

$$\left.u), e^{-\left(\frac{\pi}{a}\right)^2\eta_{xj}t}\right)++\Theta_3\left(\frac{\pi}{2a}((z-\gamma_{0\diamond j})\right.$$

$$\left.\cot\vartheta_{0\diamond j}\cos\theta_{0\diamond j}+u), e^{-\left(\frac{\pi}{a}\right)^2\eta_{xj}t}\right)\Bigg\}\times\times$$

$$\Bigg\{\Theta_3\left(\frac{\pi}{2b}((z-\gamma_{0\diamond j})\cot\vartheta_{0\diamond j}\sin\theta_{0\diamond j}-v), e^{-\left(\frac{\pi}{b}\right)^2\eta_{yj}t}\right)++$$

$$\Theta_3\left(\frac{\pi}{2b}\left((z-\gamma_{0\diamond j})\cot\vartheta_{0\diamond j}\sin\theta_{0\diamond j}+v\right), e^{-\left(\frac{\pi}{b}\right)^2\eta_{yj}t}\right)\Bigg\}\times\times$$

$$\Bigg\{\Theta_3\left(\frac{\pi(z-d_j-w)}{2(d_{j+1}-d_j)}, e^{-\left(\frac{\pi}{d_{j+1}-d_j}\right)^2\eta_{zj}t}\right)+$$

$$\Theta_3\left(\frac{\pi(z-d_j+w)}{2(d_{j+1}-d_j)}, e^{-\left(\frac{\pi}{d_{j+1}-d_j}\right)^2\eta_{zj}t}\right)\Bigg\}\Bigg]dudvdwdz$$

The spatial average pressure response of the rectangle $[(x_{02\diamond j}-x_{01\diamond j})(y_{02\diamond j}-y_{01\diamond j})]$, $\iota=\diamond$, $N_l+1\leqq\diamond\leqq L_r$ is given by $$p_j = \tag{0.15}$$

$$\frac{1}{(\phi c_t)_j(x_{02\diamond j}-x_{01\diamond j})(y_{02\diamond j}-y_{01\diamond j})}\sum_{\iota=1}^{L_l}U(t-t_{0\iota j})\int_0^{t-t_{0\iota j}}q_{\iota j}\Bigg(t-$$

$$t_{0\iota j}-\tau)\times\times\Bigg\{\Theta_3^{\int}\left(\frac{\pi(x_{02\diamond j}-x_{0\iota j})}{2a}, e^{-\left(\frac{\pi}{a}\right)^2\eta_{xj}\tau}\right)-$$

$$\Theta_3^{\int}\left(\frac{\pi(x_{01\diamond j}-x_{0\iota j})}{2a}, e^{-\left(\frac{\pi}{a}\right)^2\eta_{xj}\tau}\right)++$$

$$\Theta_3^{\int}\left(\frac{\pi(x_{02\diamond j}+x_{0\iota j})}{2a}, e^{-\left(\frac{\pi}{a}\right)^2\eta_{xj}\tau}\right)-\Theta_3^{\int}\left(\frac{\pi(x_{01\diamond j}+x_{0\iota j})}{2a}, e^{-\left(\frac{\pi}{a}\right)^2\eta_{xj}\tau}\right)\Bigg\}\times\times$$

$$\Bigg\{\Theta_3^{\int}\left(\frac{\pi(y_{02\diamond j}-y_{0\iota j})}{2b}, e^{-\left(\frac{\pi}{b}\right)^2\eta_{yj}\tau}\right)-$$

$$\Theta_3^{\int}\left(\frac{\pi(y_{01\diamond j}+y_{0\iota j})}{2b}, e^{-\left(\frac{\pi}{b}\right)^2\eta_{yj}\tau}\right)++$$

$$\Theta_3^{\int}\left(\frac{\pi(y_{02\diamond j}+y_{0\iota j})}{2b}, e^{-\left(\frac{\pi}{b}\right)^2\eta_{yj}\tau}\right)-$$

$$\Theta_3^{\int}\left(\frac{\pi(y_{01\diamond j}+y_{0\iota j})}{2b}, e^{-\left(\frac{\pi}{b}\right)^2\eta_{yj}\tau}\right)\Bigg\}\times\times$$

$$\Bigg\{\Theta_3^{\int}\left(\frac{\pi(z-z_{01\iota j})}{2(d_{j+1}-d_j)}, e^{-\left(\frac{\pi}{d_{j+1}-d_j}\right)^2\eta_{zj}\tau}\right)-$$

$$\Theta_3^{\int}\left(\frac{\pi(z+z_{01\iota j}-2d_j)}{2(d_{j+1}-d_j)}, e^{-\left(\frac{\pi}{d_{j+1}-d_j}\right)^2\eta_{zj}\tau}\right)--$$

$$\Theta_3^{\int}\left(\frac{\pi(z-z_{02\iota j})}{2(d_{j+1}-d_j)}, e^{-\left(\frac{\pi}{d_{j+1}-d_j}\right)^2\eta_{zj}\tau}\right)+$$

$$\Theta_3^{\int}\left(\frac{\pi(z+z_{02\iota j}-2d_j)}{2(d_{j+1}-d_j)}, e^{-\left(\frac{\pi}{d_{j+1}-d_j}\right)^2\eta_{zj}\tau}\right)\Bigg\}d\tau++$$

$$\frac{a}{(\phi c_t)_j(d_{j+1}-d_j)(x_{02\diamond j}-x_{01\diamond j})(y_{02\diamond j}-y_{01\diamond j})}\sum_{\iota=L_t+1}^{M_t}U\Bigg(t-$$

$$t_{0\iota j}\int_0^{t-t_{0\iota j}}q_{\iota j}(t-t_{0\iota j}-\tau)\times$$

$$\times\Bigg\{\Theta_3^{\int}\left(\frac{\pi(y_{02\diamond j}-y_{0\iota j})}{2b}, e^{-\left(\frac{\pi}{b}\right)^2\eta_{yj}\tau}\right)-$$

$$\Theta_3^{\int}\left(\frac{\pi(y_{01\diamond j}-y_{0\iota j})}{2b}, e^{-\left(\frac{\pi}{b}\right)^2\eta_{yj}\tau}\right)++\Theta_3^{\int}\left(\frac{\pi(y_{02\diamond j}+y_{0\iota j})}{2b}, e^{-\left(\frac{\pi}{b}\right)^2\eta_{yj}\tau}\right)-$$

$$\Theta_3^{\int}\left(\frac{\pi(y_{01\diamond j}+y_{0\iota j})}{2b}, e^{-\left(\frac{\pi}{b}\right)^2\eta_{yj}\tau}\right)\Bigg\}\times\times$$

$$\Bigg\{\Theta_3\left(\frac{\pi(z-z_{0\iota j})}{2(d_{j+1}-d_j)}, e^{-\left(\frac{\pi}{d_{j+1}-d_j}\right)^2\eta_{zj}\tau}\right)+$$

$$\Theta_3\left(\frac{\pi(z+z_{0\iota j}-2d_j)}{2(d_{j+1}-d_j)}, e^{-\left(\frac{\pi}{d_{j+1}-d_j}\right)^2\eta_{zj}\tau}\right)\Bigg\}\times\times$$

$$\Bigg\{\Theta_3^{\int\int}\left(\frac{\pi(x_{02\diamond j}-x_{01\iota j})}{2a}, e^{-\left(\frac{\pi}{a}\right)^2\eta_{xj}\tau}\right)-\Theta_3^{\int\int}\left(\frac{\pi(x_{01\diamond j}-x_{01\iota j})}{2a}, e^{-\left(\frac{\pi}{a}\right)^2\eta_{xj}\tau}\right)--$$

$$\Theta_3^{\int\int}\left(\frac{\pi(x_{02\diamond j}+x_{01\iota j})}{2a}, e^{-\left(\frac{\pi}{a}\right)^2\eta_{xj}\tau}\right)+$$

$$\Theta_3^{\int\int}\left(\frac{\pi(x_{01\diamond j}+x_{01\iota j})}{2a}, e^{-\left(\frac{\pi}{a}\right)^2\eta_{xj}\tau}\right)--$$

$$\Theta_3^{\int\int}\left(\frac{\pi(x_{02\diamond j}-x_{02\iota j})}{2a}, e^{-\left(\frac{\pi}{a}\right)^2\eta_{xj}\tau}\right)+$$

$$\Theta_3^{\int\int}\left(\frac{\pi(x_{01\diamond j}+x_{02\iota j})}{2a}, e^{-\left(\frac{\pi}{a}\right)^2\eta_{xj}\tau}\right)++\Theta_3^{\int\int}\left(\frac{\pi(x_{02\diamond j}+x_{02\iota j})}{2a},\right.$$

$$\left.e^{-\left(\frac{\pi}{a}\right)^2\eta_{xj}\tau}\right)-\Theta_3^{\int\int}\left(\frac{\pi(x_{01\diamond j}+x_{02\iota j})}{2a}, e^{-\left(\frac{\pi}{a}\right)^2\eta_{xj}\tau}\right)\Bigg\}++$$

$$\frac{b}{(\phi c_t)_j(d_{j+1}-d_j)(x_{02\diamond j}-x_{01\diamond j})(y_{02\diamond j}-y_{01\diamond j})}$$

$$\sum_{\iota=M_l+1}^{N_l}U(t-t_{0\iota j})$$

$$\int_0^{t-t_{0\iota j}}q_{\iota j}(t-t_{0\iota j}-\tau)\times\times\Bigg\{\Theta_3^{\int}\left(\frac{\pi(x_{02\diamond j}-x_{0\iota j})}{2a}, e^{-\left(\frac{\pi}{a}\right)^2\eta_{xj}\tau}\right)-$$

$$\Theta_3^{\int}\left(\frac{\pi(x_{01\diamond j}-x_{0\iota j})}{2a}, e^{-\left(\frac{\pi}{a}\right)^2\eta_{xj}\tau}\right)+$$

$$+\Theta_3^{\int}\left(\frac{\pi(x_{02\diamond j}+x_{0\iota j})}{2a},\ e^{-\left(\frac{\pi}{a}\right)^2\eta_{xj}\tau}\right)-\Theta_3^{\int}\left(\frac{\pi(x_{01\diamond j}+x_{0\iota j})}{2a},\ e^{-\left(\frac{\pi}{a}\right)^2\eta_{xj}\tau}\right)\Bigg\}\times\times$$

$$\left\{\Theta_3\left(\frac{\pi(z-z_{0\iota j})}{2(d_{j+1}-d_j)},\ e^{-\left(\frac{\pi}{d_{j+1}-d_j}\right)^2\eta_{zj}\tau}\right)+\right.$$

$$\left.\Theta_3\left(\frac{\pi(z+z_{0\iota j}-2d_j)}{2(d_{j+1}-d_j)},\ e^{-\left(\frac{\pi}{d_{j+1}-d_j}\right)^2\eta_{zj}\tau}\right)\right\}\times\times$$

$$\left\{\Theta_3^{\iint}\left(\frac{\pi(y_{02\diamond j}-y_{01\iota j})}{2a},\ e^{-\left(\frac{\pi}{b}\right)^2\eta_{yj}\tau}\right)-\Theta_3^{\iint}\left(\frac{\pi(y_{01\diamond j}-y_{01\iota j})}{2b},\ e^{-\left(\frac{\pi}{b}\right)^2\eta_{yj}\tau}\right)--\right.$$

$$\Theta_3^{\iint}\left(\frac{\pi(y_{02\diamond j}+y_{01\iota j})}{2b},\ e^{-\left(\frac{\pi}{b}\right)^2\eta_{yj}\tau}\right)+$$

$$\Theta_3^{\iint}\left(\frac{\pi(y_{01\diamond j}+y_{01\iota j})}{2b},\ e^{-\left(\frac{\pi}{b}\right)^2\eta_{yj}\tau}\right)--$$

$$\Theta_3^{\iint}\left(\frac{\pi(y_{02\diamond j}-y_{02\iota j})}{2b},\ e^{-\left(\frac{\pi}{b}\right)^2\eta_{yj}\tau}\right)+$$

$$\Theta_3^{\iint}\left(\frac{\pi(y_{01\diamond j}-y_{02\iota j})}{2b},\ e^{-\left(\frac{\pi}{b}\right)^2\eta_{yj}\tau}\right)++\Theta_3^{\iint}\left(\right.$$

$$\left.\frac{\pi(y_{02\diamond j}+y_{02\iota j})}{2b},\ e^{-\left(\frac{\pi}{b}\right)^2\eta_{yj}\tau}\right)-\Theta_3^{\iint}\left(\frac{\pi(y_{01\diamond j}+y_{02\iota j})}{2b},\ e^{-\left(\frac{\pi}{b}\right)^2\eta_{yj}\tau}\right)\Bigg\}$$

$$d\tau++\frac{1}{2\pi^2(\phi c_t)_j(d_{j+1}-d_j)(x_{02\diamond j}-x_{01\diamond j})(y_{02\diamond j}-y_{01\diamond j})}$$

$$\sum_{\iota=N_\iota+1}^{N_d}U(t-t_{0\iota j})\sin\vartheta_{0\iota j}\times\times\int_0^{\tau-t_{0\iota j}}q_{\iota j}(t-t_{0\iota j}-\tau)$$

$$\int_{z_{01\iota j}}^{z_{02\iota j}}\Bigg[\left\{\Theta_3^{\int}\left(\frac{\pi}{2b}\{y_{02\diamond j}-(z_{0\iota j}-\gamma_{0\iota j})\cot\vartheta_{0\iota j}\sin\theta_{0\iota j}\},\ e^{-\left(\frac{\pi}{b}\right)^2\eta_{yj}\tau}\right)-\right.$$

$$-\Theta_3^{\int}\left(\frac{\pi}{2b}\{y_{01\diamond j}-(z_{0\iota j}-\gamma_{0\iota j})\cot\vartheta_{0\iota j}\sin\theta_{0\iota j}\},\ e^{-\left(\frac{\pi}{b}\right)^2\eta_{yj}\tau}\right)++$$

$$\Theta_3^{\int}\left(\frac{\pi}{2b}\{y_{02\diamond j}+(z_{0\iota j}-\gamma_{0\iota j})\cot\vartheta_{0\iota j}\sin\theta_{0\iota j}\},\ e^{-\left(\frac{\pi}{b}\right)^2\eta_{yj}\tau}\right)--$$

$$\left.\Theta_3^{\int}\left(\frac{\pi}{2b}\{y_{01\diamond j}+(z_{0\iota j}-\gamma_{0\iota j})\cot\vartheta_{0\iota j}\sin\theta_{0\iota j}\},\ e^{-\left(\frac{\pi}{b}\right)^2\eta_{yj}\tau}\right)\right\}\times\times$$

$$\left\{\Theta_3^{\int}\left(\frac{\pi}{2a}\{x_{02\diamond j}-(z_{0\iota j}-\gamma_{0\iota j})\cot\vartheta_{0\iota j}\sin\theta_{0\iota j}\},\ e^{-\left(\frac{\pi}{a}\right)^2\eta_{xj}\tau}\right)--\right.$$

$$\Theta_3^{\int}\left(\frac{\pi}{2a}\{x_{01\diamond j}-(z_{0\iota j}-\gamma_{0\iota j})\cot\vartheta_{0\iota j}\sin\theta_{0\iota j}\},\ e^{-\left(\frac{\pi}{a}\right)^2\eta_{xj}\tau}\right)++$$

$$\Theta_3^{\int}\left(\frac{\pi}{2a}\{x_{02\diamond j}+(z_{0\iota j}-\gamma_{0\iota j})\cot\vartheta_{0\iota j}\sin\theta_{0\iota j}\},\ e^{-\left(\frac{\pi}{a}\right)^2\eta_{xj}\tau}\right)--$$

$$\left.\Theta_3^{\int}\left(\frac{\pi}{2a}\{x_{01\diamond j}+(z_{0\iota j}-\gamma_{0\iota j})\cot\vartheta_{0\iota j}\sin\theta_{0\iota j}\},\ e^{-\left(\frac{\pi}{a}\right)^2\eta_{xj}\tau}\right)\right\}\times\times$$

$$\left.\left\{\Theta_3\left(\frac{\pi}{2d}\{(z-z_{0\iota j}),\ e^{-\left(\frac{\pi}{d}\right)^2\eta_{yj}\tau}\right)+\Theta_3\left(\frac{\pi}{2d}\{(z+z_{0\iota j}),\ e^{-\left(\frac{\pi}{d}\right)^2\eta_{yj}\tau}\right)\right\}\right]$$

$$d z_{0\iota j}d\tau++\frac{2ab}{(\phi c_t)_j(d_{j+1}-d_j)(x_{02\diamond j}-x_{01\diamond j})(y_{02\diamond j}-y_{01\diamond j})}\sum_{\iota=N_d+1}^{L_r}U(t-t_{0\iota j})$$

$$\int_0^{\tau-t_{0\iota j}}q_{\iota j}(t-t_{0\iota j}-\tau)\times\times\left\{\Theta_3^{\iint}\left(\frac{\pi(x_{02\diamond j}-x_{01\iota j})}{2a},\ e^{-\left(\frac{\pi}{a}\right)^2\eta_{xj}\tau}\right)-\right.$$

$$\Theta_3^{\iint}\left(\frac{\pi(x_{01\diamond j}-x_{01\iota j})}{2a},\ e^{-\left(\frac{\pi}{a}\right)^2\eta_{xj}\tau}\right)--\Theta_3^{\iint}\left(\frac{\pi(x_{02\diamond j}+x_{01\iota j})}{2a},\right.$$

$$\left.e^{-\left(\frac{\pi}{a}\right)^2\eta_{xj}\tau}\right)+\Theta_3^{\iint}\left(\frac{\pi(x_{01\diamond j}+x_{01\iota j})}{2a},\ e^{-\left(\frac{\pi}{a}\right)^2\eta_{xj}\tau}\right)--$$

$$\Theta_3^{\iint}\left(\frac{\pi(x_{02\diamond j}-x_{02\iota j})}{2a},\ e^{-\left(\frac{\pi}{a}\right)^2\eta_{xj}\tau}\right)+$$

-continued $$\Theta_3^{\iint}\left(\frac{\pi(x_{01\diamond j}-x_{02\iota j})}{2a},\ e^{-\left(\frac{\pi}{a}\right)^2\eta_{xj}\tau}\right)+$$

$$+\Theta_3^{\iint}\left(\frac{\pi(x_{02\diamond j}+x_{02\iota j})}{2a},\ e^{-\left(\frac{\pi}{a}\right)^2\eta_{xj}\tau}\right)-\Theta_3^{\iint}\left(\frac{\pi(x_{01\diamond j}+x_{02\iota j})}{2a},\ e^{-\left(\frac{\pi}{a}\right)^2\eta_{xj}\tau}\right)\Bigg\}+\times$$

$$\left\{\Theta_3^{\iint}\left(\frac{\pi(y_{02\diamond j}-y_{01\iota j})}{2a},\ e^{-\left(\frac{\pi}{b}\right)^2\eta_{yj}\tau}\right)-\right.$$

$$\Theta_3^{\iint}\left(\frac{\pi(y_{01\diamond j}-y_{01\iota j})}{2b},\ e^{-\left(\frac{\pi}{b}\right)^2\eta_{yj}\tau}\right)--$$

$$\Theta_3^{\iint}\left(\frac{\pi(y_{02\diamond j}+y_{01\iota j})}{2b},\ e^{-\left(\frac{\pi}{b}\right)^2\eta_{yj}\tau}\right)+$$

$$\Theta_3^{\iint}\left(\frac{\pi(y_{01\diamond j}+y_{01\iota j})}{2b},\ e^{-\left(\frac{\pi}{b}\right)^2\eta_{yj}\tau}\right)--$$

$$\Theta_3^{\iint}\left(\frac{\pi(y_{02\diamond j}-y_{02\iota j})}{2b},\ e^{-\left(\frac{\pi}{b}\right)^2\eta_{yj}\tau}\right)+$$

$$\Theta_3^{\iint}\left(\frac{\pi(y_{01\diamond j}-y_{02\iota j})}{2b},\ e^{-\left(\frac{\pi}{b}\right)^2\eta_{yj}\tau}\right)++$$

$$\Theta_3^{\iint}\left(\frac{\pi(y_{02\diamond j}+y_{02\iota j})}{2b},\ e^{-\left(\frac{\pi}{b}\right)^2\eta_{yj}\tau}\right)-$$

$$\left.\Theta_3^{\iint}\left(\frac{\pi(y_{01\diamond j}+y_{02\iota j})}{2b},\ e^{-\left(\frac{\pi}{b}\right)^2\eta_{yj}\tau}\right)\right\}\times\times$$

$$\left\{\Theta_3\left(\frac{\pi(z-z_{0\iota j})}{2(d_{j+1}-d_j)},\ e^{-\left(\frac{\pi}{d_{j+1}-d_j}\right)^2\eta_{zj}\tau}\right)+\right.$$

$$\left.\Theta_3\left(\frac{\pi(z+z_{0\iota j}-2d_j)}{2(d_{j+1}-d_j)},\ e^{-\left(\frac{\pi}{d_{j+1}-d_j}\right)^2\eta_{zj}\tau}\right)\right\}d\tau++$$

$$\frac{2b}{(\phi c_t)_j(x_{02\diamond j}-x_{01\diamond j})(y_{02\diamond j}-y_{01\diamond j})}\sum_{\iota=L_r+1}^{M_r}U(t-t_{0\iota j})$$

$$\int_0^{\tau-t_{0\iota j}}q_{\iota j}(t-t_{0\iota j}-\tau)\times$$

$$\times\left\{\Theta_3^{\int}\left(\frac{\pi(x_{02\diamond j}-x_{02\iota j})}{2a},\ e^{-\left(\frac{\pi}{a}\right)^2\eta_{xj}\tau}\right)-\right.$$

$$\Theta_3^{\int}\left(\frac{\pi(x_{01\diamond j}-x_{0\iota j})}{2a},\ e^{-\left(\frac{\pi}{a}\right)^2\eta_{xj}\tau}\right)++\Theta_3^{\int}\left(\frac{\pi(x_{02\diamond j}+x_{0\iota j})}{2a},\ e^{-\left(\frac{\pi}{a}\right)^2\eta_{xj}\tau}\right)-$$

$$\left.\Theta_3^{\int}\left(\frac{\pi(x_{01\diamond j}+x_{0\iota j})}{2a},\ e^{-\left(\frac{\pi}{a}\right)^2\eta_{xj}\tau}\right)\right\}\times\times$$

$$\left\{\Theta_3^{\iint}\left(\frac{\pi(y_{02\diamond j}-y_{01\iota j})}{2a},\ e^{-\left(\frac{\pi}{b}\right)^2\eta_{yj}\tau}\right)-\Theta_3^{\iint}\left(\frac{\pi(y_{01\diamond j}-y_{01\iota j})}{2b},\ e^{-\left(\frac{\pi}{b}\right)^2\eta_{yj}\tau}\right)--\right.$$

$$\Theta_3^{\iint}\left(\frac{\pi(y_{02\diamond j}+y_{01\iota j})}{2b},\ e^{-\left(\frac{\pi}{b}\right)^2\eta_{yj}\tau}\right)+$$

$$\Theta_3^{\iint}\left(\frac{\pi(y_{01\diamond j}+y_{01\iota j})}{2b},\ e^{-\left(\frac{\pi}{b}\right)^2\eta_{yj}\tau}\right)--$$

$$\Theta_3^{\iint}\left(\frac{\pi(y_{02\diamond j}-y_{02\iota j})}{2b},\ e^{-\left(\frac{\pi}{b}\right)^2\eta_{yj}\tau}\right)+$$

$$\Theta_3^{\iint}\left(\frac{\pi(y_{01\diamond j}-y_{02\iota j})}{2b},\ e^{-\left(\frac{\pi}{b}\right)^2\eta_{yj}\tau}\right)++$$

$$\Theta_3^{\iint}\left(\frac{\pi(y_{02\diamond j}+y_{02\iota j})}{2b},\ e^{-\left(\frac{\pi}{b}\right)^2\eta_{yj}\tau}\right)-$$

$$\Theta_3^{\iint}\left(\frac{\pi(y_{01\diamond j}+y_{02\iota j})}{2b},\ e^{-\left(\frac{\pi}{b}\right)^2\eta_{yj}\tau}\right)\Bigg\}\times\times$$

-continued $$\left\{\Theta_3^{\int}\left(\frac{\pi(z-z_{01\iota j})}{2(d_{j+1}-d_j)},\ e^{-\left(\frac{\pi}{d_{j+1}-d_j}\right)^2\eta_{zj}\tau}\right)-\right.$$

$$\Theta_3^{\int}\left(\frac{\pi(z+z_{01\iota j}-2d_j)}{2(d_{j+1}-d_j)},\ e^{-\left(\frac{\pi}{d_{j+1}-d_j}\right)^2\eta_{zj}\tau}\right)--$$

$$\Theta_3^{\int}\left(\frac{\pi(z-z_{02\iota j})}{2(d_{j+1}-d_j)},\ e^{-\left(\frac{\pi}{d_{j+1}-d_j}\right)^2\eta_{zj}\tau}\right)+$$

$$\left.\Theta_3^{\int}\left(\frac{\pi(z+z_{02\iota j}-2d_j)}{2(d_{j+1}-d_j)},\ e^{-\left(\frac{\pi}{d_{j+1}-d_j}\right)^2\eta_{zj}\tau}\right)\right\}$$

$$d\tau++\frac{2a}{(\phi c_t)_j(x_{02\diamond j}-x_{01\diamond j})(y_{02\diamond j}-y_{01\diamond j})}$$

$$\sum_{\iota=M_r+1}^{N_r}U(t-t_{0\iota j})$$

$$\int_0^{t-t_{0\iota j}}q_{\iota j}(t-t_{0\iota j}-\tau)\times\times\left\{\Theta_3^{\int\int}\left(\frac{\pi(x_{02\diamond j}-x_{01\iota j})}{2a},\ e^{-\left(\frac{\pi}{a}\right)^2\eta_{xj}\tau}\right)-\right.$$

$$\Theta_3^{\int\int}\left(\frac{\pi(x_{01\diamond j}-x_{01\iota j})}{2a},\ e^{-\left(\frac{\pi}{a}\right)^2\eta_{xj}\tau}\right)--$$

$$\Theta_3^{\int\int}\left(\frac{\pi(x_{02\diamond j}+x_{01\iota j})}{2a},\ e^{-\left(\frac{\pi}{a}\right)^2\eta_{xj}\tau}\right)+$$

$$\Theta_3^{\int\int}\left(\frac{\pi(x_{01\diamond j}+x_{01\iota j})}{2a},\ e^{-\left(\frac{\pi}{a}\right)^2\eta_{xj}\tau}\right)-$$

$$-\Theta_3^{\int\int}\left(\frac{\pi(x_{02\diamond j}-x_{02\iota j})}{2a},\ e^{-\left(\frac{\pi}{a}\right)^2\eta_{xj}\tau}\right)+\Theta_3^{\int\int}\left(\frac{\pi(x_{01\diamond j}-x_{02\iota j})}{2a},\ e^{-\left(\frac{\pi}{a}\right)^2\eta_{xj}\tau}\right)++$$

$$\Theta_3^{\int\int}\left(\frac{\pi(x_{02\diamond j}+x_{02\iota j})}{2a},\ e^{-\left(\frac{\pi}{a}\right)^2\eta_{xj}\tau}\right)-$$

$$\left.\Theta_3^{\int\int}\left(\frac{\pi(x_{01\diamond j}+x_{02\iota j})}{2a},\ e^{-\left(\frac{\pi}{a}\right)^2\eta_{xj}\tau}\right)\right\}+\times$$

$$\left\{\Theta_3^{\int}\left(\frac{\pi(y_{02\diamond j}-y_{0\iota j})}{2b},\ e^{-\left(\frac{\pi}{b}\right)^2\eta_{yj}\tau}\right)-\right.$$

$$\Theta_3^{\int}\left(\frac{\pi(y_{01\diamond j}-y_{0\iota j})}{2b},\ e^{-\left(\frac{\pi}{b}\right)^2\eta_{yj}\tau}\right)++\Theta_3^{\int}\left(\frac{\pi(y_{02\diamond j}+y_{0\iota j})}{2b},\ e^{-\left(\frac{\pi}{b}\right)^2\eta_{yj}\tau}\right)-$$

$$\left.\Theta_3^{\int}\left(\frac{\pi(y_{01\diamond j}+y_{0\iota j})}{2b},\ e^{-\left(\frac{\pi}{b}\right)^2\eta_{yj}\tau}\right)\right\}\times\times$$

$$\left\{\Theta_3^{\int}\left(\frac{\pi(z-z_{0\iota j})}{2(d_{j+1}-d_j)},\ e^{-\left(\frac{\pi}{d_{j+1}-d_j}\right)^2\eta_{zj}\tau}\right)-\right.$$

$$\Theta_3^{\int}\left(\frac{\pi(z+z_{01\iota j}-2d_j)}{2(d_{j+1}-d_j)},\ e^{-\left(\frac{\pi}{d_{j+1}-d_j}\right)^2\eta_{zj}\tau}\right)--$$

$$\Theta_3^{\int}\left(\frac{\pi(z-z_{02\iota j})}{2(d_{j+1}-d_j)},\ e^{-\left(\frac{\pi}{d_{j+1}-d_j}\right)^2\eta_{zj}\tau}\right)+$$

$$\left.\Theta_3^{\int}\left(\frac{\pi(z+z_{02\iota j}-2d_j)}{2(d_{j+1}-d_j)},\ e^{-\left(\frac{\pi}{d_{j+1}-d_j}\right)^2\eta_{zj}\tau}\right)\right\}d\tau++$$

$$\frac{1}{(\phi c_t)_j(d_{j+1}-d_j)(x_{02\diamond j}-x_{01\diamond j})(y_{02\diamond j}-y_{01\diamond j})}\times$$

$$\times\int_0^t\int_0^a\int_0^b\left[\psi_j(u,v,\tau)\Theta_3\left\{\frac{\pi(z-d_j)}{2(d_{j+1}-d_j)},\ e^{-\left(\frac{\pi}{d_{j+1}-d_j}\right)^2\eta_{zj}(t-\tau)}\right\}--\right.$$

-continued $$\psi_{j+1}(u,v,\tau)\Theta_4\left\{\frac{\pi(z-d_j)}{2(d_{j+1}-d_j)},\ e^{-\left(\frac{\pi}{d_{j+1}-d_j}\right)^2\eta_{zj}(t-\tau)}\right\}\Bigg]\times\times$$

$$\left[\Theta_3^{\int}\left\{\frac{\pi(x_{02\diamond j}-u)}{2a},\ e^{-\left(\frac{\pi}{a}\right)^2\eta_{xj}(t-\tau)}\right\}-\Theta_3^{\int}\left\{\frac{\pi(x_{01\diamond j}-u)}{2a},\ e^{-\left(\frac{\pi}{a}\right)^2\eta_{xj}(t-\tau)}\right\}++\right.$$

$$\Theta_3^{\int}\left\{\frac{\pi(x_{02\diamond j}+u)}{2a},\ e^{-\left(\frac{\pi}{a}\right)^2\eta_{xj}(t-\tau)}\right\}-\Theta_3^{\int}\left\{\frac{\pi(x_{01\diamond j}+u)}{2a},\ e^{-\left(\frac{\pi}{a}\right)^2\eta_{xj}(t-\tau)}\right\}\Bigg]\times\times$$

$$\left[\Theta_3^{\int}\left\{\frac{\pi(y_{02\diamond j}-v)}{2b},\ e^{-\left(\frac{\pi}{b}\right)^2\eta_{yj}(t-\tau)}\right\}-\Theta_3^{\int}\left\{\frac{\pi(y_{01\diamond j}-v)}{2b},\ e^{-\left(\frac{\pi}{b}\right)^2\eta_{yj}(t-\tau)}\right\}++\right.$$

$$\Theta_3^{\int}\left\{\frac{\pi(y_{02\diamond j}+v)}{2b},\ e^{-\left(\frac{\pi}{b}\right)^2\eta_{yj}(t-\tau)}\right\}-$$

$$\left.\Theta_3^{\int}\left\{\frac{\pi(y_{01\diamond j}+v)}{2b},\ e^{-\left(\frac{\pi}{b}\right)^2\eta_{yj}(t-\tau)}\right\}\right]du\,dv\,d\tau+$$

$$+\frac{1}{(\phi c_t)_j(d_{j+1}-d_j)(x_{02\diamond j}-x_{01\diamond j})(y_{02\diamond j}-y_{01\diamond j})}\times\times$$

$$\int_0^t\int_0^b\int_0^{d_{j+1}-d_j}\left\{\psi_{0yzj}(v,w,\tau)\left\{\Theta_3^{\int}\left(\frac{\pi x_{02\diamond j}}{2a},\ e^{-\left(\frac{\pi}{a}\right)^2\eta_{xj}(t-\tau)}\right)-\right.\right.$$

$$\left.\Theta_3^{\int}\left(\frac{\pi x_{01\diamond j}}{2a},\ e^{-\left(\frac{\pi}{a}\right)^2\eta_{xj}(t-\tau)}\right)\right\}--$$

$$\left.\psi_{ayzj}(v,w,\tau)\left\{\Theta_4^{\int}\left(\frac{\pi x_{02\diamond j}}{2a},\ e^{-\left(\frac{\pi}{a}\right)^2\eta_{xj}(t-\tau)}\right)-\Theta_4^{\int}\left(\frac{\pi x_{01\diamond j}}{2a},\ e^{-\left(\frac{\pi}{a}\right)^2\eta_{xj}(t-\tau)}\right)\right\}\right\}\times\times$$

$$\left[\Theta_3^{\int}\left\{\frac{\pi(y_{02\diamond j}-v)}{2b},\ e^{-\left(\frac{\pi}{b}\right)^2\eta_{yj}(t-\tau)}\right\}-\Theta_3^{\int}\left\{\frac{\pi(y_{01\diamond j}-v)}{2b},\ e^{-\left(\frac{\pi}{b}\right)^2\eta_{yj}(t-\tau)}\right\}++\right.$$

$$\Theta_3^{\int}\left\{\frac{\pi(y_{02\diamond j}+v)}{2b},\ e^{-\left(\frac{\pi}{b}\right)^2\eta_{yj}(t-\tau)}\right\}-$$

$$\Theta_3^{\int}\left\{\frac{\pi(y_{01\diamond j}+v)}{2b},\ e^{-\left(\frac{\pi}{b}\right)^2\eta_{yj}(t-\tau)}\right\}\Bigg]\times\times$$

$$\left[\Theta_3\left\{\frac{\pi(z-d_j-w)}{2(d_{j+1}-d_j)},\ e^{-\left(\frac{\pi}{d_{j+1}-d_j}\right)^2\eta_{zj}(t-\tau)}\right\}+\right.$$

$$\left.\Theta_3\left\{\frac{\pi(z-d_j+w)}{2(d_{j+1}-d_j)},\ e^{-\left(\frac{\pi}{d_{j+1}-d_j}\right)^2\eta_{zj}(t-\tau)}\right\}\right]dv\,dw\,d\tau+$$

$$+\frac{1}{(\phi c_t)_j(d_{j+1}-d_j)(x_{02\diamond j}-x_{01\diamond j})(y_{02\diamond j}-y_{01\diamond j})}\times\times$$

$$\int_0^t\int_0^a\int_0^{d_{j+1}-d_j}\left\{\psi_{x0zj}(u,w,\tau)\left\{\Theta_3^{\int}\left(\frac{\pi y_{02\diamond j}}{2b},\ e^{-\left(\frac{\pi}{b}\right)^2\eta_{yj}(t-\tau)}\right)-\right.\right.$$

$$\left.\Theta_3^{\int}\left(\frac{\pi y_{01\diamond j}}{2b},\ e^{-\left(\frac{\pi}{b}\right)^2\eta_{yj}(t-\tau)}\right)\right\}--$$

$$\left.\psi_{xbzj}(u,w,\tau)\left\{\Theta_4^{\int}\left(\frac{\pi y_{02\diamond j}}{2b},\ e^{-\left(\frac{\pi}{b}\right)^2\eta_{yj}(t-\tau)}\right)-\right.\right.$$

$$\left.\left.\Theta_4^{\int}\left(\frac{\pi y_{01\diamond j}}{2b},\ e^{-\left(\frac{\pi}{b}\right)^2\eta_{yj}(t-\tau)}\right)\right\}\right\}\times\times$$

$$\left[\Theta_3^{\int}\left\{\frac{\pi(x_{02\diamond j}-u)}{2a},\ e^{-\left(\frac{\pi}{a}\right)^2\eta_{xj}(t-\tau)}\right\}-\Theta_3^{\int}\left\{\frac{\pi(x_{01\diamond j}-u)}{2a},\ e^{-\left(\frac{\pi}{a}\right)^2\eta_{xj}(t-\tau)}\right\}++\right.$$

$$\Theta_3^{\int}\left\{\frac{\pi(x_{02\diamond j}+u)}{2a},\ e^{-\left(\frac{\pi}{a}\right)^2\eta_{xj}(t-\tau)}\right\}-$$

$$\Theta_3^{\int}\left\{\frac{\pi(x_{01\diamond j}+u)}{2a},\ e^{-\left(\frac{\pi}{a}\right)^2\eta_{xj}(t-\tau)}\right\}\Bigg]\times\times$$

$$\left[\Theta_3\left\{\frac{\pi(z-d_j-w)}{2(d_{j+1}-d_j)},\ e^{-\left(\frac{\pi}{d_{j+1}-d_j}\right)^2\eta_{zj}(t-\tau)}\right\}+\right.$$

$$\left.\Theta_3\left\{\frac{\pi(z-d_j+w)}{2(d_{j+1}-d_j)},\ e^{-\left(\frac{\pi}{d_{j+1}-d_j}\right)^2\eta_{zj}(t-\tau)}\right\}\right]du\,dw\,d\tau+$$

$$+\frac{1}{2(d_{j+1}-d_j)(x_{02\diamond j}-x_{01\diamond j})(y_{02\diamond j}-y_{01\diamond j})}\times\times$$

$$\int_0^{d_{j+1}-d_j}\int_0^b\int_0^a \varphi_j(u,v,w+d_j)\Big[\Theta_3^{\int}\Big\{\frac{\pi(x_{02\diamond j}-u)}{2a},\ e^{-\left(\frac{\pi}{a}\right)^2\eta_{xj}(t-\tau)}\Big\}-$$

$$\Theta_3^{\int}\Big\{\frac{\pi(x_{01\diamond j}-u)}{2a},\ e^{-\left(\frac{\pi}{a}\right)^2\eta_{xj}(t-\tau)}\Big\}++$$

$$\Theta_3^{\int}\Big\{\frac{\pi(x_{02\diamond j}+u)}{2a},\ e^{-\left(\frac{\pi}{a}\right)^2\eta_{xj}(t-\tau)}\Big\}-$$

$$\Theta_3^{\int}\Big\{\frac{\pi(x_{01\diamond j}+u)}{2a},\ e^{-\left(\frac{\pi}{a}\right)^2\eta_{xj}(t-\tau)}\Big\}\Big]\times\times$$

$$\Big[\Theta_3^{\int}\Big\{\frac{\pi(y_{02\diamond j}-v)}{2b},\ e^{-\left(\frac{\pi}{b}\right)^2\eta_{yj}(t-\tau)}\Big\}-$$

$$\Theta_3^{\int}\Big\{\frac{\pi(y_{01\diamond j}-v)}{2b},\ e^{-\left(\frac{\pi}{b}\right)^2\eta_{yj}(t-\tau)}\Big\}++$$

$$\Theta_3^{\int}\Big\{\frac{\pi(y_{02\diamond j}+v)}{2b},\ e^{-\left(\frac{\pi}{b}\right)^2\eta_{yj}(t-\tau)}\Big\}-$$

$$\Theta_3^{\int}\Big\{\frac{\pi(y_{01\diamond j}+v)}{2b},\ e^{-\left(\frac{\pi}{b}\right)^2\eta_{yj}(t-\tau)}\Big\}\Big]\times\times$$

$$\Big\{\Theta_3\Big\{\frac{\pi(z-d_j-w)}{2(d_{j+1}-d_j)},\ e^{-\left(\frac{\pi}{d_{j+1}-d_j}\right)^2\eta_{zj}t}\Big\}+$$

$$\Theta_3\Big\{\frac{\pi(z-d_j+w)}{2(d_{j+1}-d_j)},\ e^{-\left(\frac{\pi}{d_{j+1}-d_j}\right)^2\eta_{zj}t}\Big\}\Big\}\Big]dudvdw$$

The spatial average pressure response of the rectangle $[(y_{02\diamond j}-y_{01\diamond j})(z_{02\diamond j}-z_{01\diamond j})]$, $\iota=\diamond$, $L_r+1\leqq\diamond\leqq M_r$ is given by $$p_j=\frac{(d_{j+1}-d_j)}{(\phi c_t)_j a(y_{02\diamond j}-y_{01\diamond j})(z_{02\diamond j}-z_{01\diamond j})}\tag{0.16}$$

$$\sum_{\iota=1}^{L_l}U(t-t_{0\iota j})\int_0^{t-t_{0\iota j}}q_{\iota j}(t-t_{0\iota j}-\tau)\times\times\Big\{\Theta_3\Big(\frac{\pi(x-x_{0j})}{2a},$$

$$e^{-\left(\frac{\pi}{a}\right)^2\eta_{xj}\tau}\Big)+\Theta_3\Big(\frac{\pi(x+x_{0j})}{2a},\ e^{-\left(\frac{\pi}{a}\right)^2\eta_{xj}\tau}\Big)\Big\}\times\times$$

$$\Big\{\Theta_3^{\int}\Big(\frac{\pi(y_{02\diamond j}-y_{0\iota j})}{2b},\ e^{-\left(\frac{\pi}{b}\right)^2\eta_{yj}\tau}\Big)-$$

$$\Theta_3^{\int}\Big(\frac{\pi(y_{01\diamond j}-y_{0\iota j})}{2b},\ e^{-\left(\frac{\pi}{b}\right)^2\eta_{yj}\tau}\Big)++$$

$$\Theta_3^{\int}\Big(\frac{\pi(y_{02\diamond j}+y_{0\iota j})}{2b},\ e^{-\left(\frac{\pi}{b}\right)^2\eta_{yj}\tau}\Big)-$$

$$\Theta_3^{\int}\Big(\frac{\pi(y_{01\diamond j}+y_{0\iota j})}{2b},\ e^{-\left(\frac{\pi}{b}\right)^2\eta_{yj}\tau}\Big)\Big\}\times\times$$

$$\Big\{\Theta_3^{\iint}\Big(\frac{\pi(z_{02\diamond j}-z_{01\iota j})}{2(d_{j+1}-d_j)},\ e^{-\left(\frac{\pi}{d_{j+1}-d_j}\right)^2\eta_{zj}\tau}\Big)-$$

$$\Theta_3^{\iint}\Big(\frac{\pi(z_{01\diamond j}-z_{01\iota j})}{2(d_{j+1}-d_j)},\ e^{-\left(\frac{\pi}{d_{j+1}-d_j}\right)^2\eta_{zj}\tau}\Big)--$$

$$\Theta_3^{\iint}\Big(\frac{\pi(z_{02\diamond j}+z_{01\iota j}-2d_j)}{2(d_{j+1}-d_j)},$$

$$e^{-\left(\frac{\pi}{d_{j+1}-d_j}\right)^2\eta_{zj}\tau}\Big)+$$

$$\Theta_3^{\iint}\Big(\frac{\pi(z_{01\diamond j}+z_{01\iota j}-2d_j)}{2(d_{j+1}-d_j)},\ e^{-\left(\frac{\pi}{d_{j+1}-d_j}\right)^2\eta_{zj}\tau}\Big)--$$

$$\Theta_3^{\iint}\Big(\frac{\pi(z_{02\diamond j}-z_{02\iota j})}{2(d_{j+1}-d_j)},\ e^{-\left(\frac{\pi}{d_{j+1}-d_j}\right)^2\eta_{zj}\tau}\Big)+$$

-continued $$\Theta_3^{\iint}\Big(\frac{\pi(z_{02\diamond j}-z_{01\iota j})}{2(d_{j+1}-d_j)},\ e^{-\left(\frac{\pi}{d_{j+1}-d_j}\right)^2\eta_{zj}\tau}\Big)++$$

$$\Theta_3^{\iint}\Big(\frac{\pi(z_{02\diamond j}+z_{02\iota j}-2d_j)}{2(d_{j+1}-d_j)},\ e^{-\left(\frac{\pi}{d_{j+1}-d_j}\right)^2\eta_{zj}\tau}\Big)-$$

$$\Theta_3^{\iint}\Big(\frac{\pi(z_{01\diamond j}+z_{02\iota j}-2d_j)}{2(d_{j+1}-d_j)},\ e^{-\left(\frac{\pi}{d_{j+1}-d_j}\right)^2\eta_{zj}\tau}\Big)\Big\}d\tau+$$

$$+\frac{1}{(\phi c_t)_j(y_{02\diamond j}-y_{01\diamond j})(z_{02\diamond j}-z_{01\diamond j})}\sum_{\iota=L_l+1}^{M_l}U(t-t_{0\iota j})$$

$$\int_0^{t-t_{0\iota j}}q_{\iota j}(t-t_{0\iota j}-\tau)\times\times\Big\{\Theta_3^{\int}\Big(\frac{\pi(y_{02\diamond j}-y_{0\iota j})}{2b},\ e^{-\left(\frac{\pi}{b}\right)^2\eta_{yj}\tau}\Big)-$$

$$\Theta_3^{\int}\Big(\frac{\pi(y_{01\diamond j}-y_{0\iota j})}{2b},\ e^{-\left(\frac{\pi}{b}\right)^2\eta_{yj}\tau}\Big)++$$

$$\Theta_3^{\int}\Big(\frac{\pi(y_{02\diamond j}+y_{0\iota j})}{2b},\ e^{-\left(\frac{\pi}{b}\right)^2\eta_{yj}\tau}\Big)-\Theta_3^{\int}\Big(\frac{\pi(y_{01\diamond j}+y_{0\iota j})}{2b},\ e^{-\left(\frac{\pi}{b}\right)^2\eta_{yj}\tau}\Big)\Big\}\times\times$$

$$\Big\{\Theta_3^{\int}\Big\{\frac{\pi(z_{02\diamond j}-z_{0\iota j})}{2(d_{j+1}-d_j)},\ e^{-\left(\frac{\pi}{d_{j+1}-d_j}\right)^2\eta_{zj}(t-\tau)}\Big\}-$$

$$\Theta_3^{\int}\Big\{\frac{\pi(z_{01\diamond j}-z_{0\iota j})}{2(d_{j+1}-d_j)},\ e^{-\left(\frac{\pi}{d_{j+1}-d_j}\right)^2\eta_{zj}(t-\tau)}\Big\}++$$

$$\Theta_3^{\int}\Big\{\frac{\pi(z_{02\diamond j}+z_{0\iota j}-2d_j)}{2(d_{j+1}-d_j)},\ e^{-\left(\frac{\pi}{d_{j+1}-d_j}\right)^2\eta_{zj}(t-\tau)}\Big\}-$$

$$\Theta_3^{\int}\Big\{\frac{\pi(z_{01\diamond j}+z_{0\iota j}-2d_j)}{2(d_{j+1}-d_j)},\ e^{-\left(\frac{\pi}{d_{j+1}-d_j}\right)^2\eta_{zj}(t-\tau)}\Big\}\Big\}\times\times$$

$$\Big\{\Theta_3^{\int}\Big(\frac{\pi(x-x_{01\iota j})}{2a},\ e^{-\left(\frac{\pi}{a}\right)^2\eta_{xj}\tau}\Big)-\Theta_3^{\int}\Big(\frac{\pi(x+x_{01\iota j})}{2a},\ e^{-\left(\frac{\pi}{a}\right)^2\eta_{xj}\tau}\Big)--$$

$$\Theta_3^{\int}\Big(\frac{\pi(x-x_{02\iota j})}{2a},\ e^{-\left(\frac{\pi}{a}\right)^2\eta_{xj}\tau}\Big)+\Theta_3^{\int}\Big(\frac{\pi(x+x_{02\iota j})}{2a},\ e^{-\left(\frac{\pi}{a}\right)^2\eta_{xj}\tau}\Big)\Big\}d\tau+$$

$$+\frac{b}{(\phi c_t)_j a(y_{02\diamond j}-y_{01\diamond j})(z_{02\diamond j}-z_{01\diamond j})}$$

$$\sum_{\iota=M_l+1}^{N_l}U(t-t_{0\iota j})\int_0^{t-t_{0\iota j}}q_{\iota j}(t-t_{0\iota j}-\tau)\times\times$$

$$\Big\{\Theta_3\Big(\frac{\pi(x-x_{0\iota j})}{2a},\ e^{-\left(\frac{\pi}{a}\right)^2\eta_{xj}\tau}\Big)+\Theta_3\Big(\frac{\pi(x+x_{0\iota j})}{2a},\ e^{-\left(\frac{\pi}{a}\right)^2\eta_{xj}\tau}\Big)\Big\}\times\times$$

$$\Big\{\Theta_3^{\int}\Big\{\frac{\pi(z_{02\diamond j}-z_{0\iota j})}{2(d_{j+1}-d_j)},\ e^{-\left(\frac{\pi}{d_{j+1}-d_j}\right)^2\eta_{zj}(t-\tau)}\Big\}-$$

$$\Theta_3^{\int}\Big\{\frac{\pi(z_{01\diamond j}-z_{0\iota j})}{2(d_{j+1}-d_j)},\ e^{-\left(\frac{\pi}{d_{j+1}-d_j}\right)^2\eta_{zj}(t-\tau)}\Big\}+\Theta_3^{\int}$$

$$\Big\{\frac{\pi(z_{02\diamond j}+z_{0\iota j}-2d_j)}{2(d_{jl}-d_j)},\ e^{-\left(\frac{\pi}{d_{j+1}-d_j}\right)^2\eta_{zj}(t-\tau)}\Big\}-$$

$$\Theta_3^{\int}\Big\{\frac{\pi(z_{01\diamond j}+z_{0\iota j}-2d_j)}{2(d_{jl}-d_j)},\ e^{-\left(\frac{\pi}{d_{j+1}-d_j}\right)^2\eta_{zj}(t-\tau)}\Big\}\Big\}\times\times$$

$$\Big\{\Theta_3^{\iint}\Big(\frac{\pi(y_{02\diamond j}-y_{01\iota j})}{2a},\ e^{-\left(\frac{\pi}{b}\right)^2\eta_{yj}\tau}\Big)-$$

$$\Theta_3^{\iint}\Big(\frac{\pi(y_{01\diamond j}-y_{01\iota j})}{2b},\ e^{-\left(\frac{\pi}{b}\right)^2\eta_{yj}\tau}\Big)--$$

-continued $$\Theta_3^{\int\int}\left(\frac{\pi(y_{02\diamond j}+y_{01\iota j})}{2b},\ e^{-\left(\frac{\pi}{b}\right)^2\eta_{yj}\tau}\right)+\Theta_3^{\int\int}\left(\frac{\pi(y_{01\diamond j}+y_{01\iota j})}{2b},\ e^{-\left(\frac{\pi}{b}\right)^2\eta_{yj}\tau}\right)--$$

$$\Theta_3^{\int\int}\left(\frac{\pi(y_{02\diamond j}-y_{02\iota j})}{2b},\ e^{-\left(\frac{\pi}{b}\right)^2\eta_{yj}\tau}\right)+$$

$$\Theta_3^{\int\int}\left(\frac{\pi(y_{01\diamond j}-y_{02\iota j})}{2b},\ e^{-\left(\frac{\pi}{b}\right)^2\eta_{yj}\tau}\right)++$$

$$\Theta_3^{\int\int}\left(\frac{\pi(y_{02\diamond j}+y_{02\iota j})}{2b},\ e^{-\left(\frac{\pi}{b}\right)^2\eta_{yj}\tau}\right)-\Theta_3^{\int\int}\left(\frac{\pi(y_{01\diamond j}+y_{02\iota j})}{2b},\ e^{-\left(\frac{\pi}{b}\right)^2\eta_{yj}\tau}\right)\Bigg\}d\tau+$$

$$+\frac{1}{2\pi^2(\phi c_t)_j a(y_{02\diamond j}-y_{01\diamond j})(z_{02\diamond j}-z_{01\diamond j})}$$

$$\sum_{\iota=N_t+1}^{N_d}U(t-t_{0\iota j})\sin\vartheta_{0\iota j}\times\times\int_0^{t-t_{0\iota j}}q_j(t-t_{0\iota j}-\tau)$$

$$\int_{z_{01\iota j}}^{z_{02\iota j}}\Bigg[\Bigg\{\Theta_3\left(\frac{\pi}{2a}\{x-(z_{0\iota j}-\gamma_{0\iota j})\cot\vartheta_{0\iota j}\cos\theta_{0\iota j}\},\ e^{-\left(\frac{\pi}{a}\right)^2\eta_{xj}\tau}\right)++$$

$$\Theta_3\left(\frac{\pi}{2a}\{x+(z_{0\iota j}-\gamma_{0\iota j})\cot\vartheta_{0\iota j}\cos\theta_{0\iota j}\},\ e^{-\left(\frac{\pi}{a}\right)^2\eta_{xj}\tau}\right)\Bigg\}\times\times$$

$$\Bigg\{\Theta_3^{\int}\left(\frac{\pi}{2b}\{y_{02\diamond j}-(z_{0\iota j}-\gamma_{0\iota j})\cot\vartheta_{0\iota j}\sin\theta_{0\iota j}\},\ e^{-\left(\frac{\pi}{b}\right)^2\eta_{yj}\tau}\right)--$$

$$\Theta_3^{\int}\left(\frac{\pi}{2b}\{y_{01\diamond j}-(z_{0\iota j}-\gamma_{0\iota j})\cot\vartheta_{0\iota j}\sin\theta_{0\iota j}\},\ e^{-\left(\frac{\pi}{b}\right)^2\eta_{yj}\tau}\right)++$$

$$\Theta_3^{\int}\left(\frac{\pi}{2b}\{y_{02\diamond j}+(z_{0\iota j}-\gamma_{0\iota j})\cot\vartheta_{0\iota j}\sin\theta_{0\iota j}\},\ e^{-\left(\frac{\pi}{b}\right)^2\eta_{yj}\tau}\right)--$$

$$\Theta_3^{\int}\left(\frac{\pi}{2b}\{y_{01\diamond j}+(z_{0\iota j}-\gamma_{0\iota j})\cot\vartheta_{0\iota j}\sin\theta_{0\iota j}\},\ e^{-\left(\frac{\pi}{b}\right)^2\eta_{yj}\tau}\right)\Bigg\}\times\times$$

$$\Bigg\{\Theta_3^{\int}\left(\frac{\pi(z_{02\diamond j}-z_{0\iota j})}{2(d_{j+1}-d_j)},\ e^{-\eta_{zj}\left(\frac{\pi}{d_{j+1}-d_j}\right)^2 t}\right)-$$

$$\Theta_3^{\int}\left(\frac{\pi(z_{01\diamond j}-z_{0\iota j})}{2(d_{j+1}-d_j)},\ e^{-\eta_{zj}\left(\frac{\pi}{d_{j+1}-d_j}\right)^2 t}\right)++$$

$$\Theta_3^{\int}\left(\frac{\pi(z_{02\diamond j}+z_{0\iota j}-2d_j)}{2(d_{j+1}-d_j)},\ e^{-\eta_{zj}\left(\frac{\pi}{d_{j+1}-d_j}\right)^2 t}\right)-$$

$$\Theta_3^{\int}\frac{\pi(z_{01\diamond j}+z_{0\iota j}-2d_j)}{2(d_{j+1}-d_j)},\ e^{-\eta_{zj}\left(\frac{\pi}{d_{j+1}-d_j}\right)^2 t}\Bigg\}\Bigg\}\Bigg]dz_{0\iota j}d\tau+$$

$$+\frac{2b}{(\phi c_t)_j(y_{02\diamond j}-y_{01\diamond j})(z_{02\diamond j}-z_{01\diamond j})}$$

$$\sum_{\iota=N_d+1}^{L_r}U(t-t_{0\iota j})\int_0^{t-t_{0\iota j}}q_{\iota j}(t-t_{0\iota j}-\tau)\times\times$$

$$\Bigg\{\Theta_3^{\int}\left(\frac{\pi(x-x_{01\iota j})}{2a},\ e^{-\left(\frac{\pi}{a}\right)^2\eta_{xj}\tau}\right)-\Theta_3^{\int}\left(\frac{\pi(x+x_{01\iota j})}{2a},\ e^{-\left(\frac{\pi}{a}\right)^2\eta_{xj}\tau}\right)--$$

$$\Theta_3^{\int}\left(\frac{\pi(x-x_{02\iota j})}{2a},\ e^{-\left(\frac{\pi}{a}\right)^2\eta_{xj}\tau}\right)+\Theta_3^{\int}\left(\frac{\pi(x+x_{02\iota j})}{2a},\ e^{-\left(\frac{\pi}{a}\right)^2\eta_{xj}\tau}\right)\Bigg\}\times\times$$

$$\Bigg\{\Theta_3^{\int\int}\left(\frac{\pi(y_{02\diamond j}-y_{01\iota j})}{2a},\ e^{-\left(\frac{\pi}{b}\right)^2\eta_{yj}\tau}\right)-\Theta_3^{\int\int}\left(\frac{\pi(y_{01\diamond j}-y_{01\iota j})}{2b},\ e^{-\left(\frac{\pi}{b}\right)^2\eta_{yj}\tau}\right)--$$

$$\Theta_3^{\int\int}\left(\frac{\pi(y_{02\diamond j}+y_{01\iota j})}{2b},\ e^{-\left(\frac{\pi}{b}\right)^2\eta_{yj}\tau}\right)+\Theta_3^{\int\int}\left(\frac{\pi(y_{01\diamond j}+y_{01\iota j})}{2b},\ e^{-\left(\frac{\pi}{b}\right)^2\eta_{yj}\tau}\right)--$$

$$\Theta_3^{\int\int}\left(\frac{\pi(y_{02\diamond j}-y_{02\iota j})}{2b},\ e^{-\left(\frac{\pi}{b}\right)^2\eta_{yj}\tau}\right)+\Theta_3^{\int\int}\left(\frac{\pi(y_{01\diamond j}-y_{02\iota j})}{2b},\ e^{-\left(\frac{\pi}{b}\right)^2\eta_{yj}\tau}\right)++$$

$$\Theta_3^{\int\int}\left(\frac{\pi(y_{02\diamond j}+y_{02\iota j})}{2b},\ e^{-\left(\frac{\pi}{b}\right)^2\eta_{yj}\tau}\right)-$$

-continued $$\Theta_3^{\int\int}\left(\frac{\pi(y_{01\diamond j}+y_{02\iota j})}{2b},\ e^{-\left(\frac{\pi}{b}\right)^2\eta_{yj}\tau}\right)\Bigg\}\times\times$$

$$\Bigg\{\Theta_3^{\int}\left\{\frac{\pi(z_{02\diamond j}-z_{0\iota j})}{2(d_{j+1}-d_j)},\ e^{-\left(\frac{\pi}{d_{j+1}-d_j}\right)^2\eta_{zj}(t-\tau)}\right\}-$$

$$\Theta_3^{\int}\left\{\frac{\pi(z_{01\diamond j}-z_{0\iota j})}{2(d_{j+1}-d_j)},\ e^{-\left(\frac{\pi}{d_{j+1}-d_j}\right)^2\eta_{zj}(t-\tau)}\right\}++$$

$$\Theta_3^{\int}\left\{\frac{\pi(z_{02\diamond j}+z_{0\iota j}-2d_j)}{2(d_{j+1}-d_j)},\ e^{-\left(\frac{\pi}{d_{j+1}-d_j}\right)^2\eta_{zj}(t-\tau)}\right\}-$$

$$\Theta_3^{\int}\left\{\frac{\pi(z_{01\diamond j}+z_{0\iota j}-2d_j)}{2(d_{j+1}-d_j)},\ e^{-\left(\frac{\pi}{d_{j+1}-d_j}\right)^2\eta_{zj}(t-\tau)}\right\}\Bigg\}d\tau+$$

$$+\frac{2b(d_{j+1}-d_j)}{(\phi c_t)_j a(y_{02\diamond j}-y_{01\diamond j})(z_{02\diamond j}-z_{01\diamond j})}$$

$$\sum_{\iota=L_r+1}^{M_r}U(t-t_{0\iota j})\int_0^{t-t_{0\iota j}}q_{\iota j}(t-t_{0\iota j}-\tau)\times\times$$

$$\Bigg\{\Theta_3\left(\frac{\pi(x-x_{0\iota j})}{2a},\ e^{-\left(\frac{\pi}{a}\right)^2\eta_{xj}\tau}\right)+\Theta_3\left(\frac{\pi(x+x_{0\iota j})}{2a},\ e^{-\left(\frac{\pi}{a}\right)^2\eta_{xj}\tau}\right)\Bigg\}\times\times$$

$$\Bigg\{\Theta_3^{\int\int}\left(\frac{\pi(y_{02\diamond j}-y_{01\iota j})}{2a},\ e^{-\left(\frac{\pi}{b}\right)^2\eta_{yj}\tau}\right)-$$

$$\Theta_3^{\int\int}\left(\frac{\pi(y_{01\diamond j}-y_{01\iota j})}{2b},\ e^{-\left(\frac{\pi}{b}\right)^2\eta_{yj}\tau}\right)--$$

$$\Theta_3^{\int\int}\left(\frac{\pi(y_{02\diamond j}+y_{01\iota j})}{2b},\ e^{-\left(\frac{\pi}{b}\right)^2\eta_{yj}\tau}\right)+\Theta_3^{\int\int}\left(\frac{\pi(y_{01\diamond j}+y_{01\iota j})}{2b},\ e^{-\left(\frac{\pi}{b}\right)^2\eta_{yj}\tau}\right)--$$

$$\Theta_3^{\int\int}\left(\frac{\pi(y_{02\diamond j}-y_{01\iota j})}{2b},\ e^{-\left(\frac{\pi}{b}\right)^2\eta_{yj}\tau}\right)+$$

$$\Theta_3^{\int\int}\left(\frac{\pi(y_{01\diamond j}-y_{01\iota j})}{2b},\ e^{-\left(\frac{\pi}{b}\right)^2\eta_{yj}\tau}\right)++$$

$$\Theta_3^{\int\int}\left(\frac{\pi(y_{02\diamond j}+y_{02\iota j})}{2b},\ e^{-\left(\frac{\pi}{b}\right)^2\eta_{yj}\tau}\right)-\Theta_3^{\int\int}\left(\frac{\pi(y_{01\diamond j}+y_{02\iota j})}{2b},\ e^{-\left(\frac{\pi}{b}\right)^2\eta_{yj}\tau}\right)\Bigg\}\times\times$$

$$\Bigg\{\Theta_3^{\int\int}\left(\frac{\pi(z_{02\diamond j}-z_{01\iota j})}{2(d_{j+1}-d_j)},\ e^{-\left(\frac{\pi}{d_{j+1}-d_j}\right)^2\eta_{zj}\tau}\right)-$$

$$\Theta_3^{\int\int}\left(\frac{\pi(z_{01\diamond j}-z_{01\iota j})}{2(d_{j+1}-d_j)},\ e^{-\left(\frac{\pi}{d_{j+1}-d_j}\right)^2\eta_{zj}\tau}\right)--$$

$$\Theta_3^{\int\int}\left(\frac{\pi(z_{02\diamond j}+z_{01\iota j}-2d_j)}{2(d_{j+1}-d_j)},\ e^{-\left(\frac{\pi}{d_{j+1}-d_j}\right)^2\eta_{zj}\tau}\right)+$$

$$\Theta_3^{\int\int}\left(\frac{\pi(z_{01\diamond j}+z_{01\iota j}-2d_j)}{2(d_{j+1}-d_j)},\ e^{-\left(\frac{\pi}{d_{j+1}-d_j}\right)^2\eta_{zj}\tau}\right)--$$

$$\Theta_3^{\int\int}\left(\frac{\pi(z_{02\diamond j}-z_{02\iota j})}{2(d_{j+1}-d_j)},\ e^{-\left(\frac{\pi}{d_{j+1}-d_j}\right)^2\eta_{zj}\tau}\right)+$$

$$\Theta_3^{\int\int}\left(\frac{\pi(z_{02\diamond j}-z_{01\iota j})}{2(d_{j+1}-d_j)},\ e^{-\left(\frac{\pi}{d_{j+1}-d_j}\right)^2\eta_{zj}\tau}\right)++$$

$$\Theta_3^{\int\int}\left(\frac{\pi(z_{02\diamond j}+z_{02\iota j}-2d_j)}{2(d_{j+1}-d_j)},\ e^{-\left(\frac{\pi}{d_{j+1}-d_j}\right)^2\eta_{zj}\tau}\right)-$$

$$\Theta_3^{\int\int}\left(\frac{\pi(z_{01\diamond j}+z_{02\iota j}-2d_j)}{2(d_{j+1}-d_j)},\ e^{-\left(\frac{\pi}{d_{j+1}-d_j}\right)^2\eta_{zj}\tau}\right)\Bigg\}d\tau+$$

$$+\frac{2(d_{j+1}-d_j)}{(\phi c_t)_j(y_{02\diamond j}-y_{01\diamond j})(z_{02\diamond j}-z_{01\diamond j})}$$

-continued $$\sum_{i=M_r+1}^{N_r} U(t-t_{0i,j})\int_0^{t-t_{0i,j}} q_{i,j}(t-t_{0i,j}-\tau)\times\times$$

$$\left\{\Theta_3^{\int}\left(\frac{\pi(x-x_{01i,j})}{2a},\ e^{-\left(\frac{\pi}{a}\right)^2\eta_{xj}\tau}\right)-\Theta_3^{\int}\left(\frac{\pi(x+x_{01i,j})}{2a},\ e^{-\left(\frac{\pi}{a}\right)^2\eta_{xj}\tau}\right)--\right.$$

$$\left.\Theta_3^{\int}\left(\frac{\pi(x-x_{02i,j})}{2a},\ e^{-\left(\frac{\pi}{a}\right)^2\eta_{xj}\tau}\right)+\Theta_3^{\int}\left(\frac{\pi(x+x_{02i,j})}{2a},\ e^{-\left(\frac{\pi}{a}\right)^2\eta_{xj}\tau}\right)\right\}\times\times$$

$$\left\{\Theta_3^{\int}\left(\frac{\pi(y_{02\diamond j}-y_{0i,j})}{2b},\ e^{-\left(\frac{\pi}{b}\right)^2\eta_{yj}\tau}\right)-\Theta_3^{\int}\left(\frac{\pi(y_{01\diamond j}-y_{0i,j})}{2b},\ e^{-\left(\frac{\pi}{b}\right)^2\eta_{yj}\tau}\right)++\right.$$

$$\Theta_3^{\int}\left(\frac{\pi(y_{02\diamond j}+y_{0i,j})}{2b},\ e^{-\left(\frac{\pi}{b}\right)^2\eta_{yj}\tau}\right)-$$

$$\left.\Theta_3^{\int}\left(\frac{\pi(y_{01\diamond j}+y_{0i,j})}{2b},\ e^{-\left(\frac{\pi}{b}\right)^2\eta_{yj}\tau}\right)\right\}\times\times$$

$$\left\{\Theta_3^{\int\int}\left(\frac{\pi(z_{02\diamond j}-z_{01i,j})}{2(d_{j+1}-d_j)},\ e^{-\left(\frac{\pi}{d_{j+1}-d_j}\right)^2\eta_{zj}\tau}\right)-\right.$$

$$\Theta_3^{\int\int}\left(\frac{\pi(z_{01\diamond j}-z_{01i,j})}{2(d_{j+1}-d_j)},\ e^{-\left(\frac{\pi}{d_{j+1}-d_j}\right)^2\eta_{zj}\tau}\right)--$$

$$\Theta_3^{\int\int}\left(\frac{\pi(z_{02\diamond j}+z_{01i,j}-2d_j)}{2(d_{j+1}-d_j)},\ e^{-\left(\frac{\pi}{d_{j+1}-d_j}\right)^2\eta_{zj}\tau}\right)+$$

$$\Theta_3^{\int\int}\left(\frac{\pi(z_{01\diamond j}+z_{01i,j}-2d_j)}{2(d_{j+1}-d_j)},\ e^{-\left(\frac{\pi}{d_{j+1}-d_j}\right)^2\eta_{zj}\tau}\right)--$$

$$\Theta_3^{\int\int}\left(\frac{\pi(z_{02\diamond j}-z_{02i,j})}{2(d_{j+1}-d_j)},\ e^{-\left(\frac{\pi}{d_{j+1}-d_j}\right)^2\eta_{zj}\tau}\right)+$$

$$\Theta_3^{\int\int}\left(\frac{\pi(z_{02\diamond j}-z_{01i,j})}{2(d_{j+1}-d_j)},\ e^{-\left(\frac{\pi}{d_{j+1}-d_j}\right)^2\eta_{zj}\tau}\right)+$$

$$+\Theta_3^{\int\int}\left(\frac{\pi(z_{02\diamond j}+z_{02i,j}-2d_j)}{2(d_{j+1}-d_j)},\ e^{-\left(\frac{\pi}{d_{j+1}-d_j}\right)^2\eta_{zj}\tau}\right)-$$

$$\left.\Theta_3^{\int\int}\left(\frac{\pi(z_{01\diamond j}+z_{02i,j}-2d_j)}{2(d_{j+1}-d_j)},\ e^{-\left(\frac{\pi}{d_{j+1}-d_j}\right)^2\eta_{zj}\tau}\right)\right\}d\tau++$$

$$\frac{1}{(\phi c_t)_j a(y_{02\diamond j}-y_{01\diamond j})(z_{02\diamond j}-z_{01\diamond j})}\times\times$$

$$\int_0^t\int_0^a\int_0^b\left[\psi_j(u,v,\tau)\left\{\Theta_3^{\int}\left\{\frac{\pi(z_{02\diamond j}-d_j)}{2(d_{j+1}-d_j)},\ e^{-\left(\frac{\pi}{d_{j+1}-d_j}\right)^2\eta_{zj}(t-\tau)}\right\}--\right.\right.$$

$$\left.\Theta_3^{\int}\left\{\frac{\pi(z_{01\diamond j}-d_j)}{2(d_{j+1}-d_j)},\ e^{-\left(\frac{\pi}{d_{j+1}-d_j}\right)^2\eta_{zj}(t-\tau)}\right\}\right\}--$$

$$\psi_{j+1}(u,v,\tau)\left\{\Theta_4^{\int}\left\{\frac{\pi(z_{02\diamond j}-d_j)}{2(d_{j+1}-d_j)},\ e^{-\left(\frac{\pi}{d_{j+1}-d_j}\right)^2\eta_{zj}(t-\tau)}\right\}--\right.$$

$$\left.\left.\Theta_4^{\int}\left\{\frac{\pi(z_{01\diamond j}-d_j)}{2(d_{j+1}-d_j)},\ e^{-\left(\frac{\pi}{d_{j+1}-d_j}\right)^2\eta_{zj}(t-\tau)}\right\}\right\}\right]\times\times$$

$$\left[\Theta_3\left\{\frac{\pi(x-u)}{2a},\ e^{-\left(\frac{\pi}{a}\right)^2\eta_{xj}(t-\tau)}\right\}+\Theta_3\left\{\frac{\pi(x+u)}{2a},\ e^{-\left(\frac{\pi}{a}\right)^2\eta_{xj}(t-\tau)}\right\}\right]\times\times$$

$$\left[\Theta_3^{\int}\left\{\frac{\pi(y_{02\diamond j}-v)}{2b},\ e^{-\left(\frac{\pi}{b}\right)^2\eta_{yj}(t-\tau)}\right\}-\Theta_3^{\int}\left\{\frac{\pi(y_{01\diamond j}-v)}{2b},\ e^{-\left(\frac{\pi}{b}\right)^2\eta_{yj}(t-\tau)}\right\}++\right.$$

$$\Theta_3^{\int}\left\{\frac{\pi(y_{02\diamond j}+v)}{2b},\ e^{-\left(\frac{\pi}{b}\right)^2\eta_{yj}(t-\tau)}\right\}-$$

$$\left.\Theta_3^{\int}\left\{\frac{\pi(y_{01\diamond j}+v)}{2b},\ e^{-\left(\frac{\pi}{b}\right)^2\eta_{yj}(t-\tau)}\right\}\right]dudvd\tau+$$

$$+\frac{1}{(\phi c_t)_j a(y_{02\diamond j}-y_{01\diamond j})(z_{02\diamond j}-z_{01\diamond j})}\times\times$$

$$\int_0^t\int_0^b\int_0^{d_{j+1}-d_j}\left\{\psi_{0yzj}(v,w,\tau)\Theta_3\left(\frac{\pi x}{2a},\ e^{-\left(\frac{\pi}{a}\right)^2\eta_{xj}(t-\tau)}\right)-\right.$$

$$\left.\psi_{0yzj}(v,w,\tau)\Theta_4\left(\frac{\pi x}{2a},\ e^{-\left(\frac{\pi}{a}\right)^2\eta_{xj}(t-\tau)}\right)\right\}\times\times$$

$$\left[\Theta_3^{\int}\left\{\frac{\pi(y_{02\diamond j}-v)}{2b},\ e^{-\left(\frac{\pi}{b}\right)^2\eta_{yj}(t-\tau)}\right\}-\right.$$

$$\Theta_3^{\int}\left\{\frac{\pi(y_{01\diamond j}-v)}{2b},\ e^{-\left(\frac{\pi}{b}\right)^2\eta_{yj}(t-\tau)}\right\}++$$

$$\Theta_3^{\int}\left\{\frac{\pi(y_{02\diamond j}+v)}{2b},\ e^{-\left(\frac{\pi}{b}\right)^2\eta_{yj}(t-\tau)}\right\}-$$

$$\left.\Theta_3^{\int}\left\{\frac{\pi(y_{01\diamond j}+v)}{2b},\ e^{-\left(\frac{\pi}{b}\right)^2\eta_{yj}(t-\tau)}\right\}\right]\times\times$$

$$\left\{\Theta_3^{\int}\left\{\frac{\pi(z_{02\diamond j}-d_j-w)}{2(d_{j+1}-d_j)},\ e^{-\left(\frac{\pi}{d_{j+1}-d_j}\right)^2\eta_{zj}(t-\tau)}\right\}-\right.$$

$$\Theta_3^{\int}\left\{\frac{\pi(z_{01\diamond j}-d_j-w)}{2(d_{j+1}-d_j)},\ e^{-\left(\frac{\pi}{d_{j+1}-d_j}\right)^2\eta_{zj}(t-\tau)}\right\}+\times$$

$$\Theta_3^{\int}\left\{\frac{\pi(z_{02\diamond j}-d_j+w)}{2(d_{j+1}-d_j)},\ e^{-\left(\frac{\pi}{d_{j+1}-d_j}\right)^2\eta_{zj}(t-\tau)}\right\}-$$

$$\left.\Theta_3^{\int}\left\{\frac{\pi(z_{01\diamond j}-d_j+w)}{2(d_{j+1}-d_j)},\ e^{-\left(\frac{\pi}{d_{j+1}-d_j}\right)^2\eta_{zj}(t-\tau)}\right\}\right\}dvdwd\tau++$$

$$\frac{1}{(\phi c_t)_j a(y_{02\diamond j}-y_{01\diamond j})(z_{02\diamond j}-z_{01\diamond j})}\times\times$$

$$\int_0^t\int_0^a\int_0^{d_{j+1}-d_j}\left\{\psi_{x0zj}(v,w,\tau)\left\{\Theta_3^{\int}\left(\frac{\pi y_{02\diamond j}}{2b},\ e^{-\left(\frac{\pi}{b}\right)^2\eta_{yj}(t-\tau)}\right)-\right.\right.$$

$$\Theta_3^{\int}\left(\frac{\pi y_{01\diamond j}}{2b},\ e^{-\left(\frac{\pi}{b}\right)^2\eta_{yj}(t-\tau)}\right)\right\}--$$

$$\left.\psi_{xbzj}(v,w,\tau)\left\{\Theta_4^{\int}\left(\frac{\pi y_{02\diamond j}}{2b},\ e^{-\left(\frac{\pi}{b}\right)^2\eta_{yj}(t-\tau)}\right)-\Theta_4^{\int}\left(\frac{\pi y_{01\diamond j}}{2b},\ e^{-\left(\frac{\pi}{b}\right)^2\eta_{yj}(t-\tau)}\right)\right\}\right\}\times$$

$$\times\left[\Theta_3\left\{\frac{\pi(x-u)}{2a},\ e^{-\left(\frac{\pi}{a}\right)^2\eta_{xj}(t-\tau)}\right\}+\Theta_3\left\{\frac{\pi(x+u)}{2a},\ e^{-\left(\frac{\pi}{a}\right)^2\eta_{xj}(t-\tau)}\right\}\right]\times\times$$

$$\left\{\Theta_3^{\int}\left\{\frac{\pi(z_{02\diamond j}-d_j-w)}{2(d_{j+1}-d_j)},\ e^{-\left(\frac{\pi}{d_{j+1}-d_j}\right)^2\eta_{zj}(t-\tau)}\right\}-\right.$$

$$\Theta_3^{\int}\left\{\frac{\pi(z_{01\diamond j}-d_j-w)}{2(d_{j+1}-d_j)},\ e^{-\left(\frac{\pi}{d_{j+1}-d_j}\right)^2\eta_{zj}(t-\tau)}\right\}+\times$$

$$\Theta_3^{\int}\left\{\frac{\pi(z_{02\diamond j}-d_j+w)}{2(d_{j+1}-d_j)},\ e^{-\left(\frac{\pi}{d_{j+1}-d_j}\right)^2\eta_{zj}(t-\tau)}\right\}-$$

$$\left.\Theta_3^{\int}\left\{\frac{\pi(z_{01\diamond j}-d_j+w)}{2(d_{j+1}-d_j)},\ e^{-\left(\frac{\pi}{d_{j+1}-d_j}\right)^2\eta_{zj}(t-\tau)}\right\}\right\}dvdwd\tau++$$

$$\frac{1}{2a(y_{02\diamond j}-y_{01\diamond j})(z_{02\diamond j}-z_{01\diamond j})}\times\times$$

$$\int_0^{d_{j+1}-d_j}\int_0^b\int_0^a\varphi_j(u,v,w+d_j)$$

$$\left[\left\{\Theta_3\left(\frac{\pi(x-u)}{2a},\ e^{-\left(\frac{\pi}{a}\right)^2\eta_{xj}t}\right)+\Theta_3\left(\frac{\pi(x+u)}{2a},\ e^{-\left(\frac{\pi}{a}\right)^2\eta_{xj}t}\right)\right\}\times\times\right.$$

$$\left[\Theta_3^{\int}\left\{\frac{\pi(y_{02\diamond j}-v)}{2b},\ e^{-\left(\frac{\pi}{b}\right)^2\eta_{yj}(t-\tau)}\right\}-\right.$$

$$\Theta_3^{\int}\left\{\frac{\pi(y_{01\diamond j}-v)}{2b},\ e^{-\left(\frac{\pi}{b}\right)^2\eta_{yj}(t-\tau)}\right\}++$$

$$\Theta_3^{\int}\left\{\frac{\pi(y_{02\diamond j}+v)}{2b},\ e^{-\left(\frac{\pi}{b}\right)^2\eta_{yj}(t-\tau)}\right\}-$$

-continued $$\Theta_3\int\left\{\frac{\pi(y_{01\diamond j}+v)}{2b},\ e^{-\left(\frac{\pi}{b}\right)^2\eta_{yj}(t-\tau)}\right\}\Bigg]\times\times$$

$$\left\{\Theta_3\int\left\{\frac{\pi(z_{02\diamond j}-d_j-w)}{2(d_{j+1}-d_j)},\ e^{-\left(\frac{\pi}{d_{j+1}-d_j}\right)^2\eta_{zj}t}\right\}-\right.$$

$$\Theta_3\int\left\{\frac{\pi(z_{01\diamond j}-d_j-w)}{2(d_{j+1}-d_j)},\ e^{-\left(\frac{\pi}{d_{j+1}-d_j}\right)^2\eta_{zj}t}\right\}+\times$$

$$\Theta_3\int\left\{\frac{\pi(z_{02\diamond j}-d_j+w)}{2(d_{j+1}-d_j)},\ e^{-\left(\frac{\pi}{d_{j+1}-d_j}\right)^2\eta_{zj}t}\right\}-$$

$$\left.\Theta_3\int\left\{\frac{\pi(z_{01\diamond j}-d_j+w)}{2(d_{j+1}-d_j)},\ e^{-\left(\frac{\pi}{d_{j+1}-d_j}\right)^2\eta_{zj}t}\right\}\right\}dudvdw$$

Figure 4:
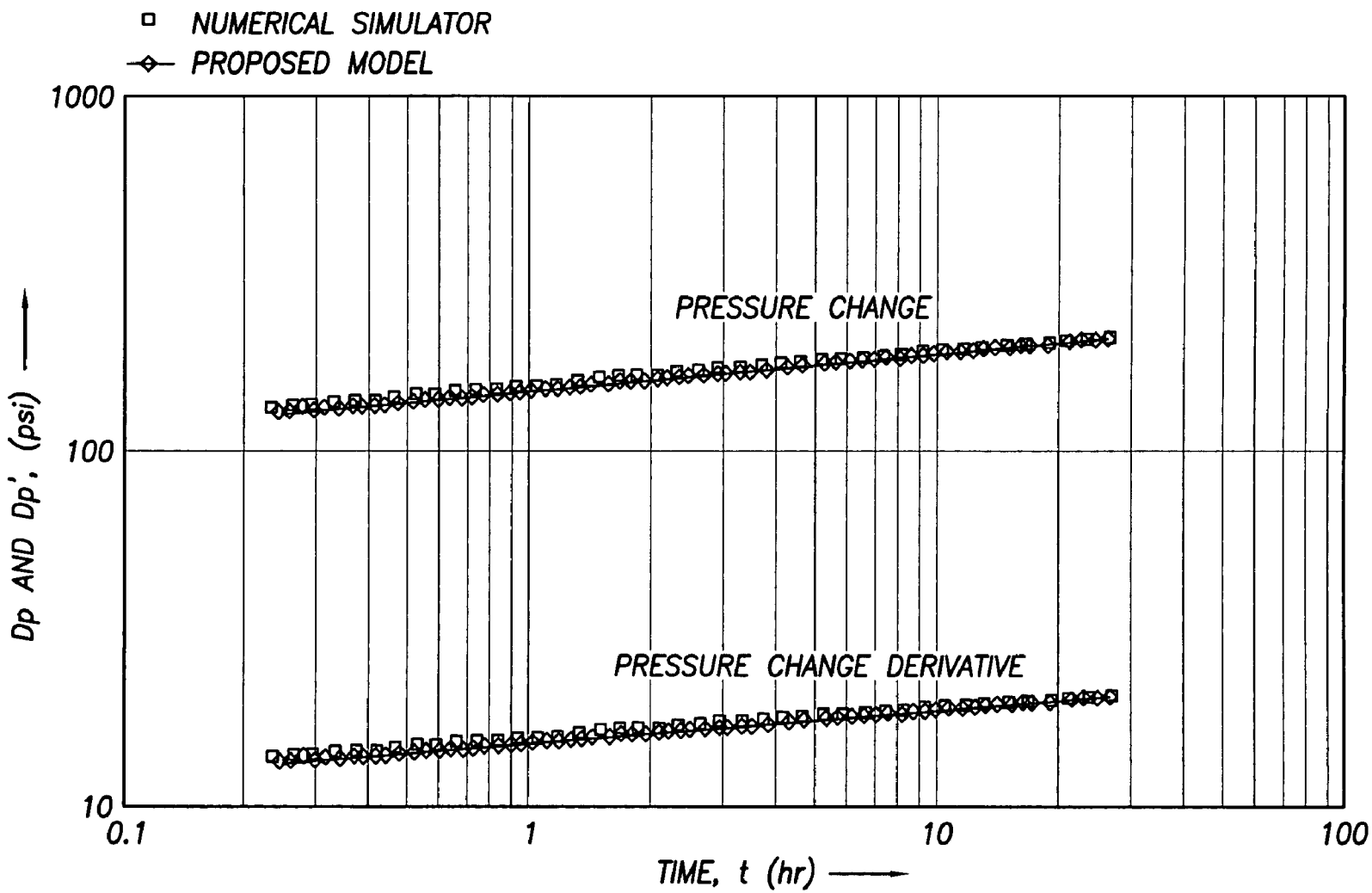
FIG. 4 illustrates a pressure/pressure derivative comparison with a numerical simulator for a deviated well.

Refer now to FIG. 4 which illustrates a pressure/pressure derivative comparison with a numerical simulator for a deviated well.

In FIG. 4, specifically, for a high angle deviated well, the pressure output by the fast simulator was validated against a numerical simulator for accuracy and speed. The pressure and pressure derivative match is presented in FIG. 4. In this case, the new solution took three (3) seconds to execute compared to four (4) minutes for a numerical simulator. Another important point to note here is that it took considerable time (i.e., half a day) to create the finely gridded numerical model and ensure that it was relatively free from grid effects. The analytical model, on the other hand, was completely gridless and could be created with a few mouse clicks.

Pseudo Two Phase Pressure

The base equation is strictly valid for a slightly compressible single phase fluid. However, we have applied suitable linearization methods for gas (compressible fluid) and multiphase applications. Specifically for gas, we have used the real gas pseudo pressure concept as described by (Al-Hussainy, Ramey, and Crawford 1966). At low pressures, linearization was improved by using pseudo time (Agarwal 1979). On the other hand, for multiphase flow, we used the two-phase pseudo pressure concept as described by (Raghavaan 1976). Two phase pseudo pressure is given by $$m(p)=\int_0^p\frac{k_{ro}}{\mu_o B_o}dp \tag{0.17}$$

$k_{ro}$ is not really a function of pressure but of saturation. The trick here is to find how saturation ($S_o$) is related to pressure. A relationship can be obtained through experiment and is based on the following equation $$R=R_s+\frac{k_g\mu_o B_o}{k_o\mu_g B_g} \tag{0.18}$$

Please note that R is measured producing gas-oil ratio at the surface.

1. From well test tabulate t, p and R.
2. From PVT and well test calculate $k_g/k_o$ using Equation 2.
3. From relative-permeability curves (experiment or Corey's correlation) calculate $k_g/k_o$ as a function of $S_o$.
4. From the above get p vs $S_o$. Warning: Extrapolation may be necessary for the next step.
5. Now for any p we can get $k_{ro}$.
6. Using numerical integration get m(p) for all p Note that for build-up (the well is shut in) a modification of the above procedure is necessary. In such a case in Equation 2 use for R the value prior to shut in.

As can be seen from above evaluation of the pseudo pressure integral requires knowledge of pressure-saturation relationship. This is often difficult to find for long time prediction. However, for term tests with proper measurements the procedure described above can realistically be applied.

Nomenclature a Width of the layer, m.

b Bredth of the layer, m.

$c_t$ Compressibility, $P_a^{-1}$.

$\phi$ Porosity, fraction.

$d_{j+1}-d_j$ Layer thickness, m.

$k_x$, $k_y$, $k_z$ Permeability in the x, y and z direction, $m^2$ $\mu$ Viscosity, $P_a\cdot s$.

$$\eta_{xj}=\left(\frac{k_x}{\phi c_t\mu}\right)_j,\ \eta_{yj}=\left(\frac{k_y}{\phi c_t\mu}\right)_j\ \text{and}\ \eta_{zj}=\left(\frac{k_z}{\phi c_t\mu}\right)_j$$

Diffusion coefficients $p_j$ Pressure in the jth layer, $P_a$.

$q_{\iota j}$ Production rate of the ιth well or fracture in the jth layer, $m^3/s$.

t Time, s.

$t_{0\iota j}$ Stat time of production of the ιth well or fracture in the jth layer, s.

$\theta_{0\iota j}$ The inclination to the x-y plane of the ιth well or fracture in the jth layer $\gamma_{0j}$ The intercept to the z axis of the ιth well or fracture in the jth layer $$U(t-t_0)=\begin{cases}0 & t<t_0\\ 1 & t>t_0\end{cases}\quad \textit{Heaviside's}\ \text{Unit step function}$$

*s Laplace* variable.

$$\ni_m=\begin{cases}\frac{1}{2} & m=0\\ 1 & m=1,2,3,\ldots\end{cases}$$

$$\Theta_3(\pi x,e^{-\pi^2 t})=\begin{cases}1+2\sum_{n=1}^{\infty}e^{-n^2\pi^2 t}\cos(2n\pi x) & e^{-\pi^2 t}>\frac{1}{\pi}\\ \frac{1}{\sqrt{\pi t}}\sum_{n=-\infty}^{\infty}e^{-\frac{(x+n)^2}{t}} & e^{-\pi^2 t}\le\frac{1}{\pi}\end{cases}$$

-continued

Eliptic theta function of the third kind $$\Theta_3^f(\pi x, e^{-\pi^2 t}) = \int_0^x \Theta_3(\pi u, e^{-\pi^2 t})du = \begin{cases} x + \frac{1}{\pi}\sum_{n=1}^{\infty} \frac{e^{-n^2\pi^2 t}}{n}\sin(2n\pi x) & e^{-\pi^2 t} > \frac{1}{\pi} \\ \frac{1}{2}\sum_{n=-\infty}^{\infty}\left\{\mathrm{erf}\left(\frac{x+n}{\sqrt{t}}\right) - \mathrm{erf}\left(\frac{n}{\sqrt{t}}\right)\right\} & e^{-\pi^2 t} \le \frac{1}{\pi} \end{cases}$$

Integral of Eliptic theta function of the third kind $$\Theta_3^{ff}(\pi x, e^{-\pi^2 t}) = \int_0^x \Theta_3^f(\pi u, e^{-\pi^2 t})du ==$$

$$\begin{cases} \frac{x^2}{2} + \frac{1}{2\pi^2}\sum_{n=1}^{\infty} \frac{e^{-n^2\pi^2 t}}{n^2}\{1 - \cos(2n\pi x)\} & e^{-\pi^2 t} > \frac{1}{\pi} \\ \frac{1}{2}\sum_{n=-\infty}^{\infty}\left\{(x+n)\mathrm{erf}\left(\frac{x+n}{\sqrt{t}}\right) + \sqrt{\frac{t}{\pi}}\left(e^{-\frac{(x+n)^2}{t}} - e^{-\frac{n^2}{t}}\right) - n\,\mathrm{erf}\left(\frac{n}{\sqrt{t}}\right)\right\} & e^{-\pi^2 t} \le \frac{1}{\pi} \end{cases}$$

Second integral of Eliptic theta function of the third kind

REFERENCES

Agarwal, R. (1979, September). Real gas pseudo-time—a new function for pressure buildup analysis of mhf gas wells. *SPE* (8279), 23-26.

Al-Hussainy, R., H. J. J. Ramey, and P. Crawford (1966). The flow of real gases through porous media. *Trans SPE AMIE*.

Banerjee, R., R. K. M. Thambynayagam, and J. B. Spath (2005). A method for analysis of pressure response with a formation tester influenced by supercharging. *SPE* (102413).

Brehm, A. D. K. and C. D. Ward (2005). Pre-drill planning saves money. *E&P*.

Brie, A., T. Endo, D. L. Johnson, and F. Pampuri. Quantitative formation permeability evaluation from stoneley waves. *SPE* (49131).

Busswell, G. S., R. Banerjee, R. K. M. Thambynayagam, and J. B. Spath (2006). Generalized analytical solution for reservoir problems with multiple wells and boundary conditions. *SPE* (99288).

Chang, Y., P. S. Hammond, and J. Pop. When should we worry about supercharging in formation pressure while drilling measurements? *SPE*. (92380).

ECLIPSE-Manual (2007). Houston: Schlumberger Information Solutions.

Hammond, P. and J. Pop. Correcting super-charging information pressurements made while drilling. *SPE*. (95710).

Herron, M., D. L. Johnson, and L. M. Schwartz. A robust permeability estimator for siliciclastics. *SPE*. (49301).

Raghavan, R. (1976, September). Well test analysis: Wells producing by solution gas drive. *Trans SPE AMIE*.

Ramakrishnan, T. S. and D. J. Wilkinson. Water cut and fractional flow logs from array induction measurements. *SPE*. (36503).

Shi, C., L. Gaoming, P. Alvaro, and A. C. Reynolds. A well test for in-situ determination of relative permeability curves. *SPE*. (96414).

Each of the 'References' set forth above are incorporated by reference into the specification of this application.

The above description of the 'NPV Max Software' being thus described, it will be obvious that the same may be varied in many ways. Such variations are not to be regarded as a departure from the spirit and scope of the claimed method or system or program storage device or computer program, and all such modifications as would be obvious to one skilled in the art are intended to be included within the scope of the following claims.

We claim:

1. A method for determining an optimum trajectory of a wellbore being drilled into a reservoir, comprising:

(a) modeling a corresponding reservoir in a simulator, said corresponding reservoir having a plurality of stations;

(b) determining a plurality of net present values corresponding, respectively, to the plurality of stations of the corresponding reservoir;

(c) determining, from among the plurality of net present values, a subset of maximum ones, relative to a predetermined threshold, of the plurality of net present values;

(d) determining, from among the plurality of stations of the corresponding reservoir, a subset of stations which correspond, respectively, to the subset of maximum ones of the plurality of net present values; and (e) drilling said wellbore in said reservoir along a path which corresponds to the subset of stations, the optimum trajectory of the wellbore being drilled into the reservoir corresponding to said path.

2. The method of claim 1, wherein the determining step (b) comprises: constructing a base model adapted for predicting a production performance of the wellbore.

3. The method of claim 2, wherein the determining step (b) further comprises:

acquiring data from the wellbore while drilling the wellbore into the reservoir; and in response to said data, updating said base model using said data thereby generating an interim posterior model adapted for modeling an impact of the drilling of the wellbore on a future production from the reservoir into which the wellbore is being drilled.

4. The method of claim 3, wherein the determining step (b) further comprises:

converting the posterior model into a simulation model of the reservoir; and in response to the converting step, history matching the simulation model of the reservoir.

5. The method of claim 4, wherein the determining step (b) further comprises:

in response to the history matching step, generating an ensemble of simulation models, adapted for modeling an impact of the drilling of the wellbore on a future production from the reservoir into which the wellbore is being drilled, and adapted for optimizing the plurality of values of net present value corresponding, respectively, to the plurality of stations of the corresponding reservoir.

6. The method of claim 5, wherein the ensemble of simulation models optimize the plurality of values of net present value corresponding, respectively, to the plurality of stations of the corresponding reservoir by optimizing an objective function: NPV=f(WOPT, Ccosts-of-well), where 'WOPT' is a cumulative amount of oil that can be produced from a production steered well, and 'Ccosts-of-well' are total costs of starting and maintaining production from the wellbore.

7. The method of claim 6, wherein the drilling step (e) comprises:

changing a trajectory of the wellbore on a condition that the ensemble of simulation models optimizes the plurality of values of net present value corresponding, respectively, to the plurality of stations of the corresponding reservoir; and drilling said wellbore into said reservoir in accordance with the changed trajectory.

8. A method of determining an optimum drilling method associated with a drilling of a wellbore into a reservoir, comprising:

(a) modeling a corresponding reservoir in a simulator, said corresponding reservoir having a plurality of stations;

(b) determining a plurality of net present values corresponding, respectively, to the plurality of stations of the corresponding reservoir;

(c) determining, from among the plurality of net present values, a subset of maximum ones, relative to a predetermined threshold, of the plurality of net present values;

(d) determining, from among the plurality of stations of the corresponding reservoir, a subset of stations which correspond, respectively, to the subset of maximum ones of the plurality of net present values; and (e) selecting a drilling method associated with a drilling of a wellbore into a reservoir in accordance with said subset of stations which correspond, respectively, to the subset of maximum ones of the plurality of net present values.

9. The method of claim 8, wherein the determining step (b) comprises:

constructing a base model adapted for predicting a production performance of the wellbore.

10. The method of claim 9, wherein the determining step (b) further comprises:

acquiring data from the wellbore while drilling the wellbore into the reservoir; and in response to said data, updating said base model using said data thereby generating an interim posterior model adapted for modeling an impact of the drilling of the wellbore on a future production from the reservoir into which the wellbore is being drilled.

11. The method of claim 10, wherein the determining step (b) further comprises:

converting the posterior model into a simulation model of the reservoir; and in response to the converting step, history matching the simulation model of the reservoir.

12. The method of claim 11, wherein the determining step (b) further comprises:

in response to the history matching step, generating an ensemble of simulation models, adapted for modeling an impact of the drilling of the wellbore on a future production from the reservoir into which the wellbore is being drilled, and adapted for optimizing the plurality of values of net present value corresponding, respectively, to the plurality of stations of the corresponding reservoir.

13. The method of claim 12, wherein the ensemble of simulation models optimize the plurality of values of net present value corresponding, respectively, to the plurality of stations of the corresponding reservoir by optimizing an objective function: NPV=f(WOPT, Ccosts-of-well), where 'WOPT' is a cumulative amount of oil that can be produced from a production steered well, and 'Ccosts-of-well' are total costs of starting and maintaining production from the wellbore.

14. The method of claim 13, wherein the selecting step (e), adapted for selecting a drilling method associated with a drilling of a wellbore into a reservoir, comprises:

selecting a drilling method associated with a drilling of a wellbore into a reservoir on a condition that the ensemble of simulation models optimizes the plurality of values of net present value corresponding, respectively, to the plurality of stations of the corresponding reservoir.

15. A program storage device readable by a machine tangibly embodying a set of instructions executable by the machine to perform method steps for modeling a first reservoir while drilling a wellbore into a corresponding second reservoir, the first reservoir having a plurality of stations, said method steps comprising:

(a) determining, for a reservoir model of the first reservoir, a plurality of values of net present value corresponding, respectively, to the plurality of stations of the first reservoir by:

determining, for the reservoir model, a subset of maximum ones, relative to a threshold value, of said plurality of values of net present value; and determining, for the reservoir model, a subset of stations of the plurality of stations of the first reservoir which correspond to the subset of maximum ones of said plurality of values of net present value for the reservoir model, said wellbore being drilled into said corresponding second reservoir in accordance with said reservoir model.

16. The program storage device of claim 15, wherein:

said wellbore is drilled into said corresponding second reservoir in accordance with said subset of stations of the plurality of stations of the first reservoir which correspond to the subset of maximum ones of said plurality of values of net present value.

17. The program storage device of claim 15, wherein the determining step (a) comprises:

constructing a base model adapted for predicting a production performance of the wellbore.

18. The program storage device of claim 17, wherein the determining step (a) further comprises:

acquiring data from the wellbore while drilling the wellbore into the corresponding second reservoir; and in response to said data, updating said base model using said data thereby generating an interim posterior model adapted for modeling an impact of the drilling of the wellbore on a future production from the corresponding second reservoir into which the wellbore is being drilled.

19. The program storage device of claim 18, wherein the determining step (a) further comprises:

converting the posterior model into a simulation model of the corresponding second reservoir; and in response to the converting step, history matching the simulation model of the corresponding second reservoir.

20. The program storage device of claim 19, wherein the determining step (a) further comprises:

in response to the history matching step, generating an ensemble of simulation models, adapted for modeling an impact of the drilling of the wellbore on a future production from the corresponding second reservoir into which the wellbore is being drilled, and adapted for optimizing the plurality of values of net present value corresponding, respectively, to the plurality of stations of the first reservoir.

21. The program storage device of claim 20, wherein the ensemble of simulation models optimize the plurality of values of net present value corresponding, respectively, to the plurality of stations of the first reservoir by optimizing an objective function: NPV=f(WOPT, Ccosts-of-well), where 'WOPT' is a cumulative amount of oil that can be produced from a production steered well, and 'Ccosts-of-well' are total costs of starting and maintaining production from the wellbore.

22. The program storage device of claim 21, wherein: a trajectory of the wellbore is changed on a condition that the ensemble of simulation models optimizes the plurality of values of net present value corresponding, respectively, to the plurality of stations of the first reservoir; and said wellbore is drilled into said corresponding second reservoir in accordance with the changed trajectory.

23. The program storage device of claim 21, wherein: a drilling method, adapted for drilling said wellbore into said corresponding second reservoir, is changed on a condition that the ensemble of simulation models optimizes the plurality of values of net present value corresponding, respectively, to the plurality of stations of the first reservoir; and said wellbore is drilled into said corresponding second reservoir in accordance with the changed drilling method.

24. A program storage device readable by a machine tangibly embodying a set of instructions executable by the machine to perform method steps for determining an optimum trajectory of a wellbore being drilled into a reservoir, said method steps comprising:

(a) modeling a corresponding reservoir in a simulator, said corresponding reservoir having a plurality of stations;

(b) determining a plurality of net present values corresponding, respectively, to the plurality of stations of the corresponding reservoir;

(c) determining, from among the plurality of net present values, a subset of maximum ones, relative to a predetermined threshold, of the plurality of net present values;

(d) determine, from among the plurality of stations of the corresponding reservoir, a subset of stations which correspond, respectively, to the subset of maximum ones of the plurality of net present values; and said wellbore being drilled in said reservoir along a path which corresponds to the subset of stations, the optimum trajectory of the wellbore being drilled into the reservoir corresponding to said path.

25. The program storage device of claim 24, wherein the determining step (b) comprises:

constructing a base model adapted for predicting a production performance of the wellbore.

26. The program storage device of claim 25, wherein the determining step (b) further comprises:

acquiring data from the wellbore while drilling the wellbore into the reservoir; and in response to said data, updating said base model using said data thereby generating an interim posterior model adapted for modeling an impact of the drilling of the wellbore on a future production from the reservoir into which the wellbore is being drilled.

27. The program storage device of claim 26, wherein the determining step (b) further comprises:

converting the posterior model into a simulation model of the reservoir; and in response to the converting step, history matching the simulation model of the reservoir.

28. The program storage device of claim 27, wherein the determining step (b) further comprises:

in response to the history matching step, generating an ensemble of simulation models, adapted for modeling an impact of the drilling of the wellbore on a future production from the reservoir into which the wellbore is being drilled, and adapted for optimizing the plurality of values of net present value corresponding, respectively, to the plurality of stations of the corresponding reservoir.

29. The program storage device of claim 28, wherein the ensemble of simulation models optimize the plurality of values of net present value corresponding, respectively, to the plurality of stations of the corresponding reservoir by optimizing an objective function: NPV=f(WOPT, Ccosts-of-well), where 'WOPT' is a cumulative amount of oil that can be produced from a production steered well, and 'Ccosts-of-well' are total costs of starting and maintaining production from the wellbore.

30. The program storage device of claim 29, wherein:

a trajectory of the wellbore is changed on a condition that the ensemble of simulation models optimizes the plurality of values of net present value corresponding, respectively, to the plurality of stations of the corresponding reservoir; and said wellbore is drilled into said reservoir in accordance with the changed trajectory.

31. A program storage device readable by a machine tangibly embodying a set of instructions executable by the machine to perform method steps for determining an optimum drilling method associated with a drilling of a wellbore into a reservoir, said method steps comprising:

(a) modeling a corresponding reservoir in a simulator, said corresponding reservoir having a plurality of stations;

(b) determining a plurality of net present values corresponding, respectively, to the plurality of stations of the corresponding reservoir;

(c) determining, from among the plurality of net present values, a subset of maximum ones, relative to a predetermined threshold, of the plurality of net present values;

(d) determine, from among the plurality of stations of the corresponding reservoir, a subset of stations which correspond, respectively, to the subset of maximum ones of the plurality of net present values; and (e) selecting a drilling method associated with a drilling of a wellbore into a reservoir in accordance with said subset of stations which correspond, respectively, to the subset of maximum ones of the plurality of net present values.

32. The program storage device of claim 31, wherein the determining step (b) comprises:

constructing a base model adapted for predicting a production performance of the wellbore.

33. The program storage device of claim 32, wherein the determining step (b) further comprises:

acquiring data from the wellbore while drilling the wellbore into the reservoir; and in response to said data, updating said base model using said data thereby generating an interim posterior model adapted for modeling an impact of the drilling of the wellbore on a future production from the reservoir into which the wellbore is being drilled.

34. The program storage device of claim 33, wherein the determining step (b) further comprises:

converting the posterior model into a simulation model of the reservoir; and in response to the converting step, history matching the simulation model of the reservoir.

35. The program storage device of claim 34, wherein the determining step (b) further comprises:

in response to the history matching step, generating an ensemble of simulation models, adapted for modeling an impact of the drilling of the wellbore on a future production from the reservoir into which the wellbore is being drilled, and adapted for optimizing the plurality of values of net present value corresponding, respectively, to the plurality of stations of the corresponding reservoir.

36. The program storage device of claim 35, wherein the ensemble of simulation models optimize the plurality of values of net present value corresponding, respectively, to the plurality of stations of the corresponding reservoir by optimizing an objective function: NPV=f(WOPT, Ccosts-of-well), where 'WOPT' is a cumulative amount of oil that can be produced from a production steered well, and 'Ccosts-of-well' are total costs of starting and maintaining production from the wellbore.

37. The program storage device of claim 36, wherein the selecting step (e), adapted for selecting a drilling method associated with a drilling of a wellbore into a reservoir, comprises:

selecting a drilling method associated with a drilling of a wellbore into a reservoir on a condition that the ensemble of simulation models optimizes the plurality of values of net present value corresponding, respectively, to the plurality of stations of the corresponding reservoir.

38. A system adapted for determining an optimum trajectory of a wellbore being drilled into a reservoir, comprising:

apparatus adapted for modeling a corresponding reservoir in a simulator, said corresponding reservoir having a plurality of stations;

apparatus adapted for determining a plurality of net present values corresponding, respectively, to the plurality of stations of the corresponding reservoir;

apparatus adapted for determining, from among the plurality of net present values, a subset of maximum ones, relative to a predetermined threshold, of the plurality of net present values;

apparatus adapted for determining, from among the plurality of stations of the corresponding reservoir, a subset of stations which correspond, respectively, to the subset of maximum ones of the plurality of net present values; and apparatus adapted for drilling said wellbore in said reservoir along a path which corresponds to the subset of stations, the optimum trajectory of the wellbore being drilled into the reservoir corresponding to said path.

39. A system adapted for determining an optimum drilling method associated with a drilling of a wellbore into a reservoir, comprising:

apparatus adapted for modeling a corresponding reservoir in a simulator, said corresponding reservoir having a plurality of stations;

apparatus adapted for determining a plurality of net present values corresponding, respectively, to the plurality of stations of the corresponding reservoir;

apparatus adapted for determining, from among the plurality of net present values, a subset of maximum ones, relative to a predetermined threshold, of the plurality of net present values;

apparatus adapted for determining, from among the plurality of stations of the corresponding reservoir, a subset of stations which correspond, respectively, to the subset of maximum ones of the plurality of net present values; and apparatus adapted for selecting a drilling method associated with a drilling of a wellbore into a reservoir in accordance with said subset of stations which correspond, respectively, to the subset of maximum ones of the plurality of net present values.

40. A computer readable medium storing a computer program adapted to be executed by a processor, said computer program, when executed by the processor, conducting a process for modeling a first reservoir while drilling a wellbore into a corresponding second reservoir, the first reservoir having a plurality of stations, said process comprising:

(a) determining, for a reservoir model of said first reservoir, a plurality of values of net present value corresponding, respectively, to the plurality of stations of the first reservoir by:

determining, for said reservoir model, a subset of maximum ones, relative to a threshold value, of said plurality of values of net present value; and determining, for said reservoir model, a subset of stations of the plurality of stations of the first reservoir which correspond to the subset of maximum ones of said plurality of values of net present value, said wellbore being drilled into said corresponding second reservoir in accordance with said reservoir model.

41. The computer readable medium of claim 40, wherein:

said wellbore is drilled into said corresponding second reservoir in accordance with said subset of stations of the plurality of stations of the first reservoir which correspond to the subset of maximum ones of said plurality of values of net present value.

* * * * *